United States Patent [19]

Uchiyama et al.

[11] Patent Number: 5,018,428

[45] Date of Patent: May 28, 1991

[54] ELECTRONIC MUSICAL INSTRUMENT IN WHICH MUSICAL TONES ARE GENERATED ON THE BASIS OF PITCHES EXTRACTED FROM AN INPUT WAVEFORM SIGNAL

[75] Inventors: Shigeru Uchiyama, Sayama; Katsuhiko Obata, Tachikawa, both of Japan

[73] Assignee: Casio Computer Co., Ltd., Tokyo, Japan

[21] Appl. No.: 478,759

[22] Filed: Feb. 12, 1990

Related U.S. Application Data

[63] Continuation of Ser. No. 112,780, Oct. 22, 1987, abandoned.

[30] Foreign Application Priority Data

| | | | |
|---|---|---|---|
| Oct. 24, 1986 | [JP] | Japan | 61-253487 |
| Nov. 28, 1986 | [JP] | Japan | 61-282140 |
| Nov. 28, 1986 | [JP] | Japan | 61-282142 |
| Nov. 28, 1986 | [JP] | Japan | 61-283292 |
| Dec. 1, 1986 | [JP] | Japan | 61-286228 |
| Dec. 2, 1986 | [JP] | Japan | 61-285985 |
| Dec. 3, 1986 | [JP] | Japan | 61-286745 |
| Dec. 29, 1986 | [JP] | Japan | 61-314157 |
| Jan. 12, 1987 | [JP] | Japan | 62-4714 |
| Mar. 6, 1987 | [JP] | Japan | 62-50381 |
| Mar. 6, 1987 | [JP] | Japan | 62-50382 |
| Mar. 31, 1987 | [JP] | Japan | 62-76453 |

[51] Int. Cl.[5] ..... G10H 7/00

[52] U.S. Cl. ..... 84/616; 84/615; 84/622; 84/626; 84/654; 84/681; 84/454

[58] Field of Search ..... 84/454, 615, 616, 622, 84/626-627, 653-654, 659, 662, 663, 678, 681, 692, 701, 702; 381/49, 50; 355/633, 665, 703, 711

[56] References Cited

U.S. PATENT DOCUMENTS

| | | | |
|---|---|---|---|
| 3,073,203 | 1/1963 | Evans | 84/1.16 |
| 3,546,584 | 12/1970 | Scarr | 381/49 X |
| 3,731,022 | 5/1973 | Loftus | 200/61.49 |

(List continued on next page.)

FOREIGN PATENT DOCUMENTS

| | | |
|---|---|---|
| 2014865 | 10/1978 | Fed. Rep. of Germany . |
| 55-55398 | 4/1980 | Japan . |
| 55-87196 | 7/1980 | Japan . |
| 55-152597 | 11/1980 | Japan . |
| 55-162132 | 11/1980 | Japan . |
| 55-159495 | 12/1980 | Japan . |
| 57-37074 | 8/1982 | Japan . |
| 57-58672 | 12/1982 | Japan . |
| 61-26090 | 2/1986 | Japan . |
| 61-51793 | 11/1986 | Japan . |
| 62-20871 | 5/1987 | Japan . |
| 62-163099 | 7/1987 | Japan . |
| 2,138,988 | 2/1984 | United Kingdom |

*Primary Examiner*—A. T. Grimley
*Assistant Examiner*—Matthew S. Smith
*Attorney, Agent, or Firm*—Frishauf, Holtz, Goodman & Woodward

[57] ABSTRACT

An electronic musical instrument extracts a pitch from an input waveform signal by a pitch extracting circuit, and directs a sound source circuit to generate a musical tone at the pitch based on the extracted pitch. The sound source circuit electronically generates musical tones at the pitches according to the performance. The pitch extracting circuit obtains fundamental period of the input waveform signal by detecting the time interval (t1) between these first two zero-cross points after two positive peak points of the input waveform signal are detected, by detecting a time interval (t2) between first two zero-cross points after two negative peak points of the input signal waveform are detected, or by detecting both the time intervals (t1, t2).

39 Claims, 53 Drawing Sheets

U.S. PATENT DOCUMENTS

| | | | |
|---|---|---|---|
| 4,080,867 | 3/1978 | Ratanangsu | 84/477 R |
| 4,117,757 | 10/1978 | Akamatu | 84/1.01 |
| 4,151,775 | 5/1979 | Merriman | 84/1.01 |
| 4,171,475 | 10/1979 | Erickson | 200/241 |
| 4,198,606 | 4/1980 | Baba | 84/454 |
| 4,217,808 | 8/1980 | Slepian et al. | 84/454 |
| 4,230,906 | 10/1980 | Davis | 381/49 X |
| 4,235,141 | 11/1980 | Eventoff | 84/1.01 |
| 4,263,520 | 4/1981 | Kajihata et al. | 307/350 |
| 4,280,387 | 7/1981 | Moog | 381/49 X |
| 4,286,495 | 9/1981 | Roof | 84/485 R |
| 4,300,431 | 11/1981 | DeRocco | 84/1.11 X |
| 4,321,852 | 3/1982 | Young, Jr. | 84/1.16 |
| 4,336,734 | 6/1982 | Polson | 84/1.01 |
| 4,351,216 | 9/1982 | Hamm | 84/726 |
| 4,357,852 | 11/1982 | Suenaga | 84/1.16 |
| 4,372,187 | 2/1983 | Berg | 84/1.16 |
| 4,429,609 | 2/1984 | Warrender | 84/454 |
| 4,457,203 | 7/1984 | Schoenberg | 84/454 |
| 4,468,997 | 9/1984 | Young, Jr. | 84/1.01 |
| 4,523,506 | 6/1985 | Hollimon | 84/454 |
| 4,606,255 | 8/1986 | Hayashi et al. | 84/1.16 |
| 4,627,323 | 12/1986 | Gold | 84/1.01 |
| 4,630,520 | 12/1986 | Bonanno | 84/1.16 |
| 4,633,748 | 1/1987 | Takashima et al. | 84/603 |
| 4,653,376 | 3/1987 | Allured et al. | 84/1.16 |
| 4,657,114 | 4/1987 | Shaw . | |
| 4,658,690 | 4/1987 | Aitken et al. | 84/1.14 |
| 4,688,460 | 8/1987 | McCoy | 84/1.16 |
| 4,688,464 | 8/1987 | Gibson et al. | 84/454 |
| 4,723,468 | 2/1988 | Takabayashi et al. | 84/722 |
| 4,726,275 | 2/1987 | Aitken et al. | 84/725 |
| 4,748,887 | 6/1988 | Marshall | 84/1.15 |
| 4,760,767 | 8/1988 | Tsurubuchi | 84/1.16 |
| 4,817,484 | 4/1989 | Iba et al. | 84/1.16 |
| 4,823,667 | 4/1989 | Deutsch et al. | 84/1.16 |

$P_S \doteqdot P \neq P_R$ (CONDITION $|P_S - P| < \alpha P$ $(0 < \alpha < 0.4)$
$|P_R - P| < \alpha P$ $(0 < \alpha < 0.4)$)

ELECTRONIC MUSICAL INSTRUMENT IN WHICH MUSICAL TONES ARE GENERATED ON THE BASIS OF PITCHES EXTRACTED FROM AN INPUT WAVEFORM SIGNAL

This application is a continuation of application Ser. No. 07/112, 780, filed Oct. 22, 1987, now abandoned.

BACKGROUND OF THE INVENTION

The present invention relates to an electronic musical instrument of the type in which a musical tone is generated on the basis of a pitch extracted from an input waveform signal, and more particularly to an electronic string instrument such as an electronic guitar or a guitar synthesizer.

In recent days, there have been developed musical instruments of the type in which a pitch (frequency) is extracted from a waveform signal generated by a natural or conventional musical instrument, and under control of the extracted pitch, a sound source of an electronic circuitry is driven to artificially generate a sound such as a musical tone.

In this type of musical instrument, the pitch extraction still involves some problems to urgently be solved. Typical pitch extraction systems are a zero-cross point detection system and a peak detection system.

The zero-cross point detection system detects the time intervals between zero-cross points in the input waveform, and uses them as periods of the artificial sound. The input waveform frequently contains harmonics which should have been removed by filters such as low-pass filters. The detection system does not operate well for such input waveforms. If it is applied, the detected pitches contain many errors. To prevent the errors, complicated software processing techniques, for example, to check the duty of the input waveform, are required. It is technically difficult to realize this.

The peak-detection system detects maximum and minimum peak points of the input waveform signal, and sets and resets the flip-flop at the peak points, to generate a period signal, e.g., a rectangular wave signal. The peak detection system is disclosed in KOKOKU Nos. 57-37074 (corresponding to U.S. Pat. No. 4,117,757) and 57-58672, and KOKAI Nos. 55-55398, 55-152597 (Utility Model), and 61-26090.

The peak detection system determines the period of the artificial sound waveform by the time interval between the adjacent maximum peaks, for example. This feature causes reduction of the reliability of the detected pitches, and a slow response to frequency change of the input natural sound waveform. Use of the R-S flip-flop makes the instrument circuitry inflexible in generic use and makes it difficult to construct so-called intelligent musical instruments having data processing functions.

Other proposals for the pitch detection system are disclosed in KOKAI Nos. 55-87196 and 55-159495, and KOKOKU No. 61-51793.

KOKAI 55-87196 measures the period of the input natural sound waveform, and then converts the measured value into a frequency number, which in turn is sent to the sound source. No novel technical proposal for the period measurement is found in this KOKAI 55-87196 specification.

KOKAI 55-159495 and KOKOKU 61-51793 disclose a frequency stabilizing technique in which when the adjacent extracted periods are substantially the same, the sounding of the musical instrument starts. A sounding command is not sent to the sound source until at least two periods elapse. In this respect, these patent applications involve the response performance problem. To obtain a quick response, the sounding should start as soon as possible.

Utility Model KOKOKU No. 62-20871 (corresponding to U.S. Pat. No. 4,606,255) discloses another frequency stabilizing technique. In a string musical instrument, a vibration of one string affects the vibration of another string. In the extreme case, the latter vibrates resonating at the vibration frequency of the former. The proposal involves a high cost because mechanical parts are used, and yet it can only imperfectly remove the resonance.

As seen from the above prior art discussion, the known techniques are still immature and require improvement of, for example system stability, response and flexibility in use.

SUMMARY OF THE INVENTION

Accordingly, an object of the present invention is to provide an electronic musical instrument of the type in which musical tones are generated on the basis of pitches extracted from the waveform of an input signal, the musical instrument being improved in the pitch extraction accuracy, and which quickly and reliably sends commands depending on the picking of the strings, the tremolo play and the like to the sound source circuit.

According to one aspect of the present invention, there is provided an electronic musical instrument of the type in which musical tones are generated on the basis of pitches extracted from an input signal waveform comprising:

positive peak detecting means for detecting positive peak points in the input signal waveform;

negative peak detecting means for detecting negative peak points in the input signal waveform;

first peak point finding means for finding the positive peak point succeeding to the negative peak point detected by the negative peak detecting means, from those positive peak points detected by the positive peak detecting means;

second peak point finding means for finding the negative peak point succeeding to the positive peak point detected by the positive peak detecting means, from those negative peak points detected by the negative peak detecting means;

time measuring means for measuring the time duration between the positive peak points as found by the first peak point detecting means or the time duration between the negative peak points as found by the second peak point detecting means; and output means for outputting the pitch data to determine high pitches through an appropriate processing on the basis of the time duration measured by the time measuring means.

According to another aspect of this invention, there is provided an electronic musical instrument of the type i which musical tones are generated by extracting pitches from an input signal waveform comprising:

peak detecting means for detecting positive or negative peak points in an input signal waveform;

zero-cross point detecting means for detecting zero-cross points in the waveform; and pitch extracting means for extracting pitches of the input signal waveform by detecting the time interval (t1) between the zero-cross points each first detected by the zero-cross point detecting means after the positive peak point is detected by the peak point detecting means and/or the time interval (t2) between the zero-cross points first detected by the zero-cross point detecting means after the negative peak point is detected by the peak point detecting means.

With such arrangements, the frequency or pitch of the input signal waveform can be extracted accurately and quickly.

BRIEF DESCRIPTION OF THE DRAWINGS

Other objects and features of the present invention will be understood to those skilled persons in the art when carefully reading the detailed description of the preferred embodiments in connection with the accompanying drawings; in which.

DETAILED DESCRIPTION OF THE PREFERRED EMBODIMENTS

First Embodiment

The first embodiment of the present invention provides an improved of electronic musical instrument of the type in which the period of an input signal waveform is obtained from the maximum peak point MAX, i.e., the positive peak point MIN, and the minimum peak point, i.e., the negative peak point. The positive and negative peak points are referred to as maximum and minimum peak points in the present specification and drawings, respectively.

1. Description of Arrangement

1) Overall circuit arrangement

Figure 1:
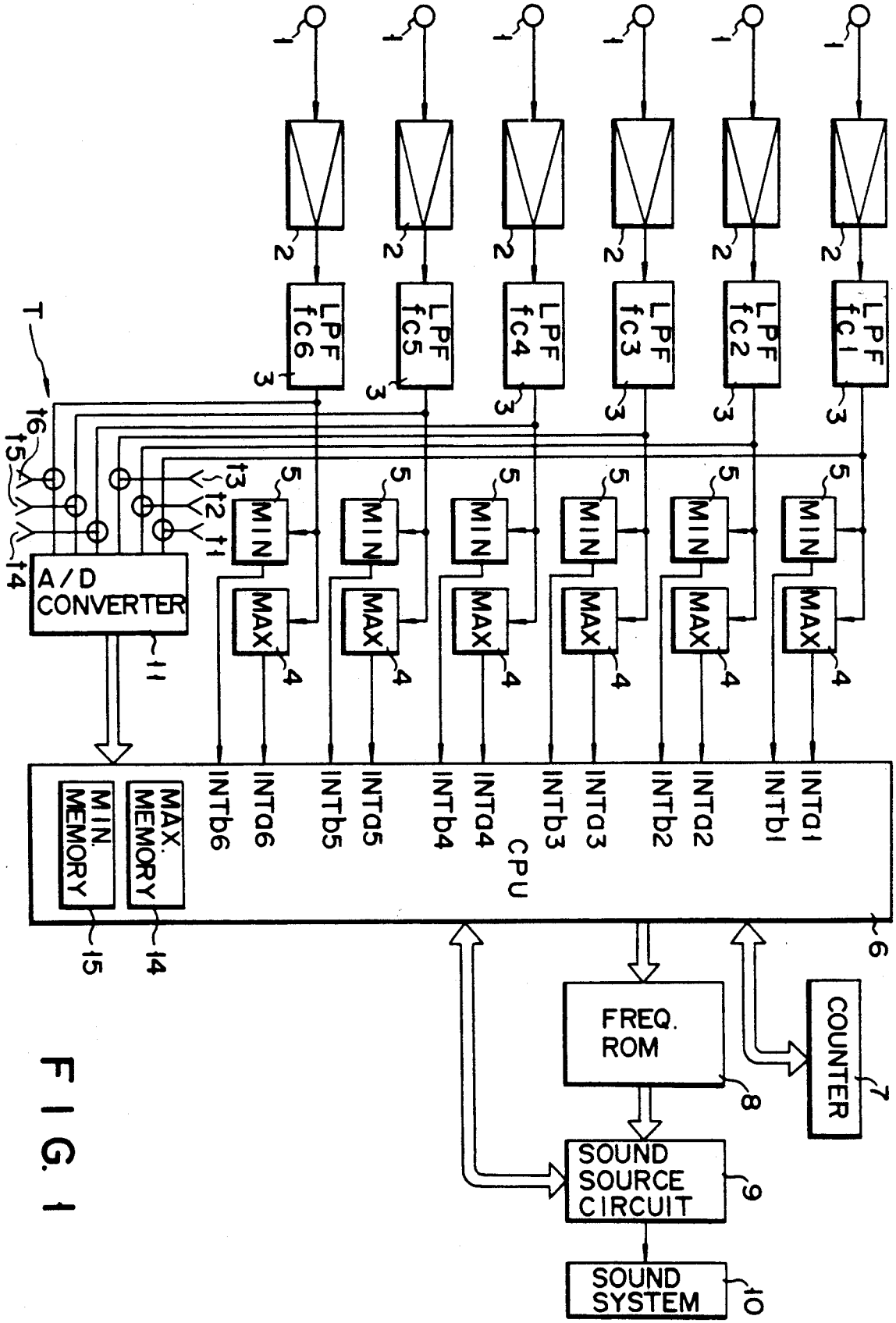
FIG. 1 illustrates in block form an overall arrangement of a first embodiment of the present invention.
Figure 5:
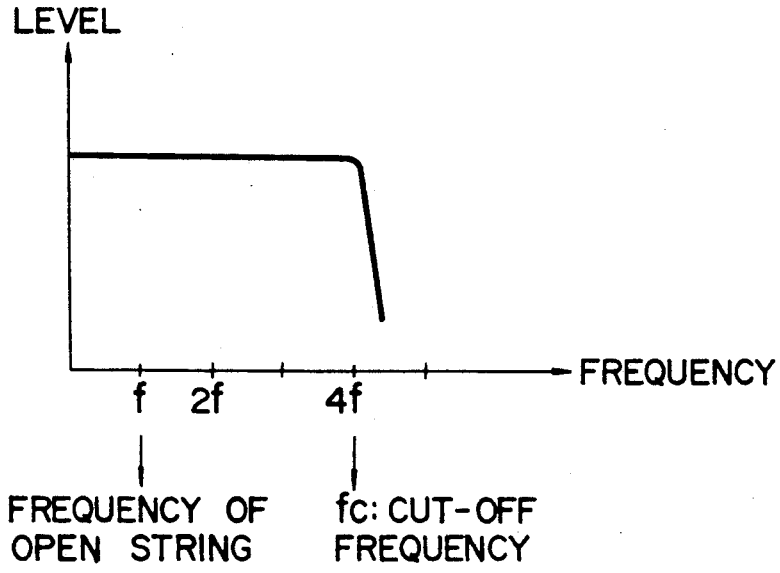
FIG. 5 shows a graphical representation of a cutoff frequency of a low-pass filter used in the FIG. 1 circuit.

An overall circuit arrangement of a musical instrument according to the present invention is illustrated in FIG. 1. In the first embodiment, the present invention is embodied in an electronic guitar. Vibrations of six strings of the electronic guitar are picked up by pickups (not shown). The pickups convert the mechanical vibrations of the strings into electrical signals. These signals as musical tone signals are input to six input terminals 1. These input signals are amplified by amplifiers 2, and applied to low-pass filters 3. These filters respectively remove the high frequency components of these signals to extract the fundamental waveform of these input signals. Each of the input signal of the fundamental waveform is applied to maximum peak detector (MAX 4 and minimum peak detector (MIN) 5. Low-pass filter 3 is designed so that, as shown in FIG. 5, the cut-off frequency is set at 4f, four times the frequency f of the vibration of the open string of each string, viz., when each string is picked without the fret operation. Such selection of the cutoff frequency is due to the fact that the guitar has generally frets of about two octaves. Each of the maximum peak detectors 4 detects the maximum peak points of the input signal. The pulse signals representing the peak detections are used as interrupt command signals INTa1 to INTa6, and transferred to CPU 6. Minimum peak detectors 5 detect each the minimum peak point of the input signal. The pulse signals representative of minimum peak detections are transferred to CPU 6 in the form of interrupt command signals INTb1 to INTb6.

When CPU 6 receives the interrupt command signals INTa1 to INTa6 representing the maximum peak points detections appearing immediately after the interrupt command signals INTb1 to INTb6 representing the minimum peak points detections, CPU 6 calculates a count difference between the present maximum peak points and those previously obtained in a similar way. When CPU 6 receives the interrupt command signals INTb1 to INTb6 appearing immediately after the interrupt command signals INTa1 to INTa6, CPU 6 similarly obtains a count difference between the minimum peak points and those previously obtained in a similar way. Every time both the command signals INT are applied to counter 7, the counts of counter 7 are stored into in-maximum memory 14 and in-minimum memory 15, respectively.

The time count data representative of the difference of the counts as counted by counter 7 is transferred by CPU 6, directly or after it is converted into a pitch code, to frequency ROM 8. The frequency data representing a frequency whose period is defined by this count data, is read out, and transferred to sound source circuit 9. Sound source circuit 9 forms a musical tone signal based on the frequency data. Receiving this signal, sound system 10 sounds the musical tone. The sound source circuit 9 may be set inside or outside the guitar main frame.

Six musical tone signals from low-pass filters 3 are transferred through transfer gates T to A/D converter 11. The A/D converter 11 converts these signals into digital data based on the waveform levels. The digital data is applied to CPU 6. When the absolute values of the waveform level data exceeds a predetermined level, CPU 6 sends the data as obtained from the count of counter 7, to frequency ROM 8, to start the sounding. When the absolute values are below the predetermined value, CPU 6 terminates the sending of the data to frequency ROM 8, to stop the sounding. The waveform level data is also applied to sound source circuit 9 to control the musical tone sounding level. This indicates that the volume is controllable according to the touch force to the string.

Staggered channel timing signals t1 to t6 are applied to the transfer gates T, so that the sounding levels of the six musical tone signals for the six strings of the guitar are performed in a time-sharing manner. Concurrently, six channel musical tone generating systems are formed in sound source circuit 9, in a time-sharing manner.

Figure 2:
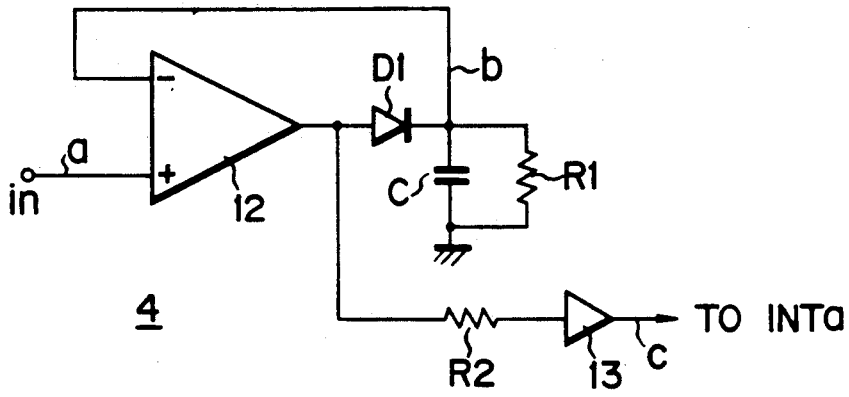
FIG. 2 shows a circuit diagram of a maximum or positive peak detector used in the FIG. 1 circuit.

2) Maximum and Minimum Peak Detectors:

A circuit configuration of maximum peak detector 4 is illustrated in FIG. 2. As shown, the musical tone signal is derived from low-pass filter 3, and input to the + terminal of operational amplifier 12. The output terminal of operational amplifier 12 is coupled with the anode of diode D1. The cathode of diode D1 is grounded through parallel arranged capacitor C and resistor R1. The cathode of diode D1 is also coupled with the − terminal of operational amplifier 12 The output signal of operational amplifier 12 is output through resistor R2 and operational amplifier 13, as interrupt command signals INTa1 to INTa6, which are representative of maximum peak detections.

When a signal with a waveform as shown in FIG. 4*a* is applied to the + terminal of operational amplifier 2, the capacitor C is charged when the signal waveform rises, and discharged when it falls. In turn, the signal with a waveform as shown in FIG. 4*b* is applied to the − terminal of operational amplifier 12. Only when the waveform rises, the operational amplifier 12 produces a difference between the signal levels at the + and − terminals. This signal is output as interrupt command signal INTa shown in FIG. 4*c*. The interrupt processing starts at the trailing edge of the pulsative signal of FIG. 4*c*.

Figure 3:
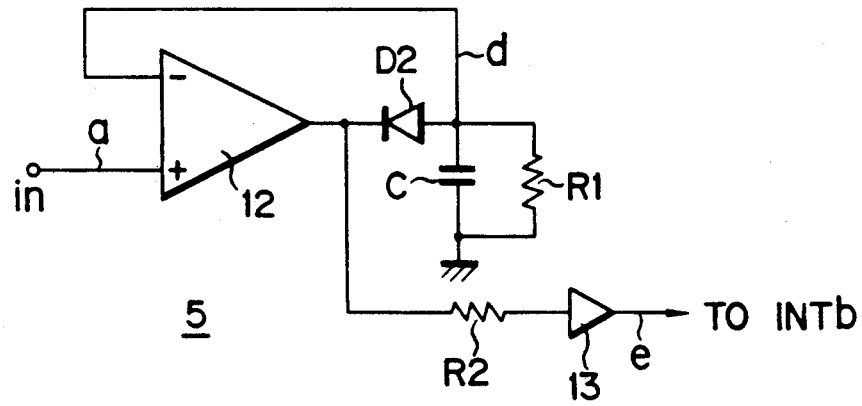
FIG. 3 shows a circuit diagram of a minimum or negative peak detector used in the FIG. 1 circuit.

A specific configuration of minimum peak detector 5 is shown in FIG. 3. The circuit configuration of this circuit 5 is substantially the same as that of the maximum peak detector 4 as mentioned above, except for the connection of diode D2 being opposite. Accordingly, capacitor C repeats the charge/discharge in the opposite directions as shown in FIG. 4*d*. Finally, the interrupt command signal INTb as shown in FIG. 4*e* is obtained.

2. Description of Operation

The operation of the above-mentioned first embodiment of the present invention will be described.

1) In Waveform Rising

Figure 6:
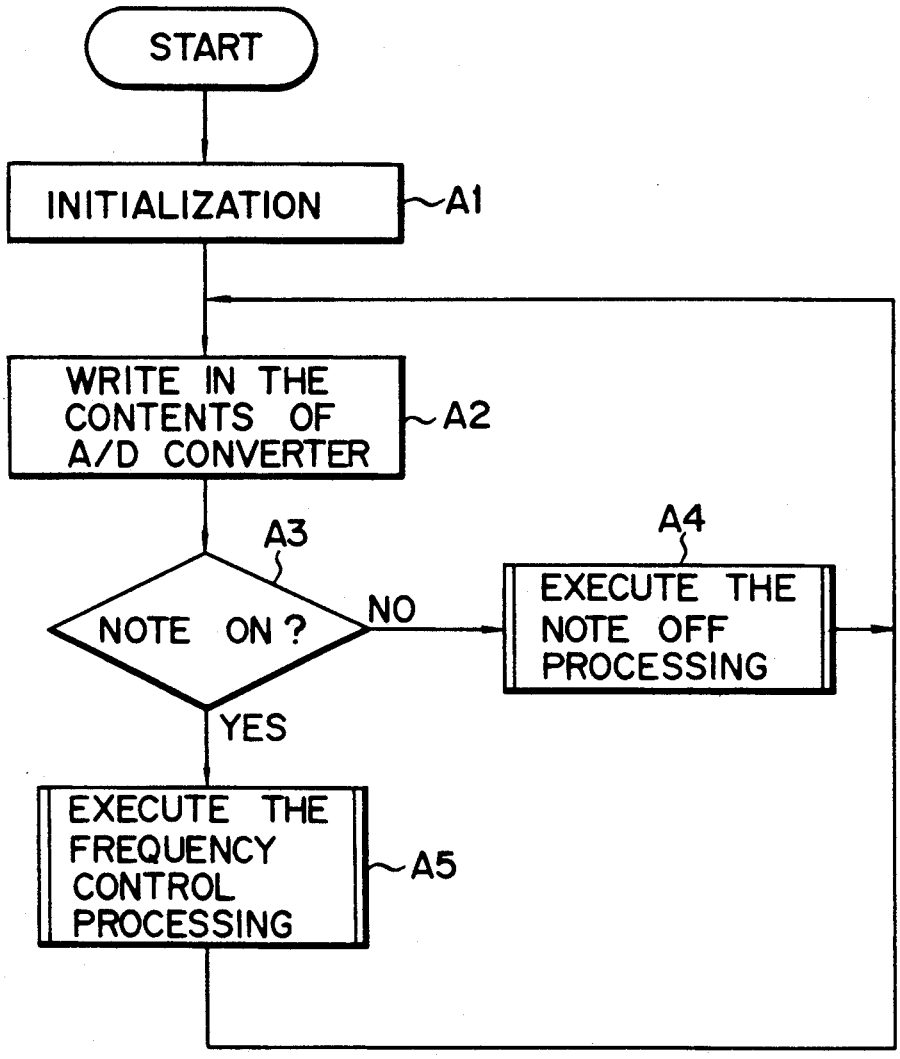
FIG. 6 shows a flowchart of a main routine used by the CPU in the FIG. 1 circuit.
Figure 9:
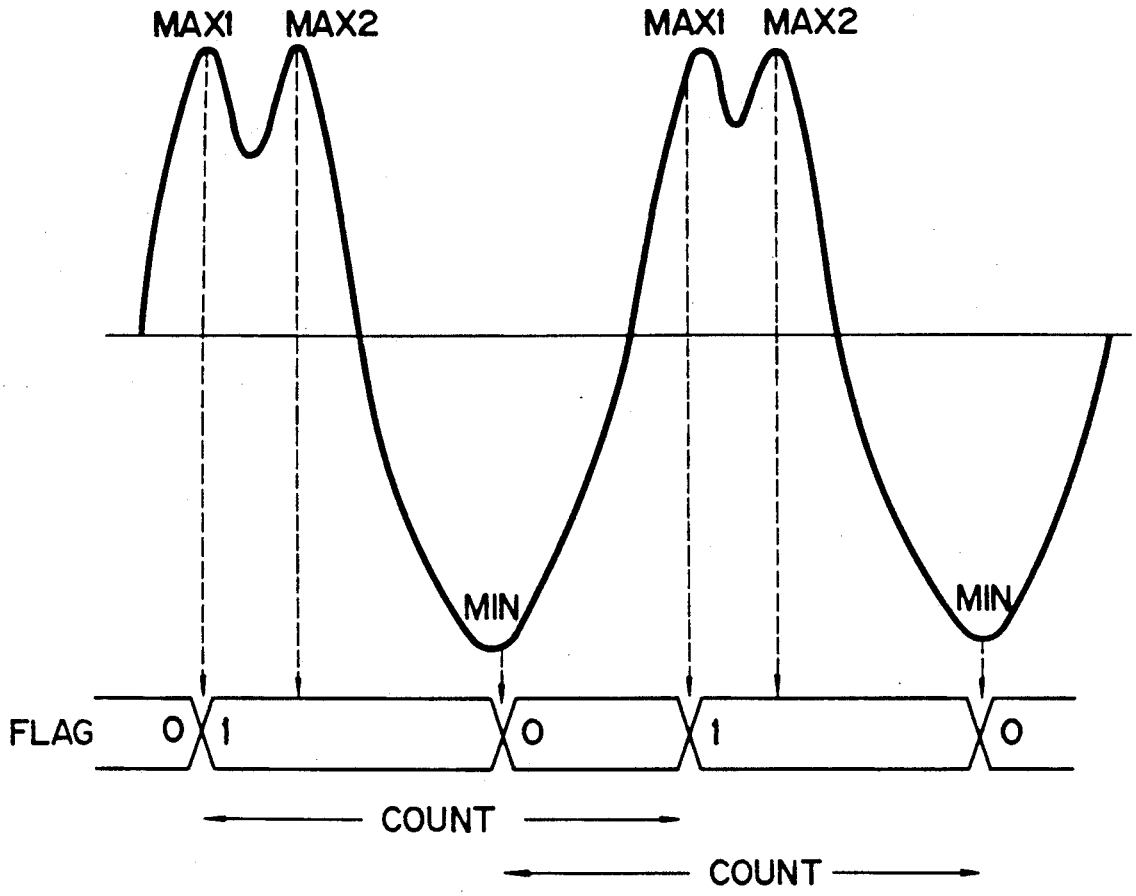
FIG. 9 shows waveforms of an input signal to the FIG. 1 circuit, and of flags.

Upon power on, CPU 6 starts a main routine as illustrated in FIG. 6. In step Al, CPU 6 initializes the related circuits in the electronic musical instrument of the embodiment. In step A2, it fetches the value of A/D converter 11. CPU 6 continues the note off processing unless the signal from the converter 11 exceeds a predetermined level. See step A3 and A4. If a player picks the guitar string, a musical tone signal at a level larger than the predetermined level as shown in FIG. 9 is input to A/D converter 11 (step A3), CPU 6 advances to step A5 where it executes the frequency control processing. The frequency control processing is a musical tone sounding processing in which the data from counter 7 is directly applied to frequency ROM 8 or the pitch code as indicated by the fret number extracted on the basis of that data is applied to frequency ROM 8. So long as the musical tone level is above the predetermined level, CPU 6 continues this sounding processing (steps A2, A3 and A5). The count data of counter 7 is set through the interrupt processing as given later.

2) At maximum peak point MAXl

Let us consider now that the waveform of the musical tone signal rises and reaches the first maximum peak point denoted as MAX1 in FIG. 9. At the maximum peak point, maximum peak detector 4 produces interrupt command signal INTa representing the maximum peak point detection, and applies it to CPU 6. In response to this signal, CPU 6 starts the interrupt processing shown in FIG. 7. CPU 6 fetches the count of counter 7 in step B1. In step B2, the CPU checks whether or not the waveform having the detected maximum peak point is the first wave. Since it is now immediately after the tone waveform rises, that waveform is the first wave. The CPU advances to step B5 to set flag "1", and further to set in in-maximum memory 14 the count of counter 7 as fetched in step B1. "1" of flag indicates that the maximum peak point has been detected. The cleared flag "0" indicates that the minimum peak point has been detected.

2) At maximum peak point MAX2

It is assumed that the waveform level reaches the second maximum peak point denoted as MAX2 in FIG. 9. At the maximum peak point, maximum peak point detector 4 applies interrupt command signal INTa indicating the maximum peak detection to CPU 6. Then, CPU 6 starts the interrupt processing shown in FIG. 7, again. CPU 6 fetches the count of counter 7, and checks if the present waveform is the first wave (step B2). Since the present wave is not the first one, the CPU advances to step B3, and checks if the flag is "0". Since the flag is "1" at the first maximum peak point MAXl, the CPU terminates the present processing, without executing the period computing processing for obtaining the frequency data.

In this way, the frequency data is not mistakenly obtained, whose one period is the difference between the count data at the maximum peak points MAX1 and MAX2, and the time count at the maximum peak point MAX1 is left stored in in-maximum memory 14.

3) At minimum peak point MIN

When the minimum peak point MIN is reached (FIG. 9), minimum peak detector 5 produces interrupt command signal INTb representing the minimum peak point detection, and applies it to CPU 6. Upon receipt of this, CPU 6 starts the interrupt processing shown in FIG. 8. In step C1, CPU 6 fetches the count of counter 7, and checks if the waveform at the minimum peak point is the first wave (step C2). In this instance, the waveform is the first waveform, and then CPU 6 proceeds to step C5. In this step, the flag is cleared to be "0", and sets in in-minimum memory 15 the count of counter 7, which has been fetched in step C1.

The judging processes in step B2 is performed in the following way. When the waveform level data derived from A/D converter 11 exceeds a predetermined level, the first wave flag "1" is set. When interrupt command signal INTb for minimum peak detection is then applied to the CPU, the first wave flag is cleared to "0". In steps B2 and C2, the CPU 6 checks whether or not the wave flag is set.

4) Period Calculation at the Maximum peak Point MAX1

When the input signal waveform increases to reach the maximum peak point MAXI, maximum peak detector 4 applies interrupt signal INTa representing the maximum peak point detection to CPU 6. CPU 6 fetches the count of counter 7 in step B1, and confirms in step B2 that the waveform at the maximum peak point MAX1 is not the first wave, and checks if the flag is "0" in step B3. Since the flag is "0" at the minimum peak point MIN immediately before the maximum point MAX1, CPU 6 advances to step B4, and in this step reads out the time count data from in-maximum memory 14, and subtracts it from the this-time count data as has been read out in step B1, and finally obtains the data of the subtraction result. As a result, in step A5, CPU 6 applies the subtraction result data to frequency ROM 8, and controls the system of the musical instrument so that it produces a musical tone with the frequency whose period ranges from the maximum peak point MAX1 to the next maximum peak point MAX1. Following the above processing, CPU 6 sets the flag to "1", and sets the this-time time count data into in-maximum memory 14 (step B5).

In steps C5 and B3, CPU 6 checks the maximum peak point following the minimum peak point, and measures the time interval between the maximum peak points. In step B4, the period calculation is progressively executed.

Therefore, if the input signal waveform contains two maximum peak points MAX1 and MAX2 successively, only the time interval between two positive peak points MAX1 and MAX1 is used to determine the sounding frequency. The time interval between the successive maximum peak points MAX1 and MAX2 is never used for the same purpose.

5) Period Calculation at Minimum Peak point MIN

When the input signal waveform reaches to the minimum peak point MIN, minimum peak detector 5 applies interrupt signal INTb representing the minimum peak point detection to CPU 6. CPU 6 fetches the count of counter 7 in step C1, and confirms in step C2 that the waveform at the minimum peak point MIN is not the first occurrence and checks if the flag is "1" in step C3 Since the flag is "1" at the maximum peak point MAXl, CPU 6 advances step C4, and in this step reads out the time count data from in-minimum memory 15, and subtracts it from the this-time count data as has been read out in step C1, and finally obtains the data of the subtraction result. According to the result data, CPU 6 reads out from ROM 8 the frequency data to give a musical tone at the frequency whose period ranges between the previous and current minimum peak points MIN and MIN. Following step C4, CPU 6 clears the flag to "0", and sets this-time count data into in-minimum memory 15 (step C5).

In this way, the time count of one period of the minimum peak points MIN is obtained and the frequency data is output. When a plurality of minimum peak points continuously appear without crossing the zero level, as in the previous case of the maximum peak points MAX1 and MAX2, CPU 6 picks up the minimum peak point following the maximum peak point in steps B5 and C3, measures the time interval between such minimum peak points. In this way, an exact period computation is performed in step C4.

As described above, on the basis of the time count data computed in steps B4 and C4 the corresponding frequency data is output from frequency ROM 8 in step A5. As a result, the frequency is changed two times (MAX1—MAX1 and MIN—MIN) during one period. This implies that the system of the musical instrument can quickly respond to the frequency variation of the input signal.

To stabilize the frequency, the previous time count data is stored into the memory in step A5, and the this-time time count data and the previous one are averaged. If the previous time data is greater than the this-time data by, for example, 20% or more, the previous data is output.

SECOND EMBODIMENT

1. General

A second embodiment of the present invention will be described. A new pitch extraction system will be discussed in the second embodiment. In the pitch extraction system, the maximum and/or minimum peaks of the waveform of a musical tone, i.e., an input signal, are first detected. Then, zero-cross points immediately after the maximum or minimum peaks are detected. A time interval between the detected zero-cross points is obtained. Finally, the pitch of the input signal waveform is obtained using the time interval.

More specifically, the time interval (t1) between the zero-cross points first appearing respectively after the maximum peaks are detected, or the time interval (t2) between the zero-cross points first appearing after the minimum peaks are detected, is detected. The detected time interval or intervals are used for the pitch extraction. The pitch extraction is exact with a simple construction.

2. Description of Arrangement

An arrangement of the second embodiment of the present invention will be described referring to FIGS. 10 to 15. In those figures, like symbols are used for designating like or equivalent portions in those of the first embodiment.

1) Overall circuit arrangement

Figure 10:
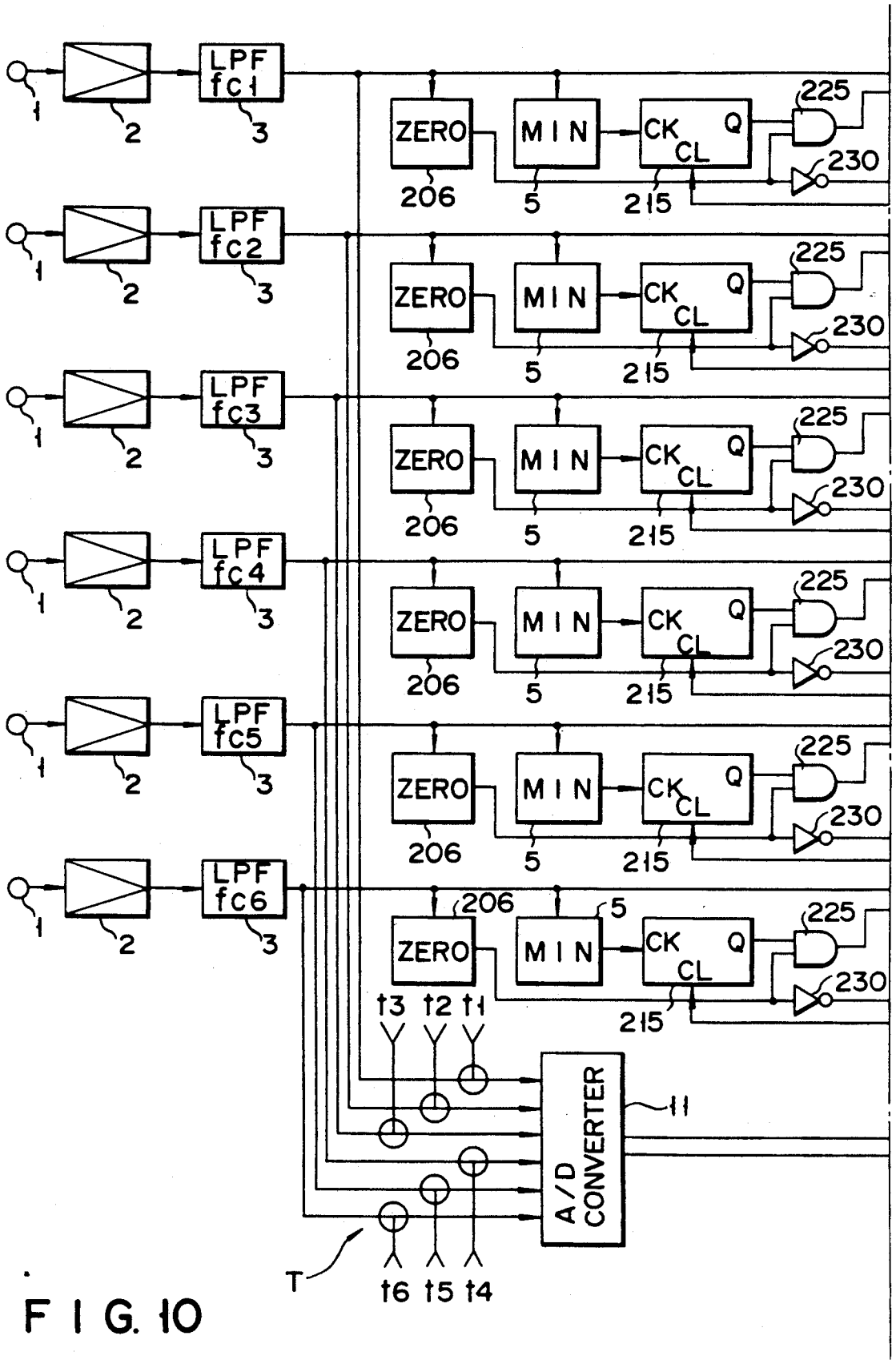
FIGS. 10 and 11 illustrate in block form an overall arrangement of a second embodiment of the present invention.
Figure 12:
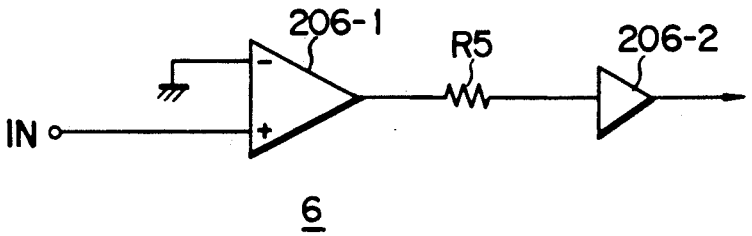
FIG. 12 shows a circuit diagram of a zero-cross point detector used in the FIG. 10 circuit.

Reference is made to FIGS. 10 and 12 illustrating an overall circuit arrangement of the second embodiment. Each maximum peak detectors 4 detects the maximum peak point of an input signal waveform. At the trailing edge of the detected pulse signal, flip-flop (FF) 214 located at the post stage of each detector 4 outputs the Q output at high level. The output signal of FF 214 and the inverted output of inverter 230 coupled with zero-cross point detector 206 are applied to AND gate 224. The output signal from AND gate 224 is applied as interrupt signal INTan (where n is any of 1 to 6 figures) to CPU 200.

Similarly, each minimum peak detector 5 detects the minimum peak point of an input signal waveform. At the leading edge of the detected pulse signal, flip-flop (FF) 215 located at the post stage of each detector 5 outputs the Q output at high level. The output signal of FF 215 and the output of zero-cross point detector 206 are applied to AND gate 225. The output signal from AND gate 225 is applied as interrupt signal INTbn (where n is any of 1 to 6 figures) to CPU 200.

Thus, when the maximum peak point is detected and FF 214 is logical high at the Q output, if the waveform crosses the zero level from the positive domain to the negative domain, interrupt signal INTan is applied to CPU 200. When the minimum peak point is detected and FF 215 is logical high at the Q output, if the waveform crosses the zero level from the negative domain to the positive domain, interrupt signal INTbn is applied to CPU 200.

Immediately after receiving the interrupt signal INTan or INTbn, CPU 200 applies clear signal CLan (where n is any of 1 to 6) or CLbn to FF214 or 215. In turn, the corresponding FF is reset. Accordingly, until the next maximum or minimum peak point is detected, even if the waveform crosses the zero level any number of times, the corresponding FF remains reset, and therefore CPU 200 is never interrupted.

When CPU 200 receives interrupt signal INTan for the zero-cross point encountered immediately after the maximum peak point is detected, CPU 200 computes a difference between the present count of counter 7 and that of counter 7 as the waveform previously crosses the zero level immediately after the maximum peak point. Similarly, when interrupt signal INTbn is generated, CPU 200 computes a difference between the present count of counter 7 and that of counter 7 as the waveform previously crosses the zero level immediately after the minimum peak point. Every time interrupt signals INTan and INTbn are generated, CPU 200 stores the counts of counter 7 into in-maximum memory 201 and in-minimum memory 202, respectively. The time count data as the count difference is transferred from CPU 200 to frequency ROM 8, directly or after it is converted into a key code. The frequency data with one period of the counter data is read out, and sent to sound source circuit 9, where a musical tone signal is generated. Sound system 10 receives this and starts the sounding of the musical tone.

2) Zero-cross point detector 206

The arrangement of zero-cross point detector 206 will be described. In FIG. 12 illustrating a specific circuit arrangement of zero-cross point detector 206, the musical tone signal derived from low-pass filter 3 is applied to the + terminal of operational amplifier 206-1. The − terminal of the operational amplifier is grounded. The output signal of operational amplifier 206-1 is output by way of resistor R5 and another operational amplifier 206-2. For a positive input signal, operational amplifier 206-2 outputs a logical high signal. For a negative input signal, amplifier 206-2 outputs a logical low signal. This indicates that every time the waveform of the signal signal, i.e., musical tone, crosses the zero level, the logical level at the output of the operational amplifier 206-2 is inverted.

3. Description of Operation

The operation of the second embodiment of the present invention will be described.

The main routine used in this embodiment is the same as that of FIG. 6, and hence it is not described here. The description of operation will be given in connection with the interrupt routines.

Figure 13:
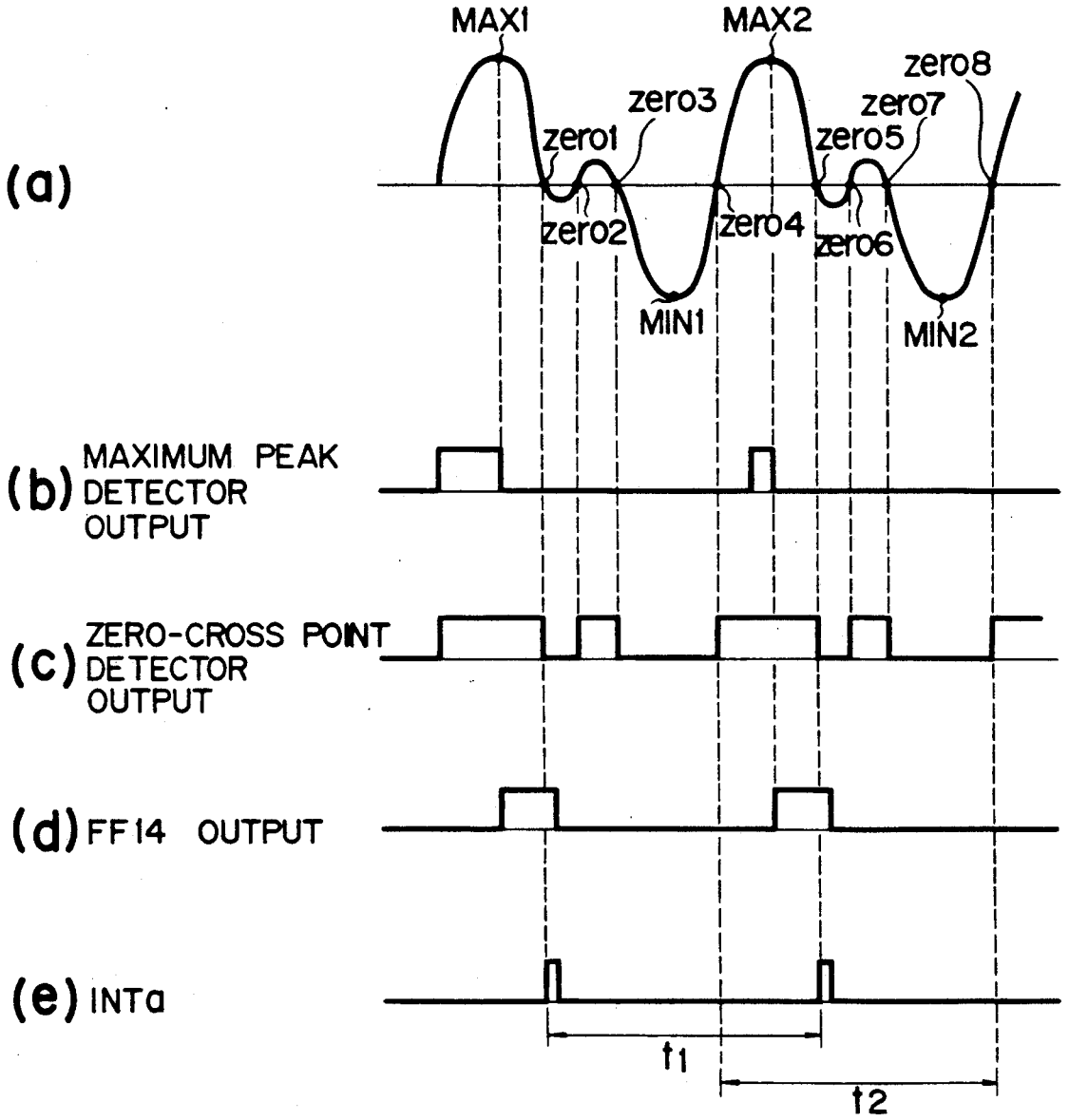
FIG. 13 shows a timing chart useful in explaining the operation of the FIG. 10 circuit when it receives an waveform of the input signal.
Figure 14:
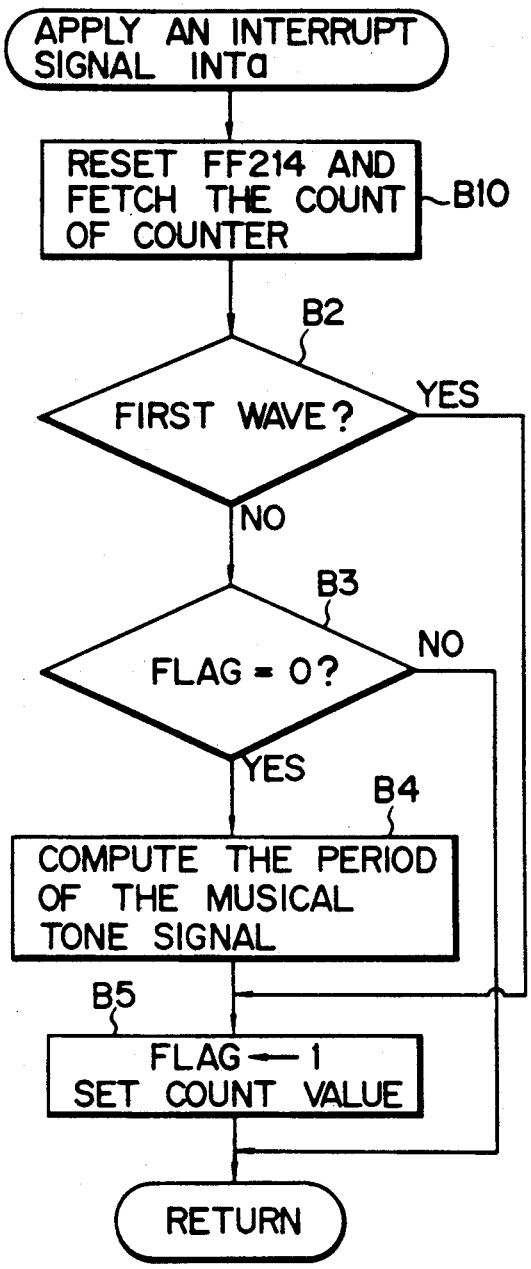
FIG. 14 shows a flowchart of an interrupt routine executed by the CPU of the FIGS. 10 and 11 circuit when the zero-cross point is detected immediately after a maximum peak point is detected.

A player picks one of strings of the guitar, and a musical tone with a waveform as shown in FIG. 13(*a*) is generated. The musical tone waveform varies and ascends to reach a maximum peak point MAX1. At this time, maximum peak detector 4 generate a signal as shown in FIG. 13(*b*). This signals renders the output of FF 214 high in logical level (FIG. 13(*e*)). At the zero-cross point Zero 1 (FIG. 13(*c*)), the zero-cross point detection output of zero-cross point detector 206 is inverted (FIG. 13(*c*)). At this time, AND gate 224 applies interrupt signal INTa to CPU 200. Upon receipt of this signal, CPU 200 starts the interrupt processing.

Figure 7:
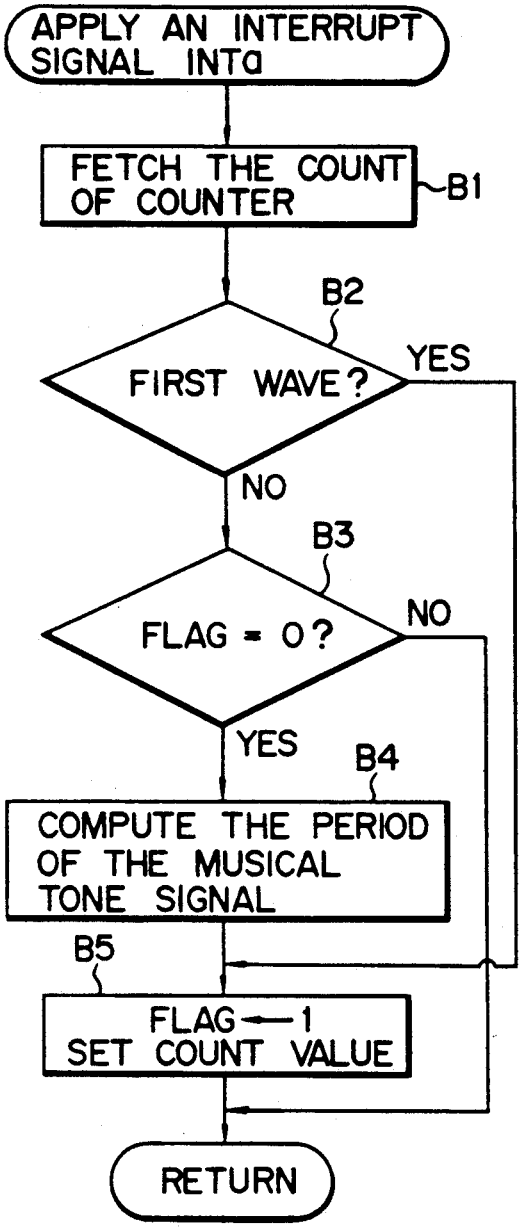
FIG. 7 shows a flowchart of an interrupt routine executed by the CPU when the maximum or positive peak point MAX is detected.

The interrupt routine is the same as that of FIG. 7 illustrated in connection with the first embodiment, except for step B10. Hence, the interrupt routine will be described in brief.

CPU 200 resets FF 214 in step B10, and reads in the count of counter 7, and checks if the present wave of the input signal waveform is the first wave in step B2. Since the musical tone waveform has been just risen and therefore the present waveform is the first wave, CPU 200 advances to step B5 and sets flag to "1", and sets the count of counter 7 as read out in step B1 into in-maximum memory 201. When the input signal with the waveform as shown in FIG. 13(*a*) is input to the musical instrument, zero-cross point detector 6 produces the inverted output signal as shown in FIG. 13(*c*) every time the zero-cross points Zero 2 and Zero 3 are successively detected.

At this time, however, FF 214 has been reset in step B10, and no interrupt signal INTb is produced.

When the minimum peak point MIN1 shown in FIG. 13(*a*) is reached, minimum peak detector 5 produces a peak detection signal, and sets FF 215 by the signal. At the next zero-cross point (Zero 4), the output signal of zero-cross point detector 206 is inverted, and AND gate 225 applies interrupt signal INTb to CPU 200. CPU 200 starts the interrupt processing shown in FIG. 15.

Figure 8:
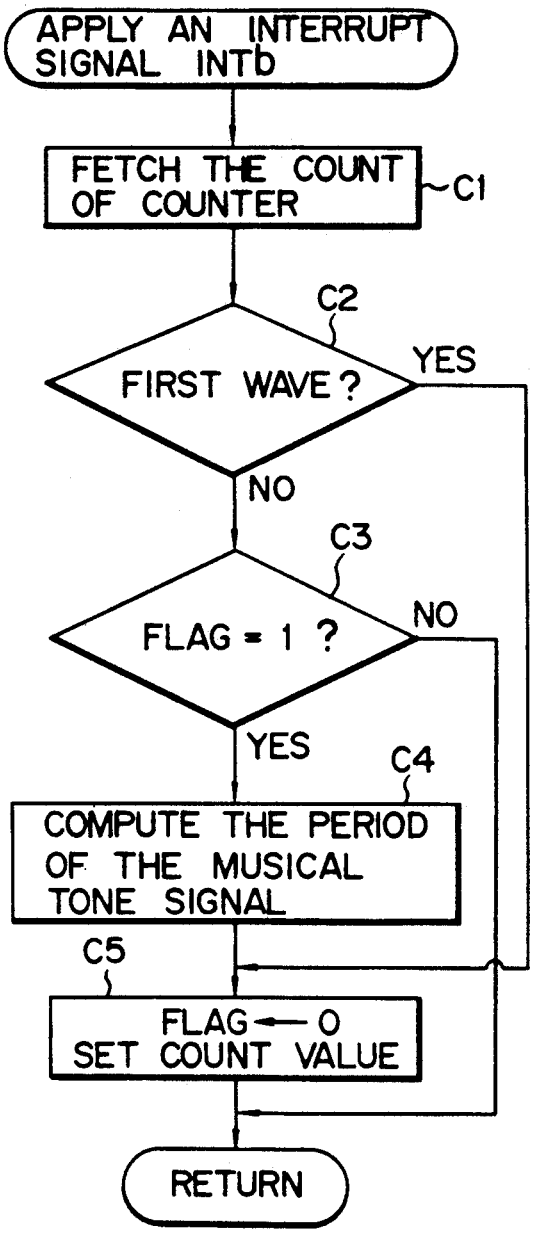
FIG. 8 shows a flowchart of an interrupt routine executed by the CPU when the minimum or negative peak point MIN is detected.
Figure 15:
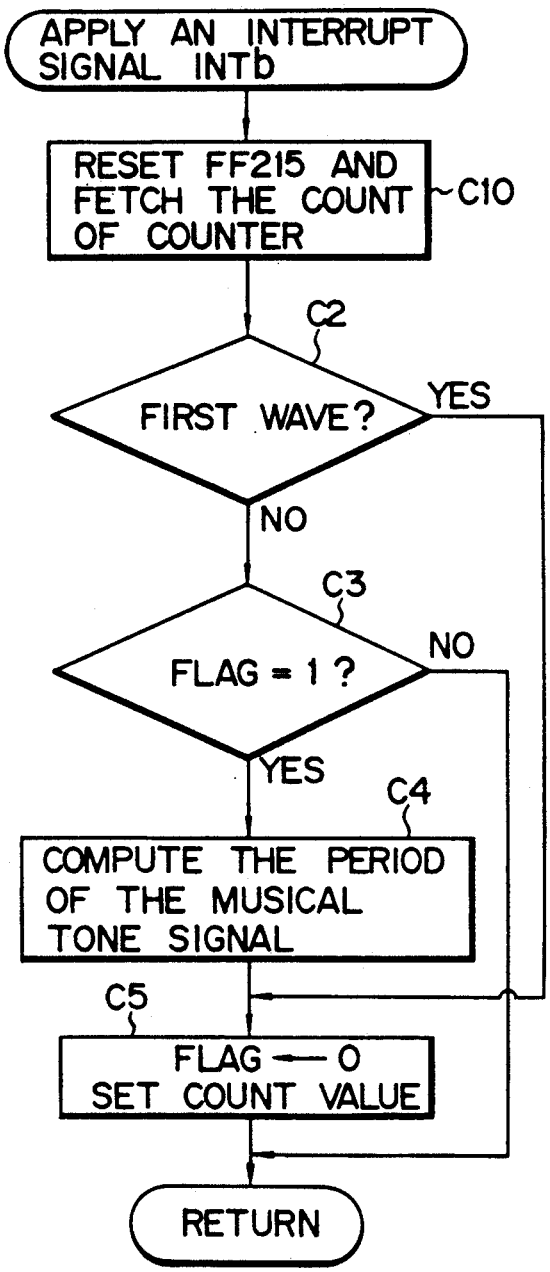
FIG. 15 shows a flowchart of an interrupt routine executed by CPU of the FIGS. 10 and 11 circuit immediately when the zero-cross point is detected after a minimum peak point is detected.

This interrupt routine of FIG. 15 is also substantially the same as that of FIG. 8, except step C10. This routine will be described in brief. CPU 200 resets FF 215 in step C10, fetches the count of counter 7, and checks if the present wave of the waveform is the first wave in step C2. The wave containing the zero-cross point succeeding to the minimum peak point is the first wave. Then, CPU 200 advances to step C5 and clears the flag to "0", and stores the count of counter 7 as read out in step C10 into in-minimum memory 202.

When the zero-cross point (Zero 5) succeeding to the maximum peak point MAX2 shown in FIG. 13(*a*) is reached, interrupt signal INTa for the detection of the zero-cross point following the maximum peak point is generated, and CPU 200 fetches the count of counter 7 in step B10. In step B2, if the CPU confirms that the present wave is not the first wave. Then, in step B3, the CPU checks if the flag is "0". Since the flag has been cleared to "0" at the zero-cross point (Zero 4) immediately after the previous minimum peak point MIN1, CPU 200 advances to step B4, and reads out the time count data, which has been saved into in-maximum memory 201 at the zero-cross point (Zero 1) immediately after the maximum peak point MAX1 one period before, and subtracts the time count data read out this time from that read out in step B1, to have the subtraction result data. As a result, in step A5 of the main routine, the resultant data is applied to frequency ROM 8, and the musical instrument is controlled so as to sound the musical tone at the frequency whose period ranges from the zero-cross point (Zero 1) to the zero-cross point (Zero 5). Succeeding to this processing, CPU 200 sets the flag "1", and sets the this-time time count data into in-maximum memory 201 (step B5).

In this way, the zero-cross point immediately after the maximum peak point is checked in steps C5 and B3 and the time interval (t1) only between these zero-cross points is measured, and the period calculation is performed in step B4.

Similarly, the zero-cross points (Zero 6 and Zero 7) are ignored. In response to input signal as the interrupt signal INTb, which is generated upon detection of the zero-cross point (Zero 8) immediately after the minimum peak point detection, CPU 200 the routine of FIG. 15. The time interval (t2) from the previous zero-cross point (Zero 4) to the present zero-cross point (Zero 8) is used as the pitch data.

Thus, the time interval (t1), i.e., Zero 1 → Zero 5, between the zero-cross points immediately after the maximum detection points, and the time interval (t2), i.e., Zero 4 → Zero 8, between the zero-cross points immediate after the minimum point detections, are obtained. In other words, the frequency change is performed two times during one period in the same manner as in the first embodiment. Therefore, the musical instrument can quickly respond to the frequency change of the input signal.

Figure 16:
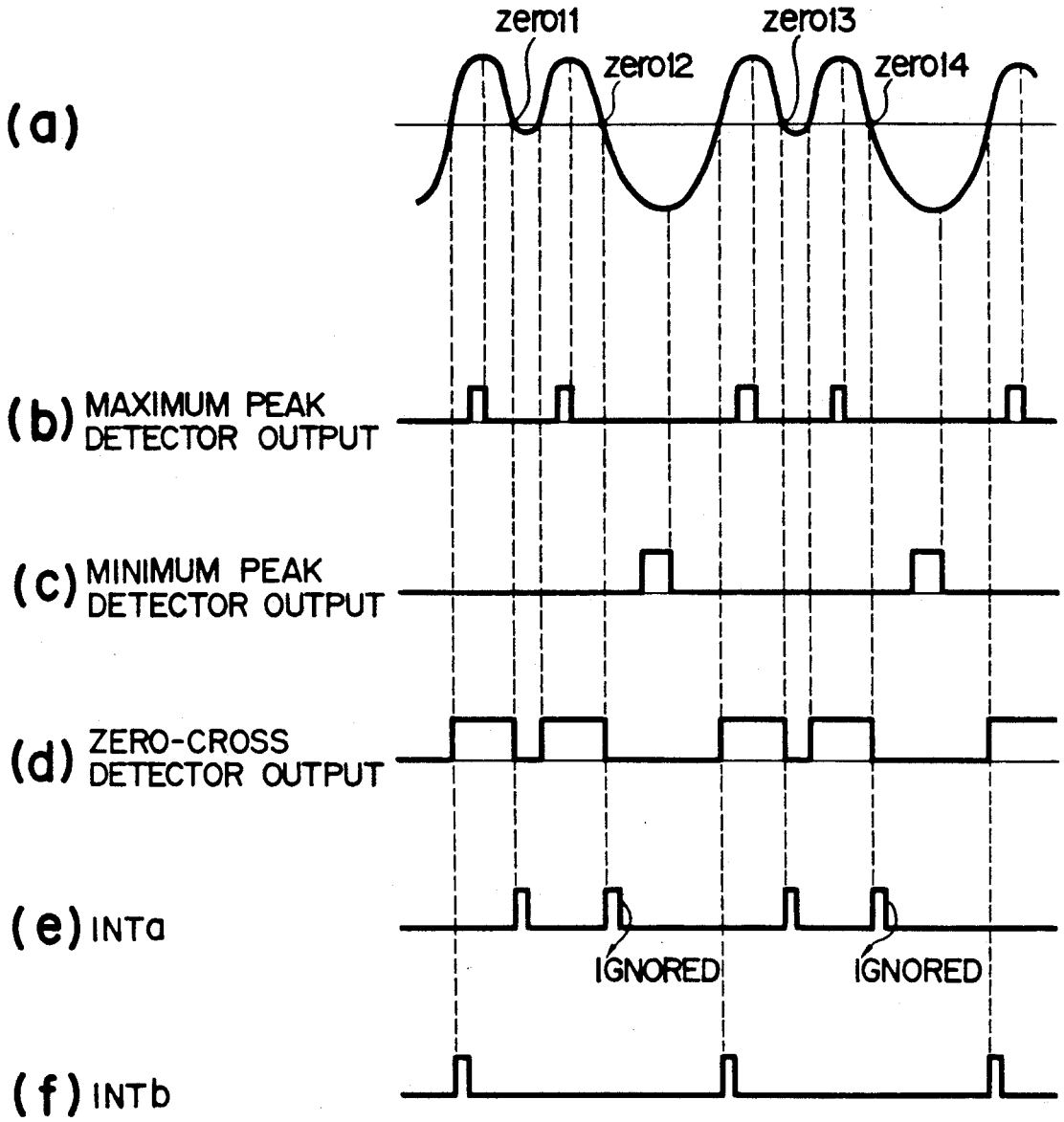
FIG. 16 shows a timing chart useful in explaining the operation of the FIGS. 10 and 11 circuit when it receives another waveform of the input signal.

As described above, in the musical instrument of this embodiment, if the waveform as shown in FIG. 16(*a*) is input, the zero-cross points Zero 12 and Zero 14 are ignored with the function of the flag in the FIG. 15 flow.

More specifically, if the signals for zero-cross points Zero 12 and Zero 14 come in as the interrupt signal INTa, the flag has been set to "1" when these signals arrive (step B5), and therefore, the answer to step B3 is NO, and hence no period calculation is performed. In this way, the zero-cross points are successively detected after the maximum peaks are detected, these are ignored by the flag, removing the effects by the harmonics.

To stabilize the frequency, in step A5, the previous time count data is stored into the memory, and the this-time time count data and the previous one are averaged. If the previous time data is greater than that of this-time by, for example, 20% or more, the previous data is output. The period calculations based on the zero-cross point detection immediately after the maximum and minimum peak points detections, may be selectively performed in a manner that the period calculation based on the zero-cross point immediately after the maximum peak point detection is executed for the waveform which rises at the start point and that based on the zero-cross point immediately after the minimum peak point detection is executed for the waveform which falls at the start point. Such arrangement provides a quick response at the start of the sounding.

As described above, in the embodiment as mentioned above, CPU 6 can execute an appropriate processing as the step A5 processing shown in FIG. 6. The selection of the appropriate processing can be made by modifying the program for CPU 6, and not requiring any modification of the hardware, i.e., the external circuit of CPU 6. Therefore, the musical instrument of this embodiment is excellent in flexibility of use, and can easily be designed so as to have so-called intelligent functions.

In the second embodiment, the time intervals (t1) and (t2) respectively between the zero-cross points immediately after the maximum and minimum peak points are both obtained, but the musical instrument is operable with, satisfactory performances, if one of them is used. If this is done, the combination of maximum peak detector 4, FF 214, AND gate 224 and inverter 230 or the combination of maximum peak detector 5, FF 215, and AND gate 225 may be omitted, thus simplifying the circuit amplification of the musical instrument.

While in the above-mentioned embodiment, the present invention is applied for an electronic guitar, it can be applied for any other systems of the type in which pitches are extracted from a sound signal or an electrical vibration as input from a microphone, for example, and an acoustic signal, which is different from the original signal is generated at the pitches or note frequencies corresponding to those of the original signal. Specific examples of such are electronic pianos with key boards, electronic wind instruments, electronic string instruments such as electronic violins and koto (Japanese string instrument).

As seen from the foregoing description, there is provided musical instrument of the type in which the frequency of a natural sound signal is detected, and the detected frequency signals are subjected to an appropriate digital data processing for artificial sound generation. In the musical instrument, the time interval (t1) between the zero-cross points immediately after the successive maximum peak points and the time interval (t2) immediately after the successive zero-cross points are detected. The time interval or intervals are appropriately processed for pitch extraction. With this feature, the ,frequency data can be obtained more exactly and quickly. Further, a flexible design of this instrument is made possible.

In the second embodiment, the time intervals (t1) and (t2) respectively between the zero-cross points immediately after the maximum and minimum peak points, are both obtained, but the musical instrument is operable with satisfactory performances, even if only one of them is used. If this is done, the combination of maximum peak detector 4, FF 214, AND gate 224 and inverter 230 or the combination of maximum peak detector 5, FF 215, and AND gate 225 may be omitted, simplifying the circuit amplification of the musical instrument.

THIRD EMBODIMENT

1. General

A third embodiment of an electronic guitar according to the present invention will be described referring to FIGS. 17 to 20. The second embodiment provides improved response time, which is required from the inputting of an input signal waveform until the electronic guitar starts the sounding of the input musical tone, thereby eliminating the unnatural feeling of sounded musical tones.

To attain the improvements, the electronic guitar of the third embodiment detects the inputting of an input signal, and gives a command to first generate a musical tone at a predetermined pitch, extracts the pitch of the input signal waveform by a pitch extracting means, and gives a command to change the pitch of the musical tone to the pitch of the input signal waveform.

More specifically, in the case of the electronic guitar, it is preferable to use for the predetermined pitch, the pitch of a musical tone generated from the open string, i.e., when the string is picked without touching the fret. For other types of musical instruments, the pitch of a low pitched sound is preferably used for the reference pitch, or the predetermined pitch.

Before pitch extraction, a musical tone is generated at a predetermined pitch, and after the pitch extraction, the pitch of the musical tone is changed to the extracted pitch. In this case, if the frequency of the first generated musical tone can be discriminated by a human being he hears it with very unnatural feelings. In this respect, the first generated musical tone must be selected to be within one wave length (one period). A low pitched sound should be first output.

2. Description of Arrangement and Operation

Figure 11:
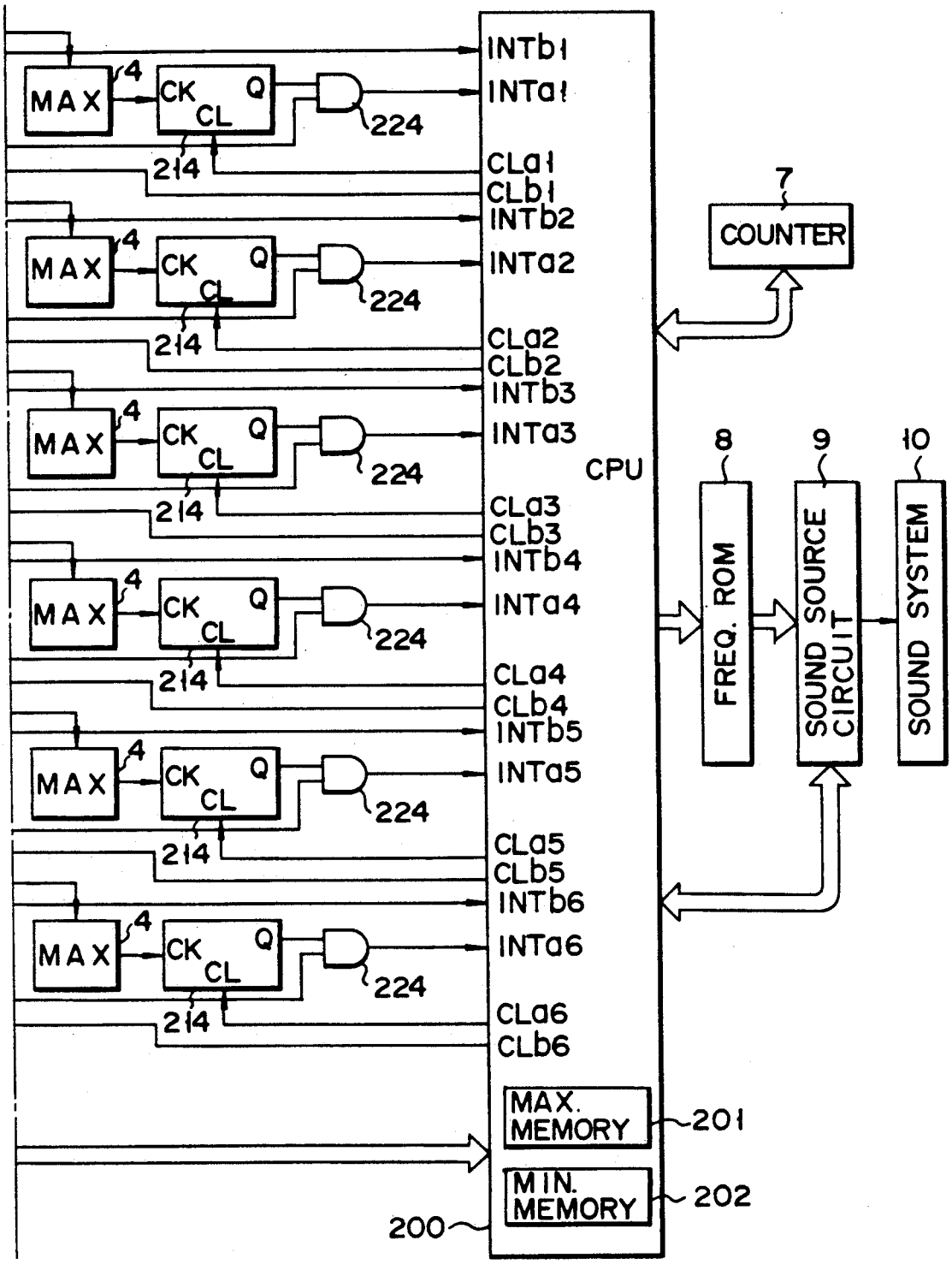

The arrangement of the third embodiment is substantially the same as that of the second embodiment illustrated in FIGS. 10 and 11. The only difference of the third embodiment from the second embodiment resides in the processing executed by CPU 200. Hence, the description will be given emphasizing the operation of the guitar system.

Figure 17:
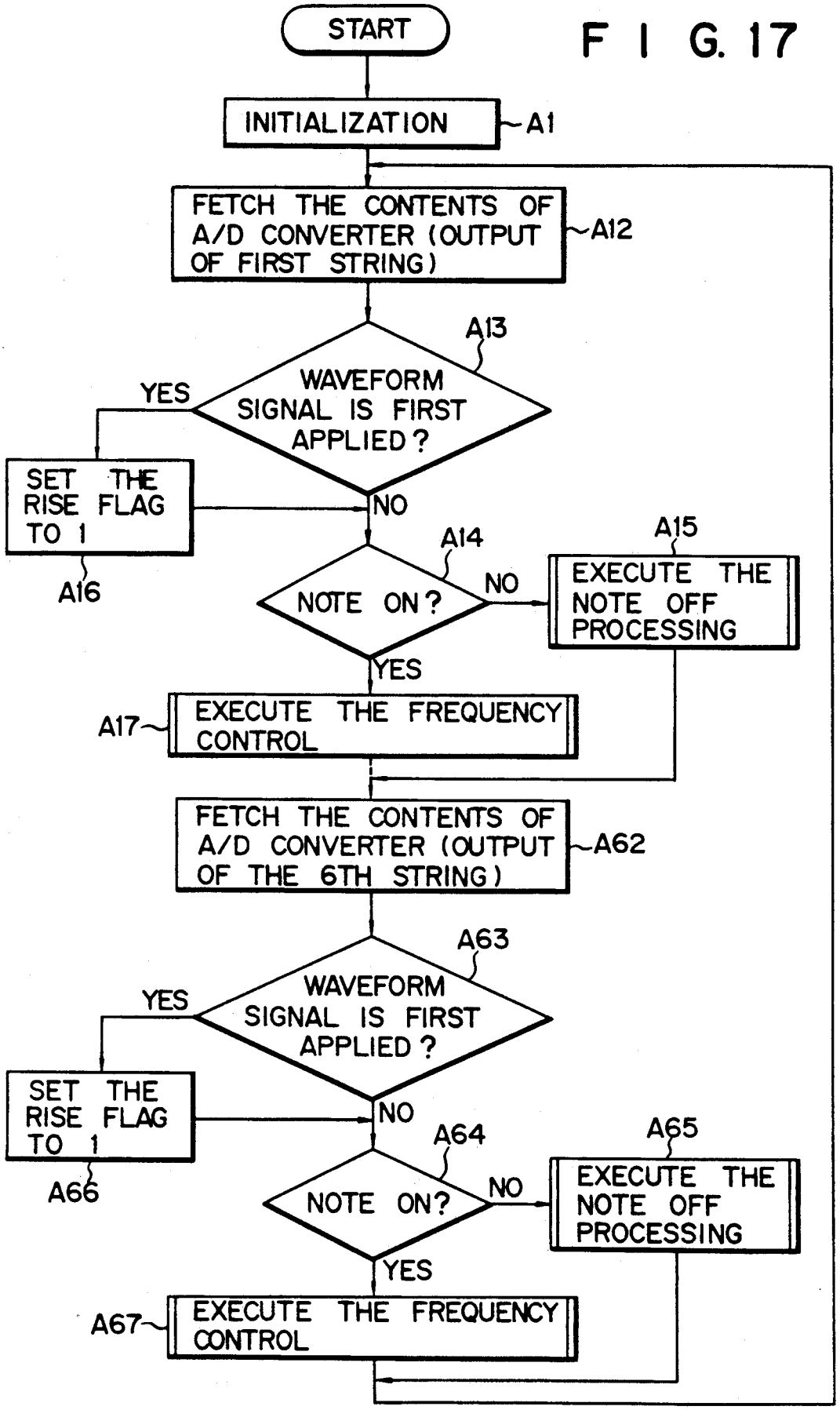
FIG. 17 shows a flowchart of a main routine executed by the CPU which is used in a circuit of musical instrument according to a third embodiment according to this invention.

A main routine executed by CPU 200 is shown in FIG. 17. The main routine is constructed on the basis of the idea substantially equivalent to that of the first embodiment (FIG. 6). Only its different features will be described with different symbols being used therefor.

In step A1, the system of the electronic guitar is initialized. In step A12, CPU 200 fetches the contents of A/D converter 11 as the first string output signal. In step A13, the CPU checks if the level of the input signal waveform exceeds a predetermined level. If it is below the predetermined level, the CPU executes the note-off processing in steps A14 and A15.

Figure 18:
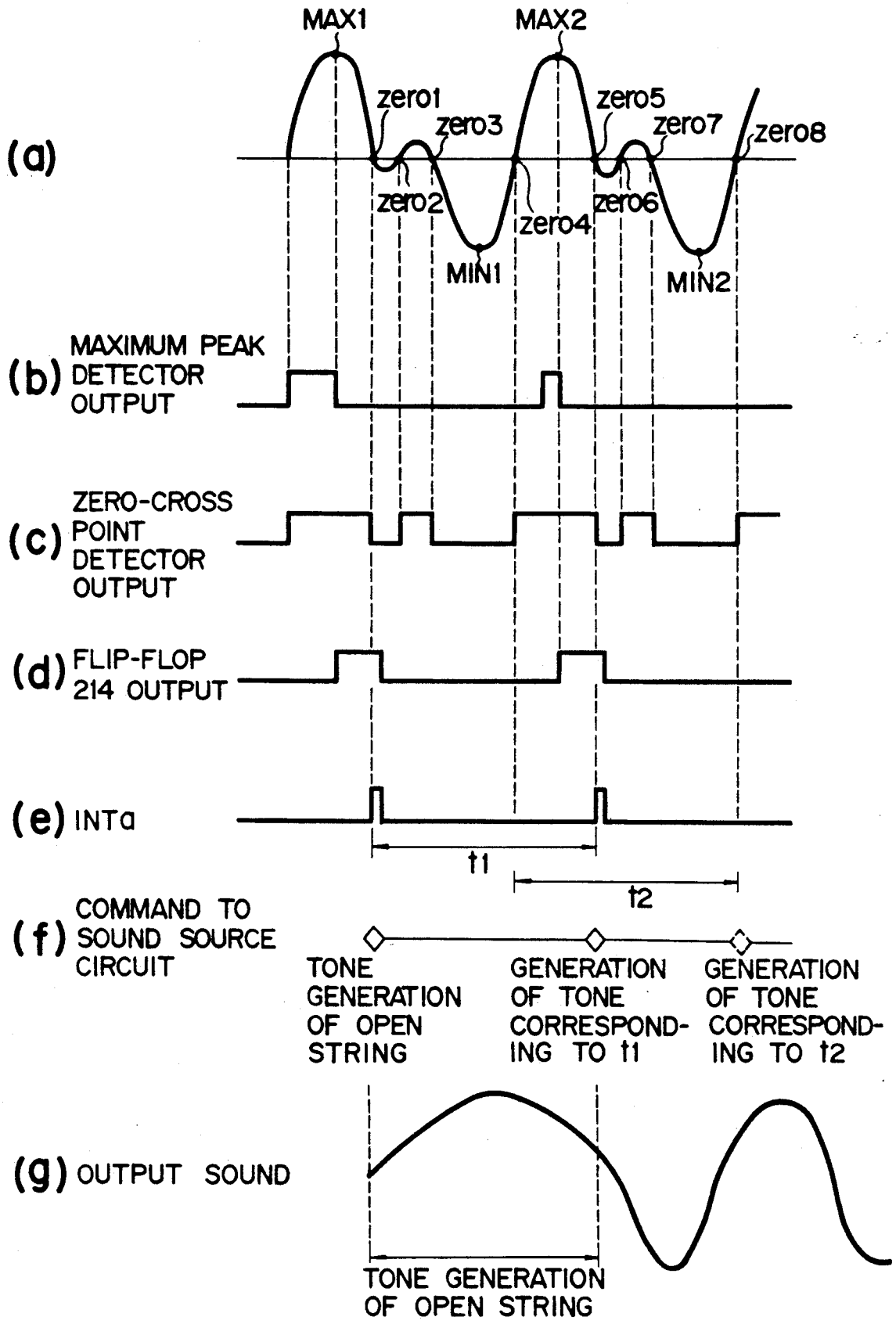
FIG. 18 shows a timing chart useful in explaining the operation of the third embodiment circuit when it receives an waveform of the input signal.

The musical tones from the second to sixth strings are processed in similar ways (steps A22 to A25, A32 to A35, A42 to A45, A52 to A55, and A62 to A65). The illustration contains the processings of the musical tones from the first and sixth strings only. The first string is picked to generate a musical tone with a waveform as shown in FIG 18(*a*). The musical tone is picked up and applied to A/D converter 11. Upon receipt of the output of the converter, CPU 200 jumps from step A13 to step A16. In step A16, the rise flag of the first string is set to "1". In this case, the sounding is not done, and then the CPU executes steps A14 and A15, and enters the processings of the next string.

When other strings are picked, it is evident that the following processings are executed: A23→A26→A24→A25, A33 A26→A34 →A35, A43→A46→A34→A45, A53→56→A54→A55, A63→A66→A64→A65.

As will be seen later, the above processing is repeated until either of interrupt signals INTan and INTbn (where n is any of 1 to 6) is first applied. When the waveform rises as shown in FIG. 18(*a*), the interrupt signal first applied to CPU 200, is the interrupt command INTan. When the waveform falls, i.e., from zero level to the negative side, interrupt signal INTbn is applied to CPU 200.

As the first interrupt signal INTan or INTbn is applied to CPU 200, the CPU issues a command to generate a musical tone based on the frequency of the open string. Subsequently, the CPU executes steps A13 (A23, A33, A43, A53, A63), A14 (A24, A34, A44, A54, A64) and A17 (A27, A37, A47, A57, A67) in this order. Then, the pitch is extracted, and step A17 controls the frequency on the basis of the extracted pitch.

To generate a musical tone at the pitch of the open string or the extracted true pitch, CPU 200 supplies a control signal to frequency ROM 8. So long as the input signal is above a predetermined level, a sequence of procedural steps A12 → A13 → A14 → A17 (A22 → A23 → A24 → A27, A32 → A33 → A34 → A37, A42 → A43→ A44 → A47, A52 → A53 → A54 → A57, A62 → A63 → A64 → A67) is repeated. If it is below the predetermined level, CPU 200 executes the step A15 (A25, A35, A45, A55, A65) processing, and stops the sounding.

The operation of the electronic guitar, when a string is picked, will be described in detail. When the musical tone waveform rises upon the string picking, the waveform level reaches the first maximum peak point MAX1 in FIG. 18(*a*), maximum peak detector 4 produces a signal as shown in FIG. 18(*b*). FF 214 output goes high (FIG. 18(*d*)). The output signal from zero-cross point detector 206 is inverted at the zero-cross point Zero 1 (FIG. 18(*c*)). AND gate 24 applies interrupt signal INTan to CPU 200. CPU 200 starts the execution of the interrupt routine FIG. 19.

This routine is similar to those of FIGS. 7 and 13. CPU 200 resets FF 214 in step B301, reads in the count of counter 7, and in step B302 checks if the rise flag is 1. Since the waveform has just risen, and the present wave of the waveform is the first wave, the CPU advances to step B303 (see steps A16 (A26, A36, A46, A56, A66), and in this step executes the processing of starting the sounding at the note by the open string. In step B304, the rise flag is cleared, and the CPU proceeds to step B305 where it sets the control flag to "1". Then, the CPU saves into in-maximum memory 201 the counter 7 count as read out in step 301. The control flag "1" indicates that the zero-cross point after the maximum peak point has been detected. The cleared flag indicates the detection of the minimum peak point. The function of this control flag will be discussed later.

When the guitar system receives the waveform as shown in FIG. 18(*a*), every time the zero-cross points Zero 2 and Zero 3 are successively detected, zero-cross point detector 6 produces inverted signals as shown in FIG. 18(*c*).

At this time, however, the output of FF 214 has been reset (step B301) and the CPU produces interrupt signal INTa. Of course, FF 215 also remains set, and no interrupt signal INTb is produced.

When the minimum peak point MIN1 shown in FIG. 18(*a*) is then reached, minimum peak detector 5 produces a peak detect signal, to set FF 215. At the zero-cross point Zero 4, the output of zero-cross point detector 5 is inverted, so that AND gate 22 applies interrupt signal INTb to CPU 200. Upon receipt of this, CPU 200 starts the interrupt processing shown in FIG. 20. This routine is also similar to those of FIGS. 8 and 14. In step C301, CPU 200 resets FF 215, and reads in the counter 7 count, and checks if the present wave first rises or falls. In other words, the CPU checks if the rise flag is "1" in step C302.

At this time, the waveform has risen, and the musical tone signal has been input to the guitar system. Therefore, in step B304 (FIG. 19), the rise flag has been cleared. The result of the check in step 302 is NO.

The CPU advances to step C306. In step C306, the CPU checks if the control flag within it is "1". In step B305 in FIG. 19, the flag has been set to "1", and the answer "YES" is given. Then, the CPU advances to step C307.

In step C307, the CPU checks if the note now sounding is that by the open string at the start of sounding, as described above. As seen from FIGS. 18(*f*) and 18(*g*), the sound at the note of the open string is output when the zero-cross point is detected, and then the answer "YES" is given, and the CPU goes to step C305. In this step C305, the control flag is set to "0", and saves the count of counter 7 into in-minimum memory 202.

The judgement in step C307 can be attained by providing such a flag in CPU 200 that is turned on during the period of time from the generation of the musical tone of the open string to the arrival of the next interrupt signal INT, and is turned off in other periods of time. The arrival time of the next interrupt signal INT is more exactly the time when the next interrupt signal INTan (where n is any of "1" to 6) arrives when the input waveform rises, and the time when the next interrupt signal INTbn (n is any of 1 to 6) arrives when the input waveform falls. In the example shown in FIG. 9, it is the timing of zero-cross point Zero 5.

In the case of the input waveform as shown in FIG. 18(*a*), when the zero-cross point Zero 5 following the next maximum peak point MAX2 is reached, interrupt signal INTa for the detection of zero-cross point after the maximum peak point is applied to CPU 200 (FIG. 18(*e*) CPU 200 resets FF 214 in step B301, and reads in the count of counter 7, and checks if the present wave of the waveform is not the first wave in step B302. Further, the CPU checks if the control flag is "0" in step B306. This control flag has been set to "0" at zero-cross point Zero 4 after the previous minimum peak point MIN1 (step C305 in FIG. 19). CPU 200 advances to step B307 and provides the answer "NO", and in step B308 reads out the time count data as set to in-maximum memory 201 at the zero-cross point Zero 1 immediate after the maximum peak point MAX1 before one period, and subtracts it from the this-time time count data as read out in step B301. As a result, in step A17 (or A27, A37, A47, A57, A67) shown in FIG. 17, which follows the FIG. 19 interrupt processing, the subtraction result data is applied to frequency ROM 8. At this time, under control of the CPU, the electronic guitar sounds with the musical tone at the frequency whose one period (t1 in FIG. 18(*e*) ranges from the zero-cross point Zero 1 to the zero-cross point Zero 5. In step B305 of the interrupt processing, CPU 200 sets the control flag to "1", and saves the this-time time count data into in-maximum memory 201.

In this way, in steps C305 and B306, the zero-cross points respectively immediately after the maximum peak points are checked, and the time interval (t1) between the zero-cross points is measured, and in step B308 the period calculation is performed.

Figure 20:
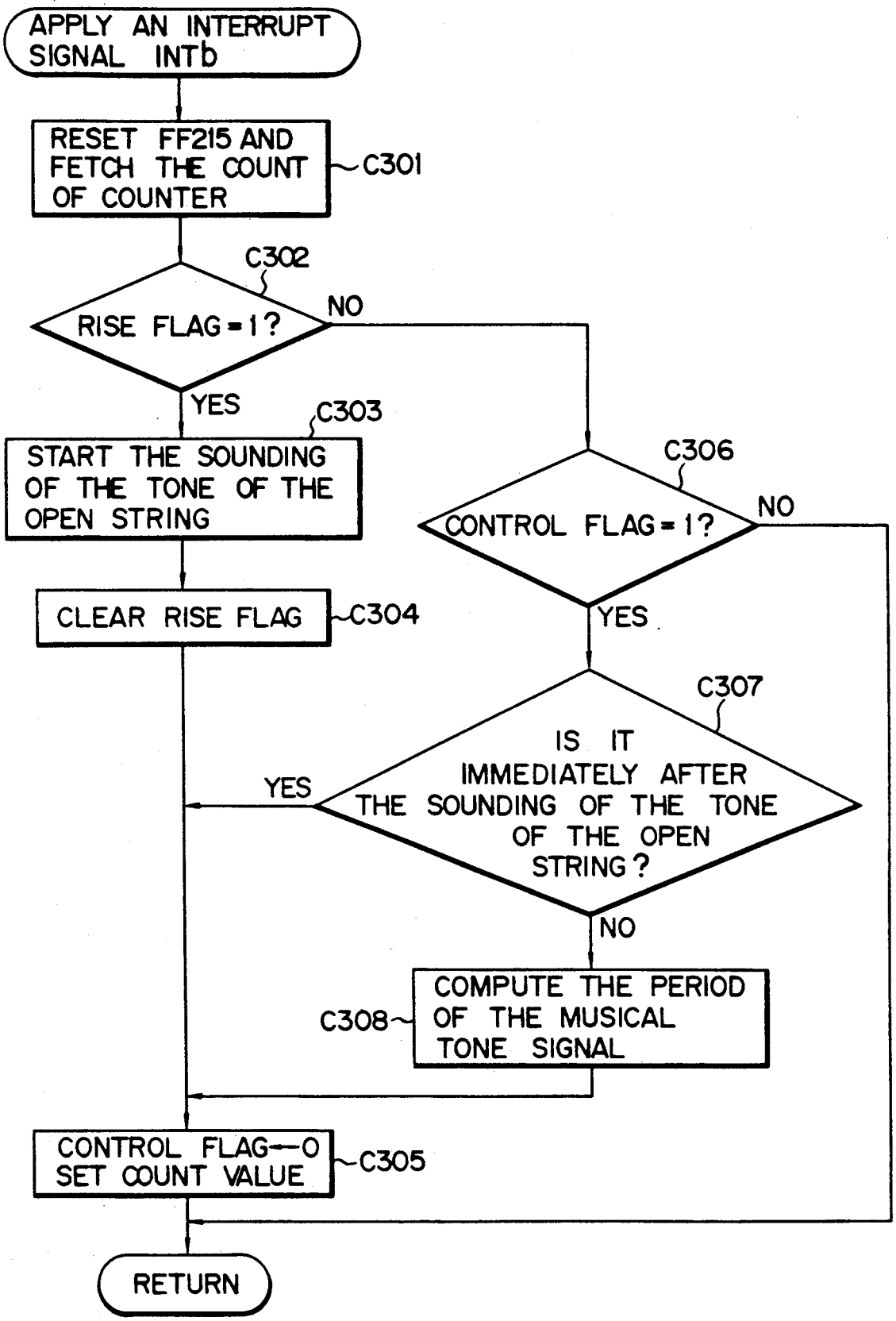
FIG. 20 shows a flowchart of an interrupt routine executed by the CPU of the third embodiment circuit when the zero-cross point is detected immediately after a minimum peak point is detected.
Figure 21:
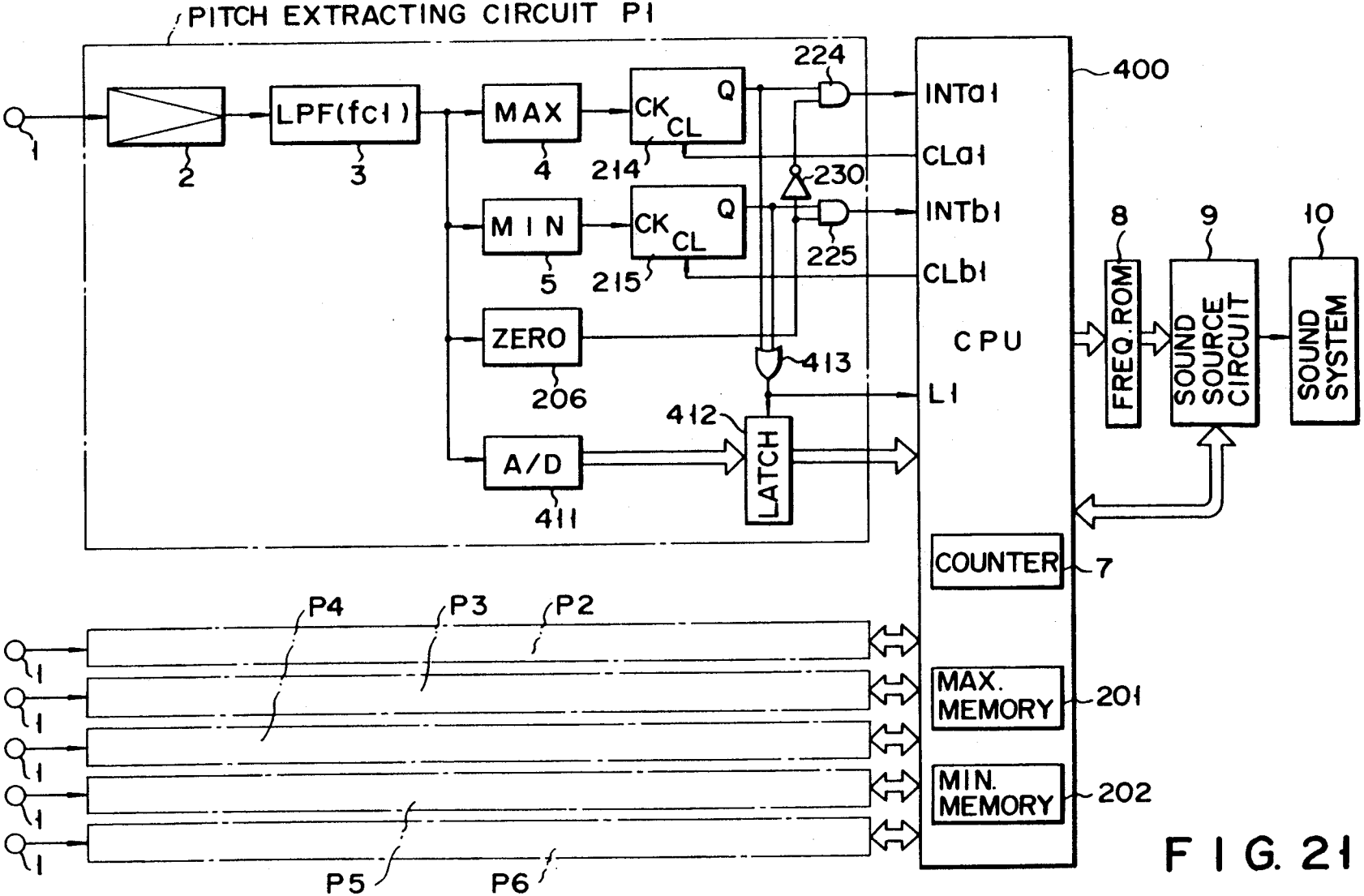
FIG. 21 illustrates in block form an overall arrangement of a fourth embodiment of the present invention.

Similarly, the zero-cross points Zero 6 and Zero 7 are ignored, and CPU 200 executes the routine of FIG. 20 in response to the interrupt signal INTb from AND gate 22 as generated upon detection of the zero-cross point Zero 8 immediately after the minimum peak detection. At this time, the time interval (t2) from the previous zero-cross point Zero 4 to the this-time zero-cross point Zero 8, is the pitch extraction data. This processing is performed in the order of steps C301 → C302 → C306 → C307 → C308 → C305.

Accordingly, in this embodiment, the musical tone at the note of this string, when it is in the open string, is generated at the generation of the first interrupt signal INTa for waveform rise or INTb for waveform fall. After the next interrupt signal, which is of the same type, two types of time intervals are obtained, and the frequency change is performed two times during one period. One of the two types of the intervals is the time interval (t1) between the zero-cross points, i.e., Zero 1 and Zero 5, immediately after the maximum peak values are detected. The other is the time interval (t2) between the zero-cross points, i.e., Zero 4 to Zero 8, generated immediately after the minimum peak values are detected. Therefore, the musical tone can quickly be output in response to the generation of the input signal. Subsequently, if the pitch is extracted, the operation of the electronic guitar follows up a frequency change of the input signal by setting the sounding note based on the extracted pitch.

In this embodiment, if the waveform as shown in FIG. 16 is input with the function of the control flag in the control flag shown in FIG. 20, the zero-cross points 12 and 14 are ignored. This operation is as described referring to FIG. 16 in the description of the second embodiment, and hence no further description will be given.

To stabilize the frequency, in step A17 (A27, A37, A47, A57, A67), the time count data previously stored and the this-time time count data are averaged and the averaged data is output. Alternatively, when the previous data is greater than that of the this time data by, for example, 20% or more, the previous data is output. The period calculations based on the zero-cross point detection immediately after the maximum and minimum peak points detections, may be selectively performed in a manner that the period calculation (i.e., only t1 is obtained) based on the zero-cross points immediately after the maximum peak points detection is executed for the waveform which rises at the start point, and that (i.e., only t2 is obtained) based on the zero-cross points immediately after the maximum peak points detection is executed for the waveform which falls at the start point.

As described above, in the third embodiment as mentioned above, CPU 6 can execute an appropriate processing as the step A17 (A27, A37, A47, A57, A67) shown in FIG. 17. The selection of the appropriate processing can be made by modifying the program for CPU 6, and not requiring any modification of the hardware, i.e., the external circuit of CPU 6. Therefore, the musical instrument of this embodiment is excellent in flexibility of use, and can easily be designed so as to have intelligent functions.

In the third embodiment, the time intervals (t1) and (t2) respectively between the zero-cross points immediately after the maximum and minimum peak points, are both obtained, but musical instrument is operable with satisfactory performances, if one of them is used. If this is done, the combination of maximum peak detector 4, FF 214, AND gate 224 and inverter 230 or the combination of maximum peak detector 5, FF 215, and AND gate 225 may be omitted, thus simplifying the Circuit arrangement of the musical instrument, i.e., electronic guitar.

Figure 19:
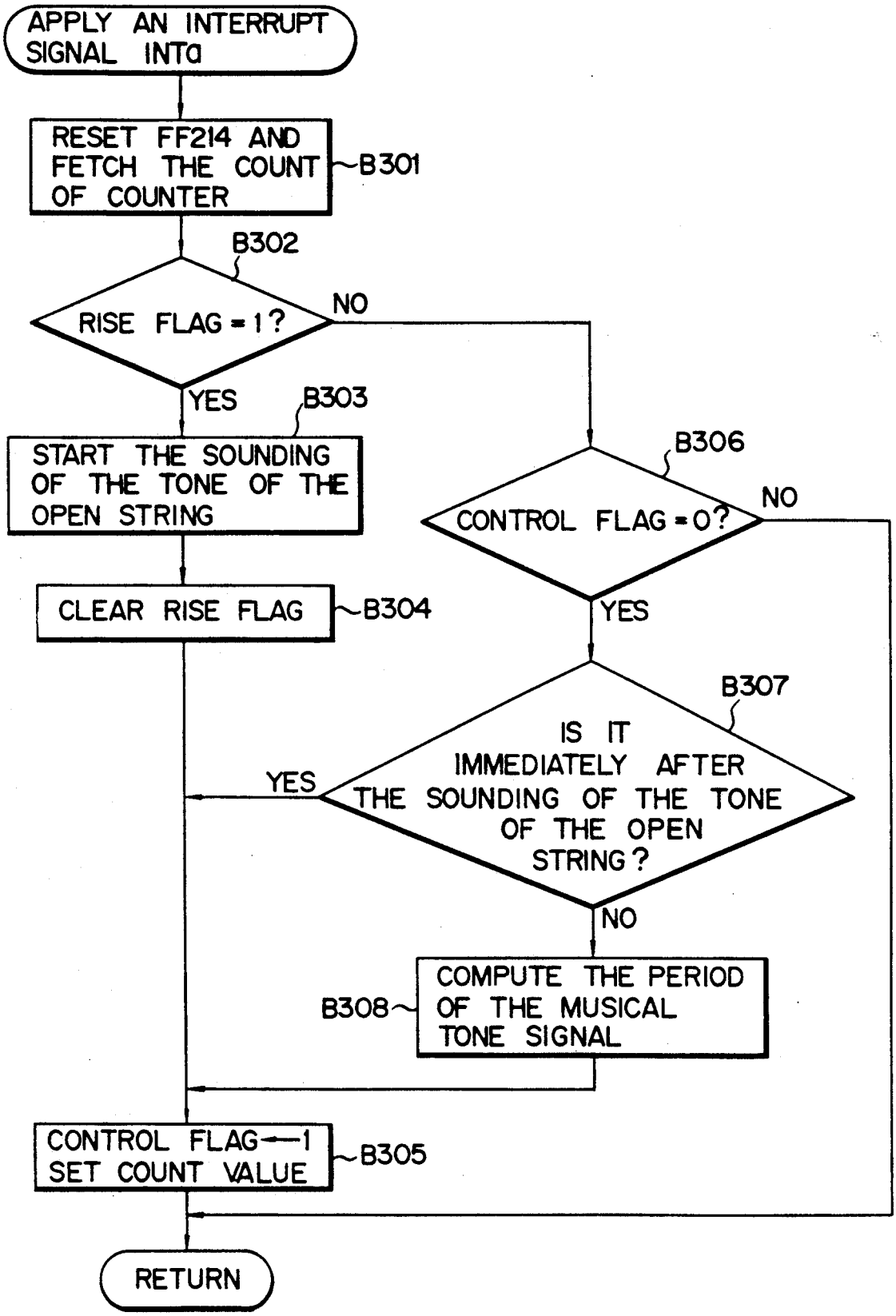
FIG. 19 shows a flowchart of an interrupt routine executed by the of the third embodiment circuit when the zero-cross point is detected immediately after a maximum or positive peak point is detected.

In the above-mentioned embodiment, CPU 200 controls the system of the electronic guitar, so that the actual sounding of the musical tone is started in step B303 in FIG. 19 or step C303 in FIG. 20. Alternatively, the sounding may be started in a sequence of the processings in FIG. 17 as the main flow, after the interrupt processing is completed.

Also in the third embodiment, the period calculation is performed in the step B308 in FIG. 19, and in the step C308 in FIG. 20. The control of the musical tone frequency change, which is based on the period calculation, is executed in step A17 (A27, A37, A47, A57, A67). If necessary, this processing can be made during each interrupt processing.

In the third embodiment, the frequency change is made until the first one wave of the note sound of the open string is completed, as shown in FIG. 18(*g*). Therefore, the actual tone frequency can be obtained before the player feels the periodicity (i.e., the frequency or pitch) of the output sound at the early stage of sounding. The sounding start is possible at early timing, and the player hear the sound with natural feeling of sound at the time of sounding start.

To quicken the response, when CPU 200 detects the string vibration before the maximum peak value MAX1 in FIG. 18(*a*), that is, CPU 200 detects that A/D converter 11 outputs a signal at an amplitude larger than a predetermined level, the CPU applies a sounding start command of the open string note to frequency ROM 8 and sound source circuit 9 in the processing to set the rise flag to "1" (steps A13 and A16, A23 and A26, A33 and A36, A43 and A46, A53 and A56, A63 and A66).

While in the above-mentioned embodiment, the present invention is applied to an electronic guitar, it can be applied to any other systems of the type in which pitches are extracted from a sound signal or an electrical vibration as input from a microphone, for example, and an acoustic signal, which is different from the original signal, is generated at the pitches or note frequencies corresponding to those of the original signal. Specific examples of such are electronic pianos with key boards, electronic wind instruments, electronic string instruments such as electronic violins and koto (Japanese string instrument).

In case that, before the pitch extraction, the musical tone is generated at a predetermined pitch by using any of such various types of musical instruments, and after the pitch extraction, the musical tone is changed to have the pitch, if a player hears the musical tone and can distinguish the frequencies of one from the other, he feels something unnatural. In this respect, the musical sound first output must be in length within one wave length (period), and it is desired that the musical tone at low pitch is first output.

It should be understood that any suitable measure may be employed for the pitch extraction. In the above-mentioned embodiment, either of the two time intervals (t1) and (t2) is used for the pitch extraction. As recalled, the time interval (t1) is between the zero-cross points first appearing after the maximum peak values of the input waveform. The time interval (t2) is between the zero-cross points first appearing after the minimum peak values of the input waveform. Another possible pitch extraction is to compare the time interval (T1) between two adjacent maximum peak values of the input waveform with the time interval (T2) between two adjacent minimum peak points. A further possible pitch extraction is to use the time interval between the two adjacent zero-cross points. An additional pitch extraction is to use the auto-correlation function or other suitable function of the period calculation.

As described above, when the inputting of the input signal is detected, a musical tone is first generated at a predetermined pitch. After this, the pitch of the musical tone is extracted, the frequency of the musical tone is changed to the extracted pitch, and then the musical tone is sounded. Therefore, the response time of the electronic guitar, which ranges from the inputting of an input signal of musical tone till it is sounded, can be reduced. Electronic guitars, which are free from any unnatural sound feeling, can be provided.

FOURTH EMBODIMENT

1. General

A fourth embodiment of an electronic guitar according to this embodiment will be described referring to FIGS. 21 to 27.

The electronic guitar of this embodiment is improved in that the time from the inputting of an input signal waveform until the generation of an actual acoustic sound is shortened to have a good response for eliminating unnatural feelings of sounded musical tones.

The fourth embodiment is based on the fact that three items of distinctive period information exist between two periods of the input signal waveform. Within the time interval of less than two periods of the input signal waveform, two periods of the waveform are detected. If the detected two periods are almost equal to each other a controller issues a command to start the sounding.

More specifically, the two periods are detected by detecting the time interval t1 between the zero-cross points each first appearing after the maximum peak of the input signal waveform is detected, and by detecting the time interval t2 between the zero-cross points first appearing after the minimum peak point of the input signal waveform is detected.

Alternatively, the two periods are detected by detecting the time interval T1 between the maximum peak points of the input signal waveform and by detecting the time interval T2 between the minimum peak points of the same waveform.

The above technical features reduces the time from the arrival of the input signal to the, generation of artificial acoustic wave, providing desirable performance by the guitar.

2. Description of Arrangement and Operation

1) Arrangement

The fourth embodiment is configured like the second embodiment. For the configuration of this embodiment, reference is made to FIGS. 10 and 11 of the second embodiment. Like or equivalent portions are designated by like reference numerals in FIGS. 10 and 11, for simplicity.

Six pitch extraction circuits P1 to P6 are used. A/D converter 411 is contained in each pitch extraction circuit P1 to P6. The output signal of FFs 214 and 215 are applied as read-in signals to latch 412, via OR gate 413. In response to the signal from OR gate 413, latch 412 fetches the digital output of A/D converter 411.

With such an arrangement, each latch 412 latches the maximum or minimum peak point of the input signal waveform, so that CPU 400 can readily fetch these peak values.

The output signal of each OR gate 413 is applied as each signal L1 to L6 to CPU 400.

2) Operation

Figure 22:
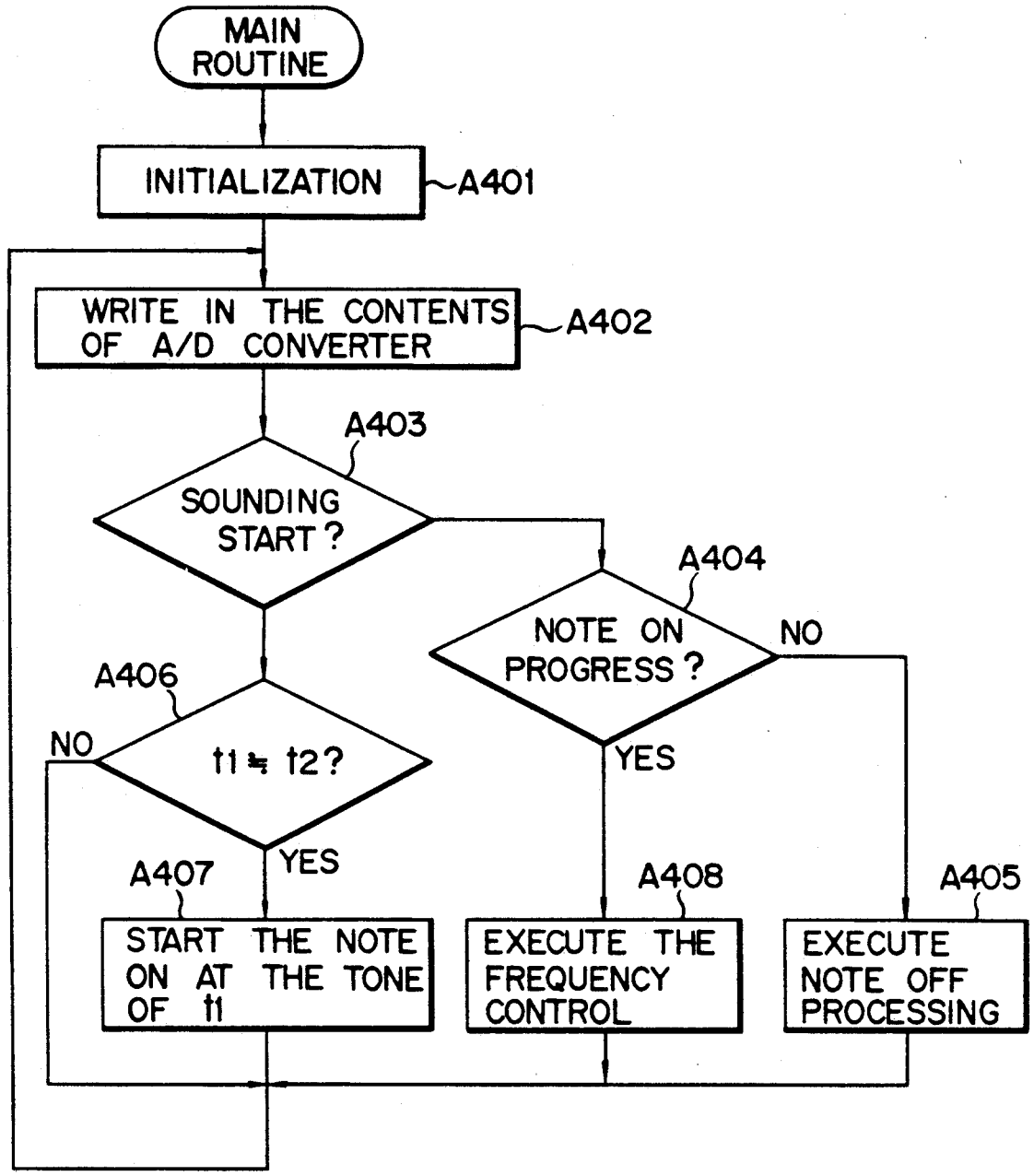
FIG. 22 shows a flowchart of a main routine of the CPU in the FIG. 21 circuit.
Figure 23:
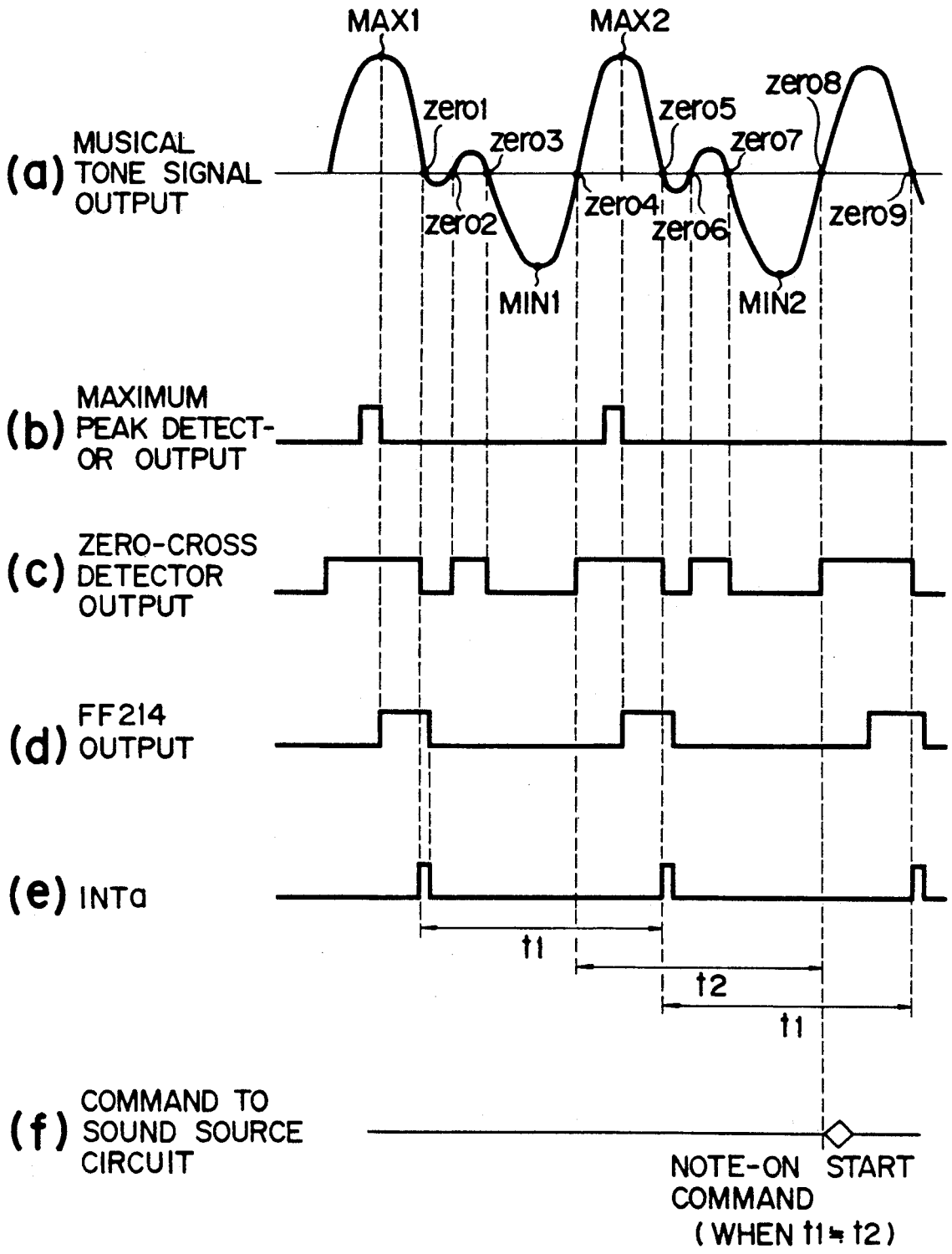
FIG. 23 shows a timing chart useful in explaining the operation of the FIG. 21 circuit when it receives an waveform of the input signal.

FIG. 22 shows a main routine executed by CPU 400. This routine is similar to those of embodiments mentioned earlier. The main routine illustrated is for processing of the musical tone generated by one string of the guitar. This processing is correspondingly applied to the other five strings. Actually, CPU 400 executes these routines in a time divisional manner. CPU 400 first executes step A401 to initialize the system of the electronic guitar. Following this, CPU 400 reads on the contents of A/D converter 411 in step A402. The CPU continues the tone-off processing of musical tone until the output level of A/D converter 41 reaches a predetermined level (steps A403, 404, and 405). If the guitar string is picked, and the musical tone signal above the predetermined level as shown in FIG. 23 is input to A/D converter 411 (step A403), the CPU advances to step A405. In this step, the CPU checks whether or not the already extracted time intervals t1 and t2 are equal. Since both the intervals are not yet detected, however, the answer in step A406 is NO, and the CPU returns to the original flow. As described later, when starting the sounding, the CPU advances to step A407 and starts the sounding of the musical tone at the pitch as determined by the time interval t1 (nearly equals t2). Subsequently, the CPU goes through the route of A403 → A404 → A408. In the step A408, the CPU executes the frequency control processing, i.e., the sounding processing to apply the data for designating the musical tone to frequency ROM 8. This sounding processing is continued so long as the musical tone signal level is above the predetermined level (steps A402 → A403 → A404 → A408). When the output level A/D converter 411 is below the predetermined level, step A405 is executed and the sounding starts.

The operation of the electronic guitar, when a string of it is picked, will be described. A string is picked and the waveform of the musical tone as generated rises, and its level reaches the first maximum peak point MAX1 shown in FIG. 23(*a*). Maximum peak detector 4 produces a signal as shown in FIG. 23(*b*). This signal sets the output of FF 214 high (FIG. 23(*d*)). The zero-cross point detection output signal from zero-cross point detector 6 is inverted at the zero-cross point Zero 1 (see FIGS. 23(*a*) and 23 (*c*)). At this time interrupt signal INTan is transferred to CPU 400, from AND gate 224. Upon receipt of this, the CPU starts the interrupt processing of FIG. 24. This processing is substantially the same as the interrupt processing of FIG. 14. The period obtained in the step B4 in the FIG. 24 routine is used as the interval t1.

Figure 25:
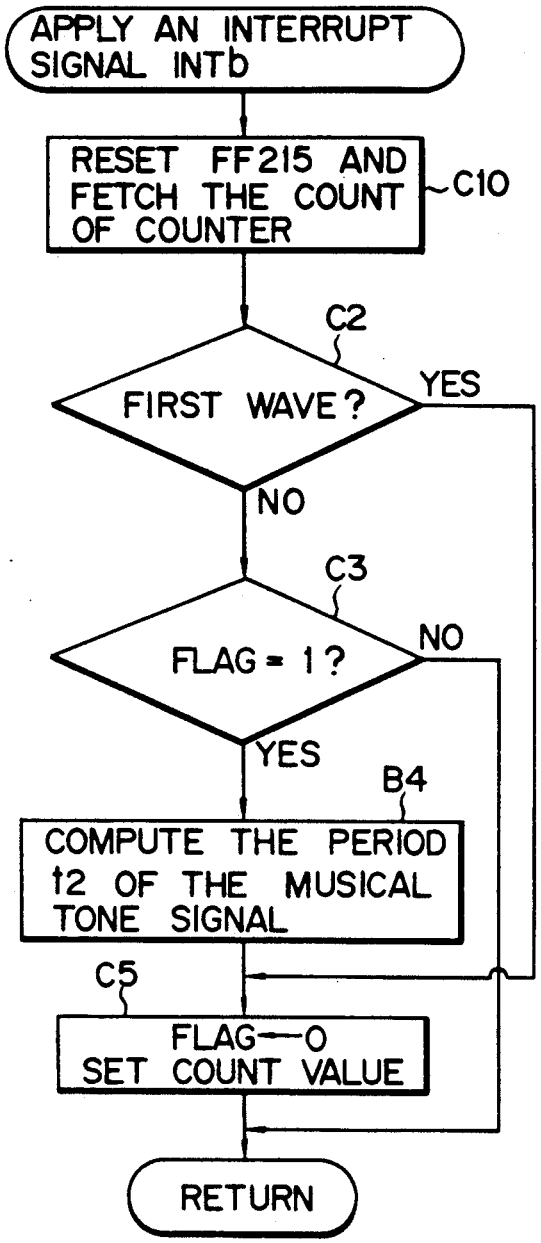
FIG. 25 shows a flowchart of an interrupt routine executed by the CPU of the FIG. 21 circuit immediately when the zero-cross point is detected after a minimum or negative peak point is detected.

When at the zero-cross point Zero 4 in FIG. 23(*a*), interrupt signal INTbn is applied to CPU 400, the CPU execute the FIG. 25 processing. The FIG. 25 interrupt processing is substantially the same as that of the FIG. 15 processing of the second embodiment.

In FIG. 23(*a*), CPU 400 first obtains the period data t1 through the interrupt processing at the zero-cross point Zero 5, and obtains the period data t2 by the interrupt processing at the zero-cross point Zero 8.

Following the detection of this zero-cross point Zero 8, the CPU returns to the main routine. In this routine, the CPU executes steps A403 and A406 in FIG. 22, successively. If the time data t1 and t2 are approximately equal, and the difference between them is within a tolerable range, the answer in step A406 is YES, and in step A407 the CPU causes the sound source circuit to start the sounding of musical tone at the frequency a defined by the time data t1 or t2 (see FIG. 23 (*f*)).

If the answer to the step A406 is NO, that is, when interval t1 between zero-cross points Zero 1 and Zero 5 is not equal to the interval t2 between zero-cross points Zero 4 and Zero 8, no sounding starts and the CPU waits for the next interrupt processing. Then, the CPU checks if the time interval t2 between the points Zero 4 and Zero 8 is equal to the next time interval t1 ranging from zero-cross points Zero 5 to Zero 9 (FIG. 23(*a*)). This is made in step A406. If the check result is YES, the CPU advances to step A407 where it directs the start of sounding.

Subsequently, the CPU measures the time interval t1 between the zero-cross points immediately after the maximum peak point detection, and the time interval t2 immediately after the minimum peak point detection. The CPU executes the frequency change processing two times for one period, if necessary. Therefore, the guitar can respond to the frequency change of the input signal quickly.

Figure 24:
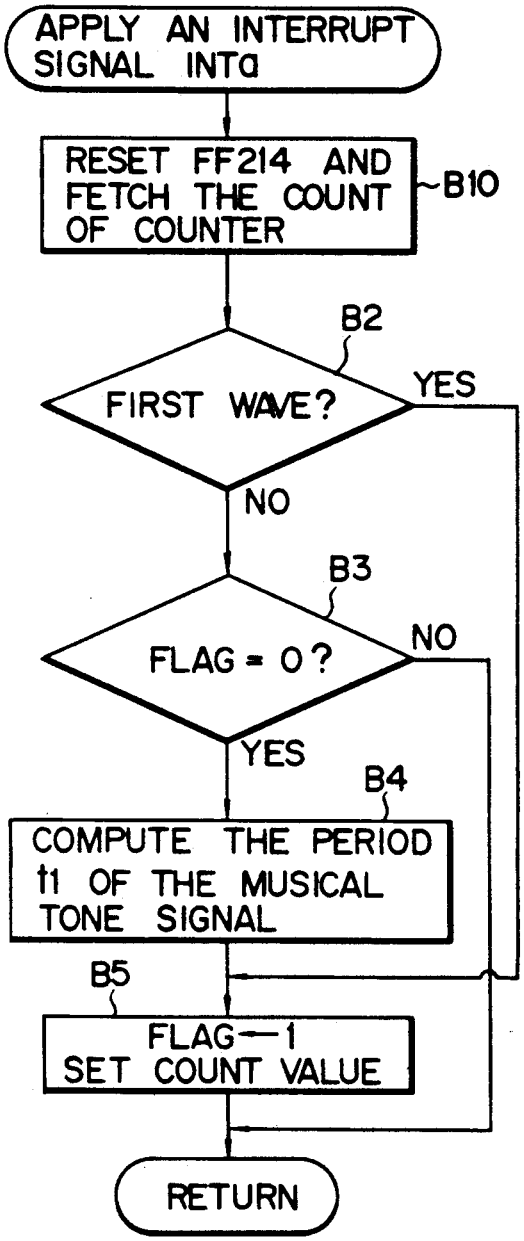
FIG. 24 shows a flowchart of an interrupt routine executed by of the FIG. 21 circuit when the zero-cross point is detected immediately after a maximum or positive peak point is detected.

In this embodiment, with the flag function in the flows of FIGS. 24 and 25, if the waveform as shown in FIG. 15 in the first embodiment is input, the zero-cross points 12 and 14 are ignored.

In the above-mentioned embodiment, the waveform input is that of the type in which the waveform first rises, viz., the amplitude of the waveform increases from zero level to positive. The same operation can be obtained when the waveform first falling, or going from zero level to negative is input.

Figure 26:
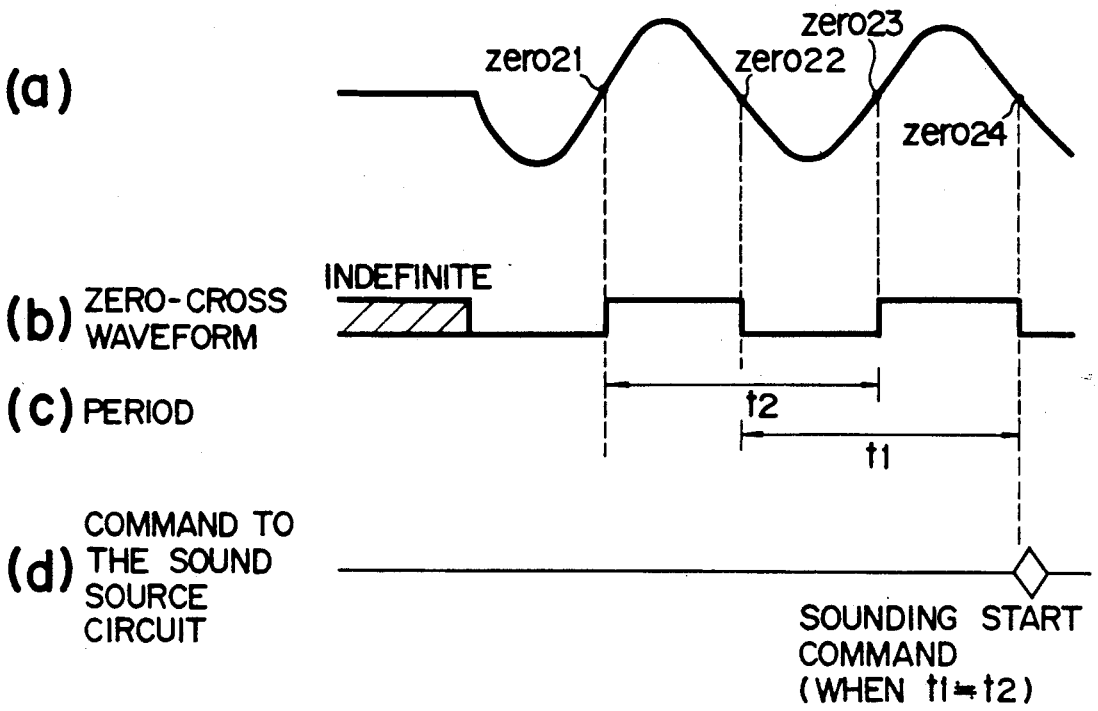
FIG. 26 shows a timing chart useful in explaining the operation of the FIG. 21 circuit when it receives another waveform of the input signal.

Such an example is shown in FIG. 26. When the waveform as shown in FIG. 26(*a*) comes in, zero-cross point detector 206 outputs a signal with a waveform as shown in FIG. 26(*b*). As a result, interrupt signal INTb is applied to CPU 400. At this time point, the FIG. 25 routine starts. Count 7 starts the counting of the time interval t2 (see zero-cross point Zero 21 in FIG. 26(*a*) then interrupt signal INTa is generated at the zero-cross point Zero 22 in the same figure. The CPU starts the processing of the FIG. 24 flow chart. At the next zero-cross point Zero 23, the first period calculation is completed to obtain interval t2. At the next zero-cross point Zero 24, time t1 is obtained (see FIG. 26(*c*)).

The CPU executes the FIG. 24 processing as the interrupt at zero-cross point Zero 24. After completion of this processing, the CPU returns to the main flow of FIG. 22, and executes steps A403 and A406 in a successive manner. Step A406 is used for checking the intervals t2 and t1 fall within a time length within a tolerance (FIG. 26(*c*)). If the answer to this step is YES, the CPU advances to step A407 and give the command to generate a musical tone with the period of that time length to frequency ROM 8 and sound source circuit 9 (FIG. 26(*d*)).

If the answer to step A406 is NO the CPU checks if the previous time interval t1 (between Zero 22 and Zero 24) is equal to the next interval t2 (ranging from zero-cross points Zero 22 to Zero 24), after about half period. If these intervals are approximately equal, the CPU executes the sounding start processing.

Thus, even when the waveform falls, the sounding can be started during the period of time less than two periods (for a sine wave, it is 1.5 period).

To stabilize the frequency in step A408 in FIG. 22, after sounding is started, the time count data previously stored and the this-time time count data are averaged and the averaged data is output. Alternatively, when the difference between the previous data and the this time data is great, for example, 20% or more, the previous data is output. The period calculations based on the zero-cross point detection immediately after the maximum and minimum peak points detections, may be selectively performed in a manner that the period calculation based on the zero-cross points immediately after the maximum peak points detection is executed for the waveform which rises at the start point, and that based on the zero-cross points immediately after the maximum peak points detection is executed for the waveform which falls at the start point.

As described above, the CPU may select an appropriate processing in the step A405 in FIG. 22. It is noted that this selection can be made by some modification of the software, and not modifying the external circuit of the CPU. Therefore, the musical instrument of this invention can be flexibly used.

In the above-mentioned embodiment, the period of the waveform is calculated in step B4 in FIG. 24 and in step C4 in FIG. 25. The sounding control based on the calculated period and the musical tone frequency are performed in the step A407 or A408 in the main flow of FIG. 22. These processings may be performed in the interrupt processing (FIGS. 24 and 25), if necessary. If this is done, the response to the input signal is speeded up.

3. Modification of the 4th Embodiment

Figure 27:
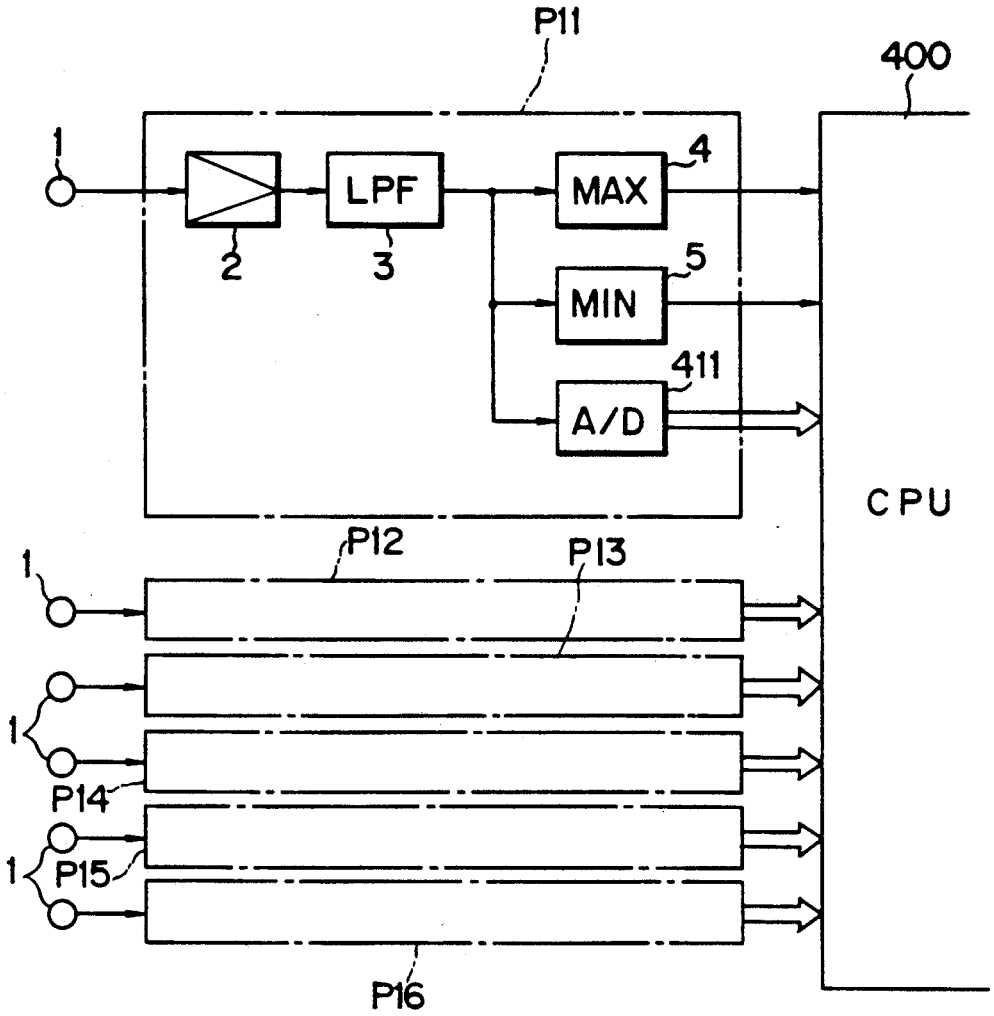
FIG. 27 shows a block diagram of a modification of the FIG. 21 circuit as the fourth embodiment.

A modification of the fourth embodiment will be described. An overall circuit configuration of the fourth embodiment is shown in FIG. 27 In the modification, the time intervals T1 and T2 respectively between the maximum and minimum peak points are detected. The sounding control is made on the basis of the detected time intervals.

The output signals from a microphone and pick-ups are applied to input terminals 1, and then to pitch extraction circuits P11 to P16. The specific configuration of each pitch extraction circuit P11 to P16 is as shown in FIG. 27. As shown, each amplifiers 2 receives the musical tone signal from the corresponding input terminal 1. Each low-pass filters 3 cuts off the high frequency components of the output signal from the amplifier. The output signal of the filter is applied to maximum peak detector 4, minimum peak detector 5, and A/D converter 411.

These detectors 4 and 5 may be the same as those of the first embodiment.

The signals of these detectors 4 and 5, A/D converter 411 are applied to CPU 400. On the basis of these signals, the CPU appropriately processes the sounding start and frequency change.

Figure 28:
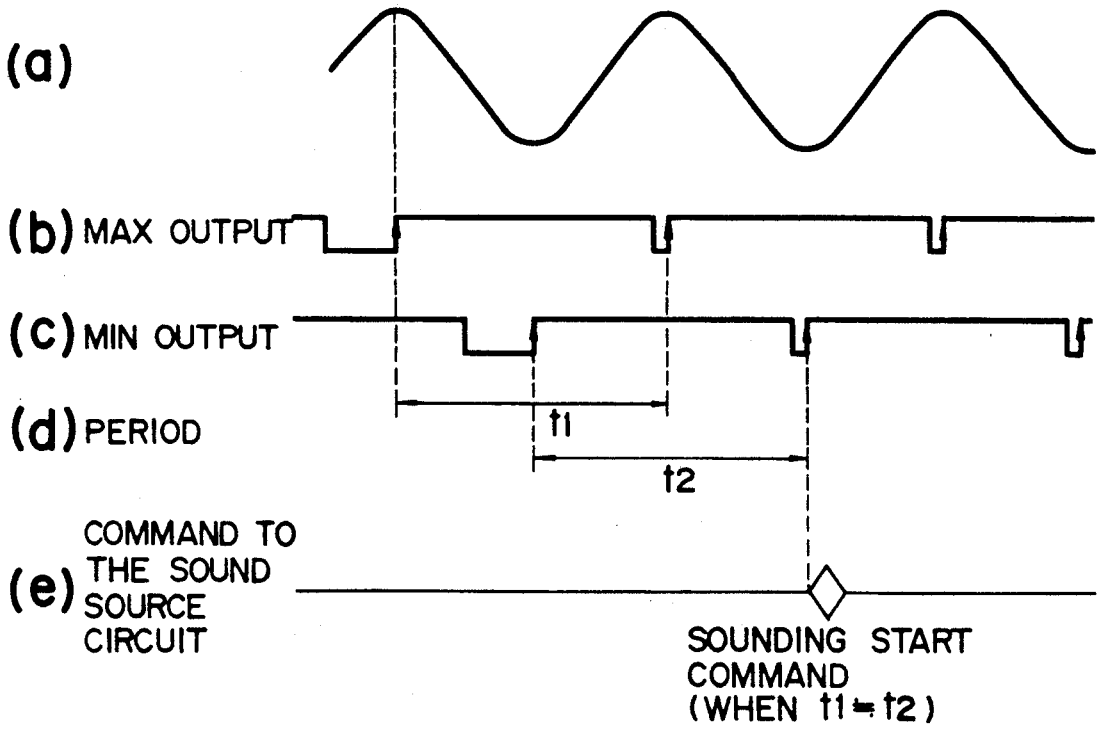
FIG. 28 shows a timing chart for explaining the operation of the FIG. 27 circuit.

FIG. 28 shows a timing chart of related signals when the input signal waveform rises. When the waveform as shown in FIG. 28(*a*) comes in, maximum peak detector 4 has the output waveform as shown in FIG. 28(*b*). The waveform of the output signal of minimum peak detector 5 is as shown in FIG. 28(*c*).

CPU 400 works out the time intervals T1 and T2 on the basis of the output signals from those detectors, as shown in FIG. 28(*d*). If the time intervals T1 and T2 each representing one period of the waveform are substantially equal to each other and the difference between them is within a tolerable range, a sounding start command as shown in FIG. 28(*e*) is applied to the sound source circuit.

If these time intervals T1 and T2 are not equal, the time interval T1 is measured about half period later, and it is compared with the old time interval T1. If these are substantially equal, the sounding start processing is executed.

It should be understood that any suitable measure may be employed for the pitch extraction. In the above-mentioned embodiment, either of the two time intervals t1 and t2 is used for the pitch extraction. As will be recalled, the time interval t1 is between the zero-cross points first appearing after the maximum peak values of the input waveform. The time interval t2 is between the zero-cross points first appearing after the minimum peak values of the input waveform. Another possible pitch extraction is, as described in the modification, to compare the time interval T1 between two adjacent maximum peak values of the input waveform with the time interval T2 between two adjacent minimum peak points. A further possible pitch extraction is to use the time interval between the two adjacent zero-cross points. An additional pitch extraction is to use the autocorrelation function or other suitable function of the period calculation.

The fourth embodiment and its modification use three types of period data t1, t2, t3 or t2, t1, t2 and T1, T2, T1 or T1, T2, T1. During the time interval of less than two periods of the input waveform (if it is a perfect sine wave, the interval is 1.5 period), two periods of the waveform are detected. If these values of periods are coincident with each other, the CPU directs the sound source circuit to start the sounding.

While in the above-mentioned embodiment, the present invention is applied for the electronic guitar, it can be applied for any other systems of the type in which pitches are extracted from a sound signal or an electrical vibration as input from a microphone, for example, and an acoustic signal, which is different from the original signal, is generated at the pitches or note frequencies corresponding to those of the original signal. Specific examples of such are electronic pianos with key boards, electronic wind instruments, electronic string instruments such as electronic violins and koto (Japanese string instrument).

As described above, during the time interval of less than two periods of the input signal waveform, two periods of the input signal waveform are detected. If these are substantially equal, the CPU directs the sounding of a musical tone at the frequency as defined by the period. Therefore the time required from the inputting of the waveform to the actual sounding start is reduced. The result is to improve the response performance and to eliminate unnatural feeling of sounded musical tones.

FIFTH EMBODIMENT

1. General

A fifth embodiment of an electronic guitar according to the present invention will be described, referring to FIGS. 29 to 32.

The fifth embodiment is proposed with an intention to prevent an erroneous operation of the guitar due to the resonance between the vibrations of different strings when the sounding is started. To prevent this, this embodiment employs an electronic measure in place of the mechanical measure, which has employed by the conventional electronic guitar.

To realize this, when the inputting of an input signal of musical tone starts, a controller checks as to whether the change of peak values of the input signal waveform is great or small when observed sequentially in time. On the basis, of the check result a further check is made as to whether the peak value change is due to the resonance of string vibrations. If the result of this additional check shows that the peak value change is not related to the resonance of vibrations of different strings, the controller issues a command to start the sounding of the musical tone.

2. Arrangement and Operation

1) Arrangement

The arrangement of this embodiment is substantially the same as that of FIG. 1. No further description is required for the description of the fifth embodiment.

2) Operation

Figure 29:
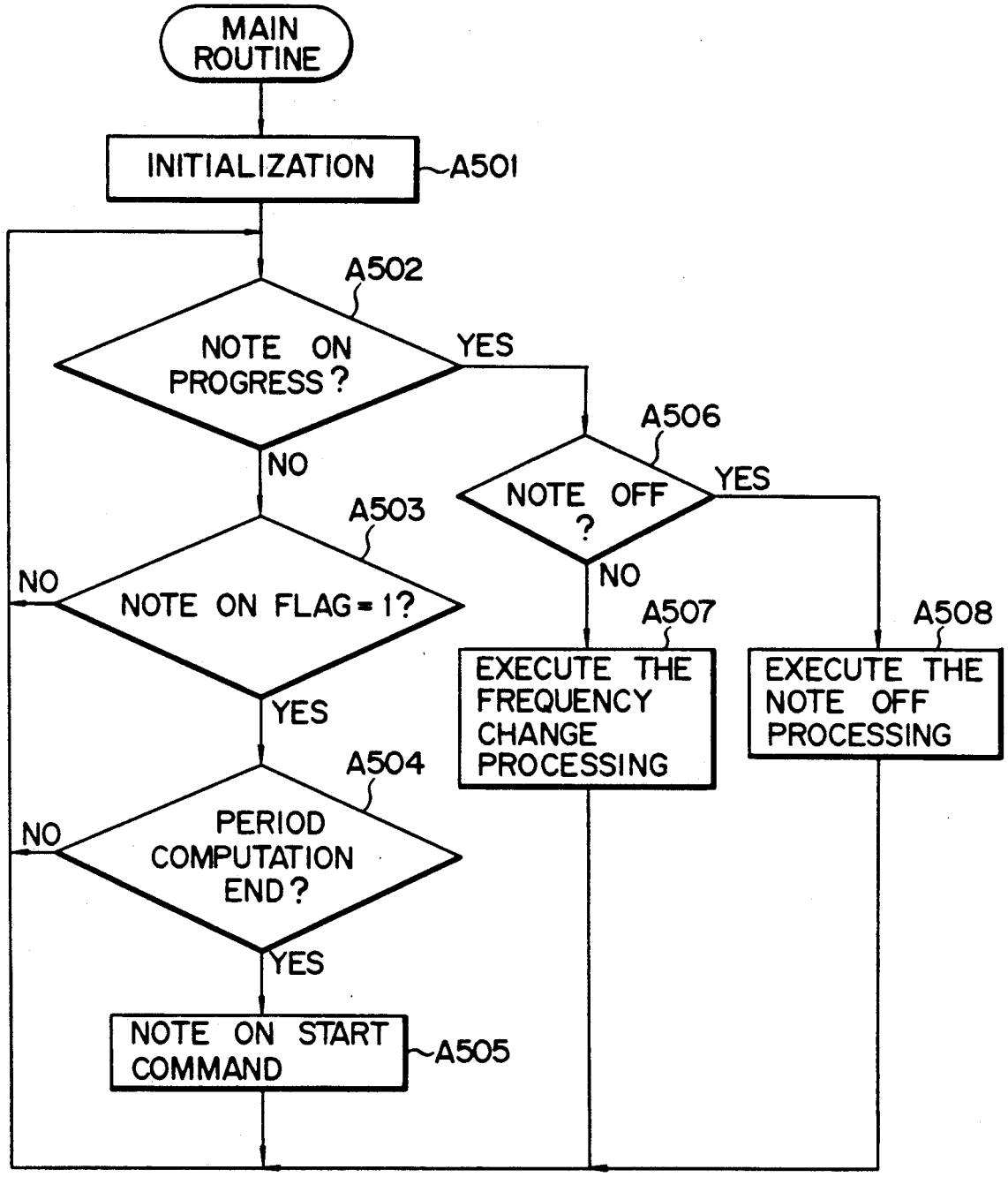
FIG. 29 shows a flowchart of a main routine executed by the CPU which is used in a circuit of musical instrument according to a fifth embodiment according to this invention.

A main routine of CPU 400 is illustrated in FIG. 29. The illustration of FIG. 29 is for the processing of the musical tone generated by one string. The same processing is correspondingly applied for the other string musical tone. In a specific overall system, CPU 400 processes the musical tones by six strings in a time-divisional manner.

To start with, CPU 400 initializes the system of the electronic guitar in step A501 in FIG. 29, and checks if the sounding is now performed or not in step A502. Before sounding, the CPU checks if the note-on flag is "1". If the flag is still "0", NO is given. Then, the CPU returns from step 503 to step 502. The CPU repeats the execution of steps 502 and 503.

If the flag is "1", the CPU advances from step 503 to step 504. After completion of the period calculation of the input waveform, that is to say, the period is calculated using in-maximum memory 201 and in-minimum memory 202, the CPU goes from step 504 to 505, and gives a sounding start signal to sound source circuit 9 and frequency ROM 8, resulting in sounding the musical tone.

After sounding, the CPU advances from step A502 to step 506. If the output of A/D converter 411 is not below a predetermined value, the CPU goes from step A506 to A507. In this step, the CPU changes the frequency on the basis of the frequency data computed every time the interrupt processing is executed. Steps A502, A506 and A507 are successively executed. When the input level progressively goes low, the CPU goes from step A506 to A508, to execute the note-off processing.

The operation of the electronic guitar when the waveform by the string vibration, will be described in detail.

Figure 30:
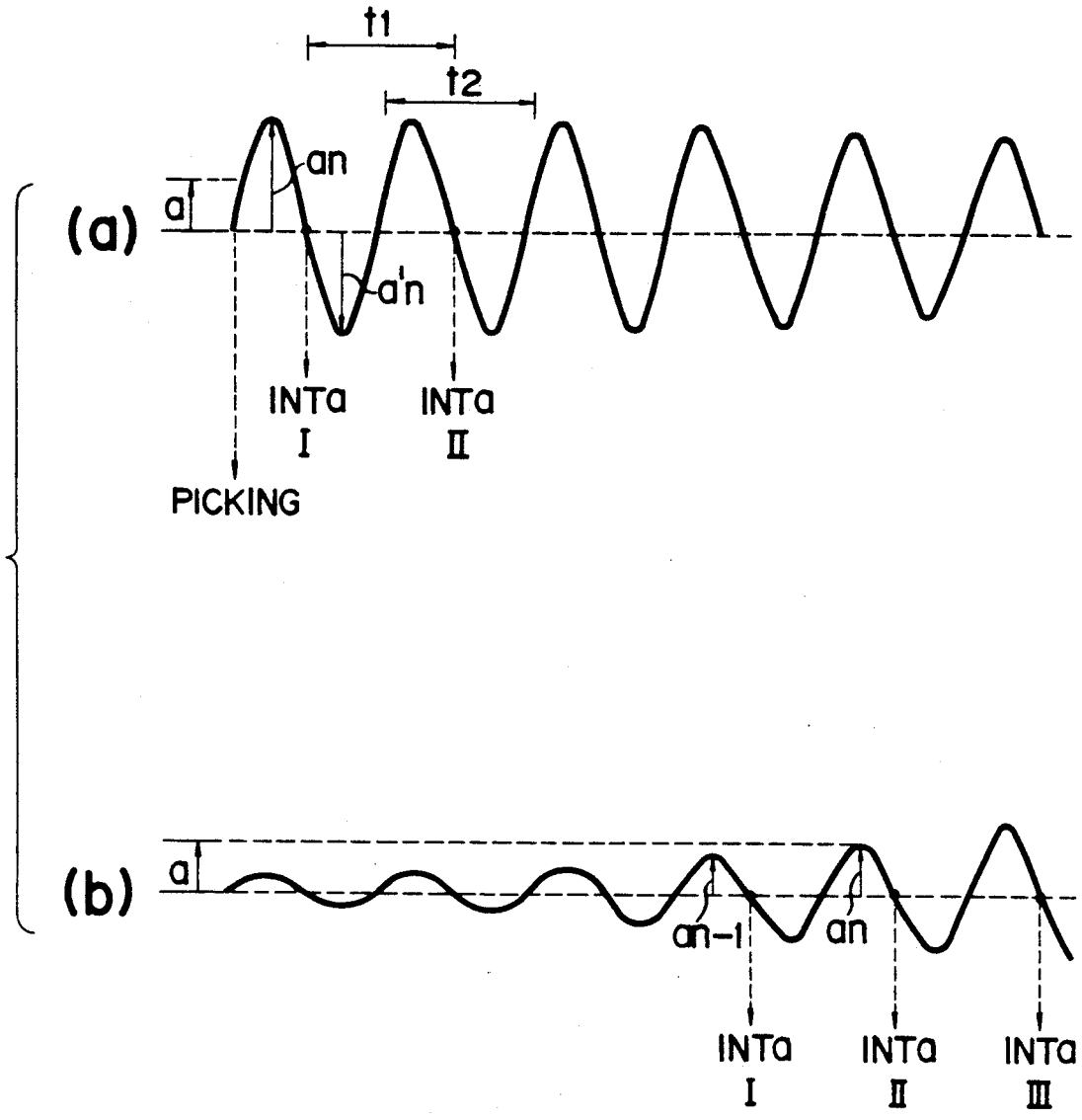
FIG. 30 shows a timing chart useful in explaining the operation of the fifth embodiment circuit when it receives an waveform of the input signal.

FIG. 30(*a*) shows the waveform of the output signal from low-pass, filter 3 when the normal string operation is performed, viz., a string is picked. As shown, the waveform steeply rises (falls) as soon as the string is picked.

FIG. 30(*b*) shows a waveform which gently rises due to the resonance of vibrations of strings.

When the waveform steeply rises as shown in FIG. 30(*a*), interrupt signal INTa is generated at the timing of (1) which in turn is transferred to CPU 400. Upon receipt of this, CPU 400 executes the interrupt processing of FIG. 31.

In step B501, the CPU fetches the output of latch 412 in A/D converter 411 The output of latch 412 is the maximum peak value of an.

In step B502, the CPU clears FF 214, and executes the step B503 to fetch the count of counter.

In step B504, the CPU checks if note-on flag contained in CPU 400 is "1". Now this flag is "0". Then the CPU goes to step B505 to check if the peak value an exceeds the sound start level a (FIG. 30) as the reference. The answer to this step is YES and the CPU proceeds to step 506.

In step 506, the CPU checks if (an −an-1) >R is satisfied. "an-1" is the previous peak value and "an" is this-time peak value. "R" is a factor at a predetermined positive value which provides a reference to check if the input waveform is due to the vibration resonance or the normal vibration.

In the waveform of FIG. 30(*a*), the peak value an-1 is initialized and "0". Then "an" is larger than "R". Under this condition, the CPU step B507 and to set the note-on flag to "1" and goes to step B508. In this step the CPU sets the peak value an as extracted this time, as the previously extracted peak value an-1 into the memory within the CPU, and returns to the main flow.

During the interrupt processing of (2), the CPU detects the value of t1, i.e., the interval between the zero-cross points respecting following the maximum peak points of the waveform. This is obtained as the difference between the count of counter 7 and the value of in-maximum memory 201.

After this processing, the CPU returns to the main routine of FIG. 29. Then, it executes steps A502 to A504. In step A505 CPU 400 issues a command to sound the musical tone at the frequency based on time interval t1.

Figure 31:
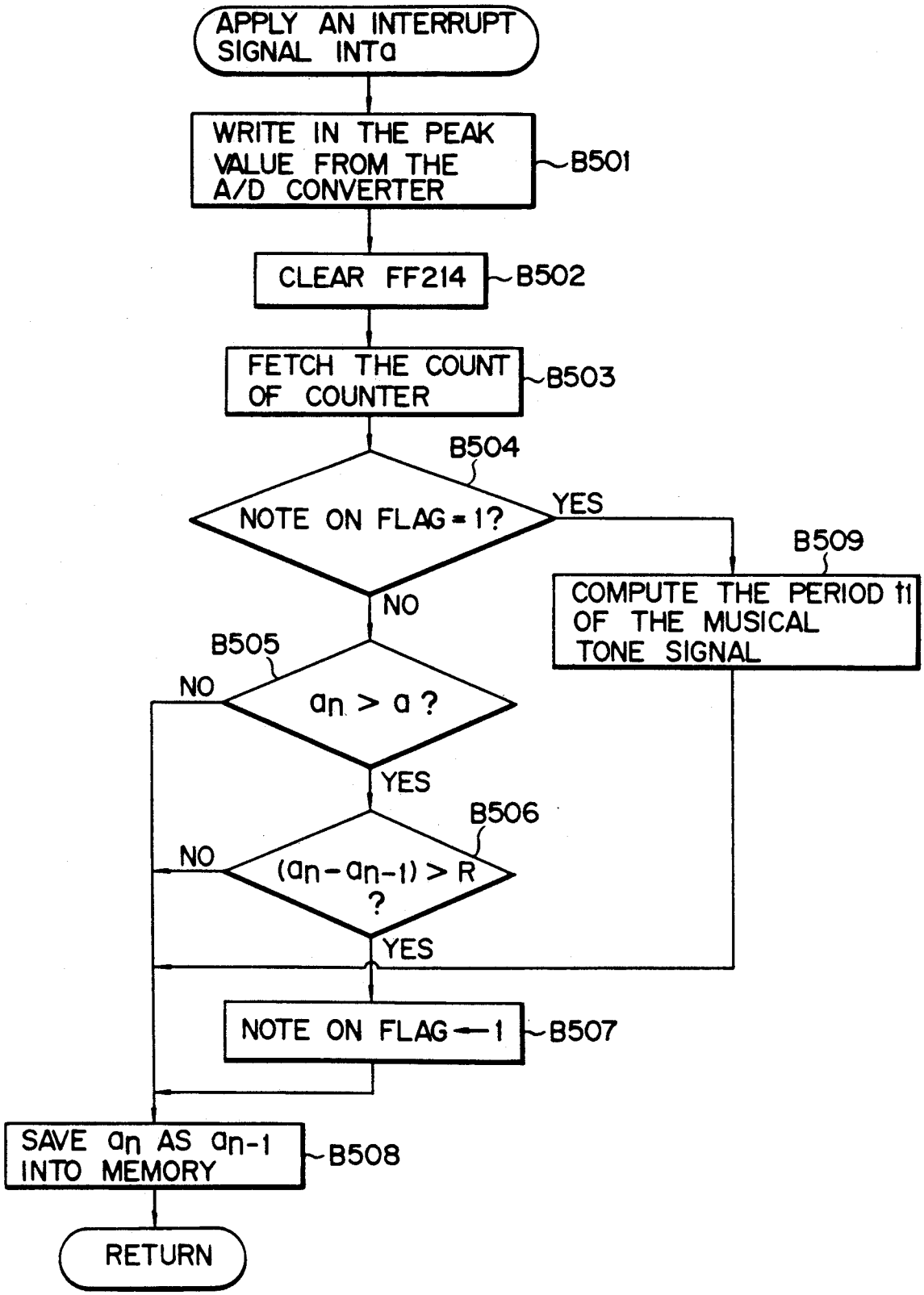
FIG. 31 shows a flowchart of an interrupt routine executed by of the fifth embodiment circuit when the zero-cross point is detected immediately after a maximum or positive peak point is detected.

Similarly, the CPU receives interrupt signal INTb via AND gate 225, and executes the interrupt processing like that of FIG. 31. The flow chart of this processing is not illustrated, but will be described applying Cn to Bn (n is any of 501 to 509) in these steps in the FIG. 31 routine. In step C502, FF 215 is reset and in step C505, peak values an' and a are compared with each other. The an' designates a negative peak value. In step C506, negative peak values an' are compared in step B508, the CPU saves the peak value an' as an'-1 into the memory. In step C509 the CPU executes the period calculation t2, i.e., the calculation of the time interval between the zero-cross points respectively after the minimum peak values.

When the waveform is rises as shown in FIG. 30(*a*), the routine based on interrupt signal INTa is first executed. When the input waveform falls, the CPU executes the interrupt routine by interrupt INTb.

Thus when the input waveform as shown in FIG. 30(*a*), the CPU judges that the waveform is that of the normal input signal, and starts the sounding of the musical tone at the corresponding note.

When the waveform of string resonance is input as shown in FIG. 30(*b*), interrupt signal INTa (or INTb) is applied to CPU 400. Then, the CPU executes the routine shown in FIG. 31 (or the interrupt routine equivalent to the FIG. 31 routine).

Until the peak value an exceeds the peak value a, step B505 gives the answer of NO at timing (1) of FIG. 9(*b*). Then step B508 is executed.

The interrupt routine at the timing of (2) if executed to give the answer of YES in step B505. Step B506 follows step B505. In this instance, the difference between peak values an-1 and a is not large, and is smaller than "R". Therefore, step B506 gives the answer of NO. In other words, the CPU decides that the input signal waveform is that of the string vibration resonance, and does not set the note-on flag to "1" , viz., does not execute the sounding processing.

The above-mentioned interrupt processing is correspondingly applied to the interrupt processing by the interrupt signal INTb, and the description of it is omitted.

As described above, in the fifth embodiment, the CPU checks if the peak values of the input signal waveform changes greatly or small. Incidentally, when the waveform rises, the peak value increases, but when it falls, the peak value decreases (its absolute value increases). This check is executed in step B506 in FIG. 31. More specifically, the CPU checks if the difference between the peak values previously and this time extracted satisfies a predetermined condition. Therefore, the electronic circuit can completely check if the input signal waveform is due to the resonance of the different string vibrations or the real vibrations by the string picking. This implies that there is no need for some mechanical measure for resonance prevention.

In the above-mentioned embodiment, the difference between the previous and present peak values is used for checking whether the input signal waveform is the resonance waveform or not. Alternatively, their ratio may be used for the same purpose. To this end, step B506' is used in place of step B506, and in this step, CPU 400 checks whether or not an/an-1 is larger than S (S is a large value above 1). If it is met, the CPU judges that the input waveform is the normal waveform. If it is not met, the CPU judges that it is the resonance waveform. In a further alternative, some arithmetic calculation may be used.

In the processing of FIG. 31, step B505 is used for checking if "an" exceeds "a". This step is not essential. In this case, the CPU jumps from step B504 to step B506, and in this step, the CPU checks whether or not the input waveform level exceeds a predetermined level by using the relation of (an−an-1) R.

To stabilize the frequency, in step A507 in FIG. 29, the time count data previously stored and the this-time time count data are averaged and the averaged data is output. Alternatively, when the difference between the previous data and the this time data is great, for example, 20% or more, the previous data is output. The period calculations based on the zero-cross point detection immediately after the maximum and minimum peak points detections, may be selectively performed in a manner that the period calculation (i.e., only t1 is obtained) based on the zero-cross points immediately after the maximum peak points detection is executed for the waveform which rises at the start point, and that (i.e., only t2 is obtained) based on the zero-cross points immediately after the maximum peak points detection is executed for the waveform which falls at the start point.

As described above, the CPU may select an appropriate processing in the step 507 in FIG. 29. It is noted that this selection can be made by some modification of the software, and not modifying the external circuit of the CPU. In this respect, the musical instrument of this embodiment is flexibly adaptable for many different situations.

It should be understood that any suitable measure may be employed for the pitch extraction. In the above-mentioned embodiment, either of the two time intervals (t1) and (t2) is used for the pitch extraction. As recalled, the time interval (t1) is between the zero-cross points first appearing after the maximum peak values of the input waveform. The time interval (t2) is between the zero-cross points first appearing after the minimum peak values of the input waveform. Another possible pitch extraction is to compare the time interval (T1) between two adjacent maximum peak values of the input waveform with the time interval (T2) between two adjacent minimum peak points. A further possible pitch extraction is to use the time interval between the two adjacent zero-cross points. An additional pitch extraction is to use one auto-correlation function or other suitable function of the period calculation.

Before start of the sounding, at least one period waveform is needed for pitch extraction. Therefore, the following is possible: the musical tone at the note as given by one string picked in one string mode, is first generated, and the frequency of the output sound is variably controlled after the pitch extraction.

While in the above-mentioned embodiment, the present invention is applied to an electronic guitar, it can be applied to any other systems of the type in which pitches are extracted from a sound signal or an electrical vibration as input from a microphone, for example, and an acoustic signal, which is different from the original signal, is generated at the pitches or note frequencies corresponding to those of the original signal. Specific examples of such are electronic pianos with key boards, electronic wind instruments, electronic string instruments such as electronic violins and koto (Japanese string instrument).

As described above, at the start of inputting a musical tone signal, the CPU checks if the peak values of the input signal waveform changes gently or steeply. On the basis of the check result, the CPU further checks if the input waveform variation is caused by the resonance of the vibrations of different strings or by the vibration of one string as picked. The musical tone sounding is allowed only when the input waveform is that of the real vibration. Therefore, inexpensive and high accuracy electronic musical instruments can be provided, with natural feeling of sounding.

SIXTH EMBODIMENT

1. General

A sixth embodiment of an electronic guitar according to the present invention will be described referring to FIGS. 32 to 38. This embodiment is proposed with the intention to improve of an accuracy of pitch extraction.

When the input signal waveform rises, it is necessary to quickly extract the pitches of the waveform, and to send a sounding start command based on the extracted pitch to the sound source circuit. Generally, when the sound is generated, various kinds of waveforms appear. If the fundamental wave component is obtained from the generated sound by using a low-pass filter, it is very difficult to determine the measuring points for pitch extraction, with the influence by the characteristics of the filter.

Figure 32:
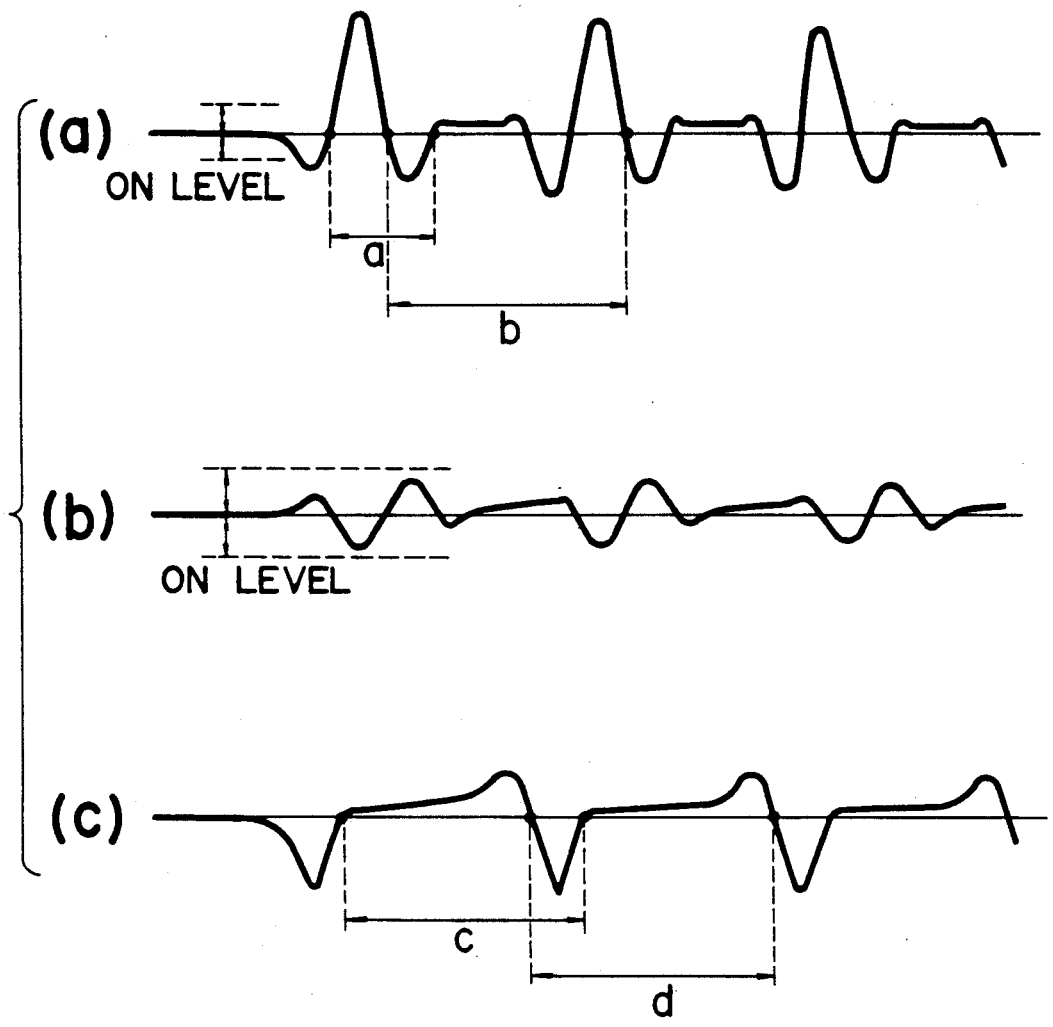
FIG. 32 typical waveforms to which the musical instrument according to a sixth embodiment is applicable with the improved response.

Some examples of the output waveform of the low-pass filter are illustrated in FIG. 32. The waveform as shown in FIG. 32(*a*) frequently appears when a string is picked. If the pitch of that waveform is determined by the time intervals between the zero-cross pons after the maximum and minimum peak points, the controller of the musical instrument may frequently treat the time interval of (a) as one period. The true one period, in this case, is the interval of (b). Thus, if the response is quickened at the start of sounding, the musical instrument is mistakenly operated.

A possible measure taken for overcoming this problem is to use a large threshold level (corresponding to the ON level in the figure), which is for checking whether or not the waveform as shown in FIG. 32(*a*) is caused by the vibration of a string, and not to detect the waveform levels below the threshold level. When a weak waveform as shown in FIG. 32(*b*) comes in, however, this measure considers that no string vibration is produced. In this case, of course, no sound is produced from the sound source circuit and it is extremely unnatural when hearing the sound from the guitar.

The period measurement starts when both the positive and negative peak points appear as shown in FIG. 32(*c*). In the case of the input waveform of (c), the period of (c) is not measured, but the period of (d) is measured. This indicates that the sounding start timing is slightly delayed.

This embodiment is directed to solve the problem of the sounding start timing delay.

To solve this problem, the maximum and minimum peaks immediately after the waveform rises are compared. A time interval is detected, and used as the period of the musical tone waveform. The time interval is the point relating to the larger peak point is used as the sounding start point. The peak point, which is similarly detected and exists in the same domain as that of the larger peak point, is used as the end of the time interval. A controller directs the start of sounding the musical tone at the frequency as defined by the detected period.

The point relating to the maximum and minimum peak points may be the zero-cross point immediately after or before the maximum or minimum peak point, or may be the maximum or minimum peak point per se.

2. Description of Arrangement and Operation

1) Arrangement

Figure 33:
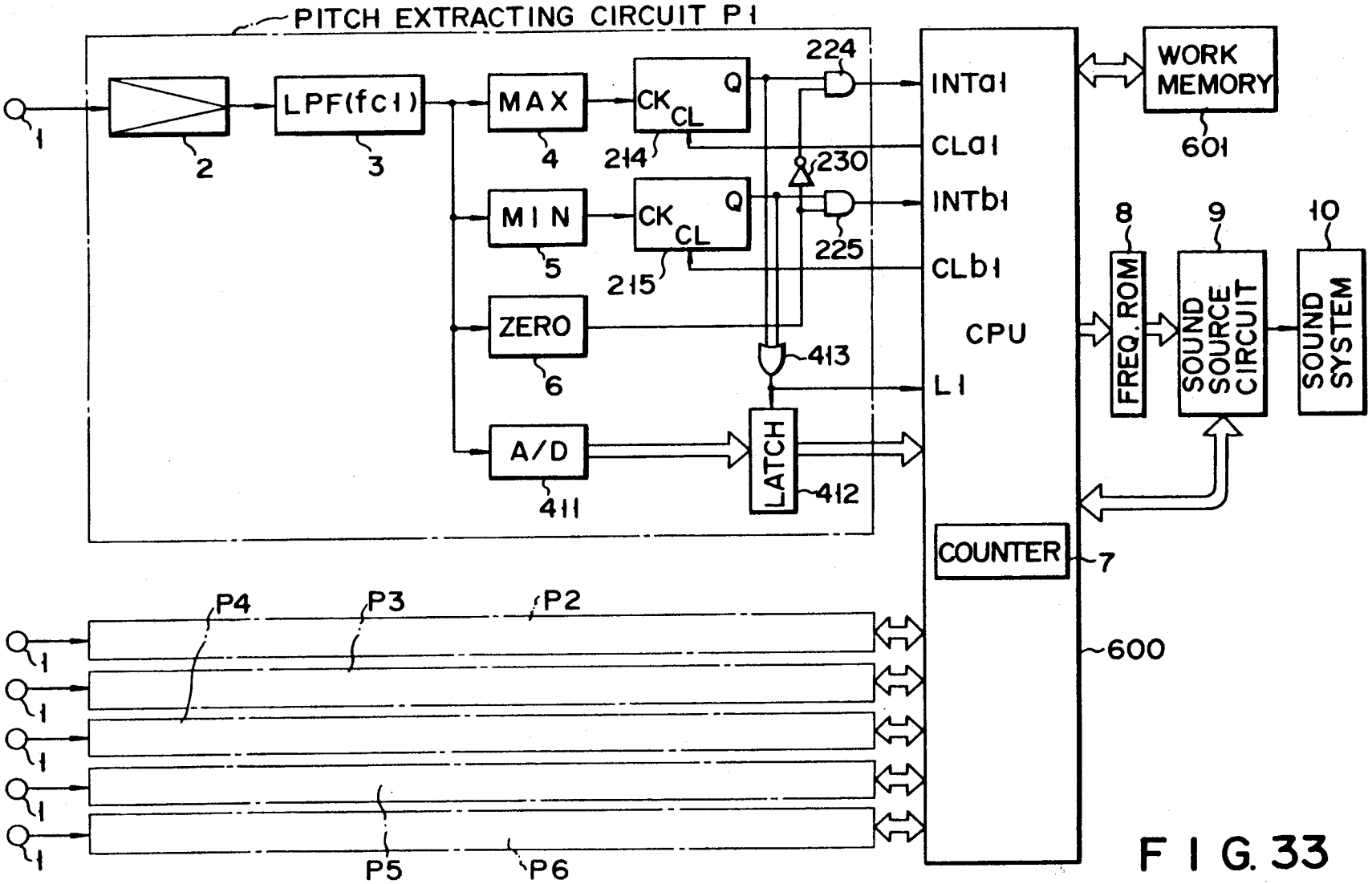
FIG. 33 shows a circuit arrangement of the sixth embodiment of a musical instrument according to this invention.

A circuit arrangement of the sixth embodiment according to the present invention is illustrated in FIG. 33. This arrangement is substantially the same as that of the embodiment thus far described, except some portions. Only the difference will be described, with the designation of like reference symbols for like portions.

CPU 600 receives interrupt signals INTan and INTbn (n is any of 1 to 6) from pitch extraction circuits P1 to P6, and cooperates with work memory 601 to work out the period data.

2) Operation

Figure 34:
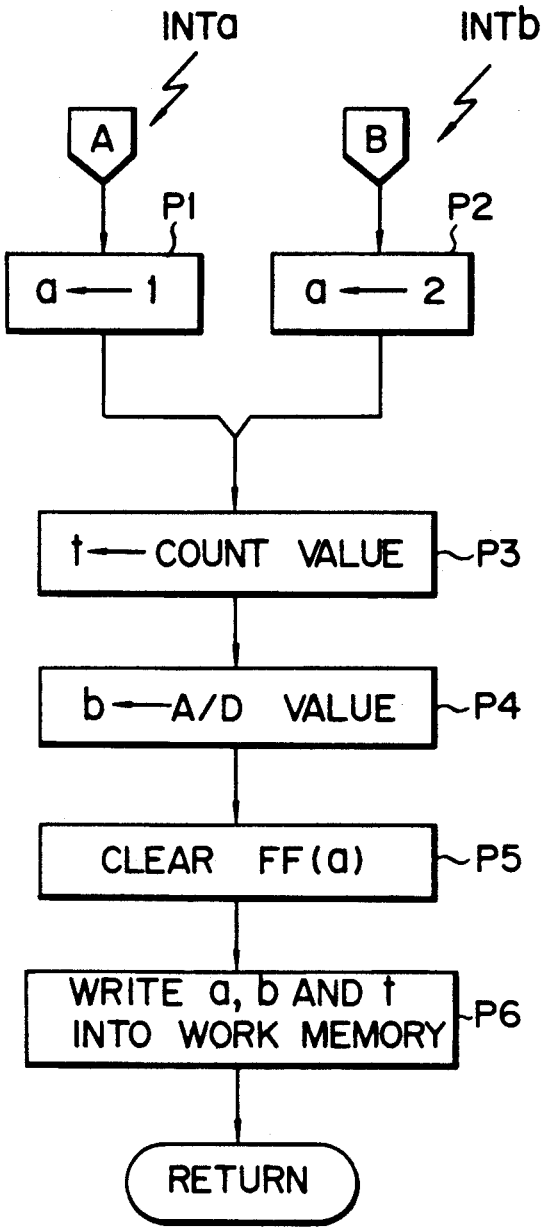
FIG. 34 shows a flowchart of an interrupt routine executed by the CPU in the sixth embodiment.
Figure 35A:
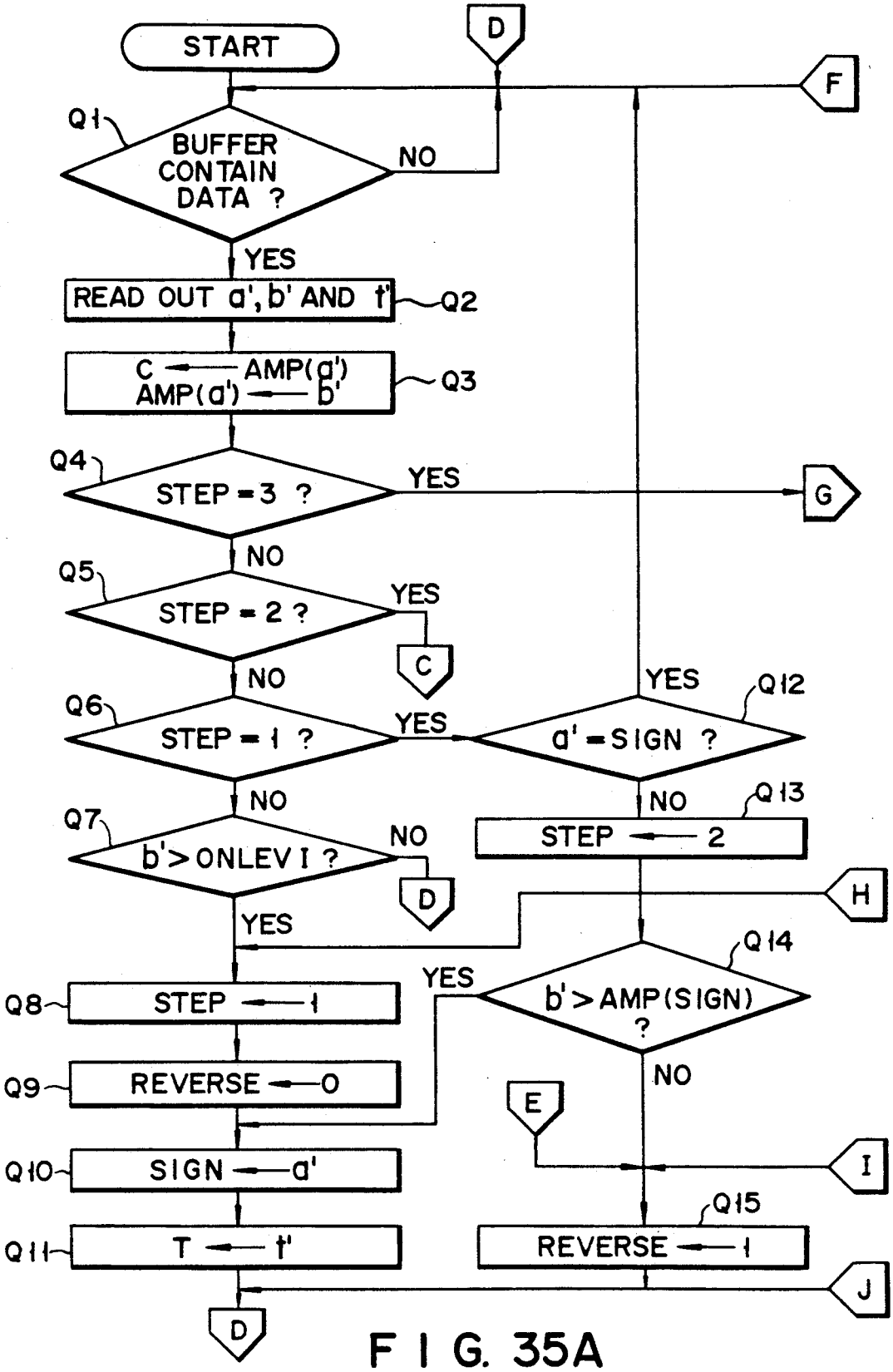
FIGS. 35A and 35B show a flowchart of a main routine of the CPU in the sixth embodiment.
Figure 35B:
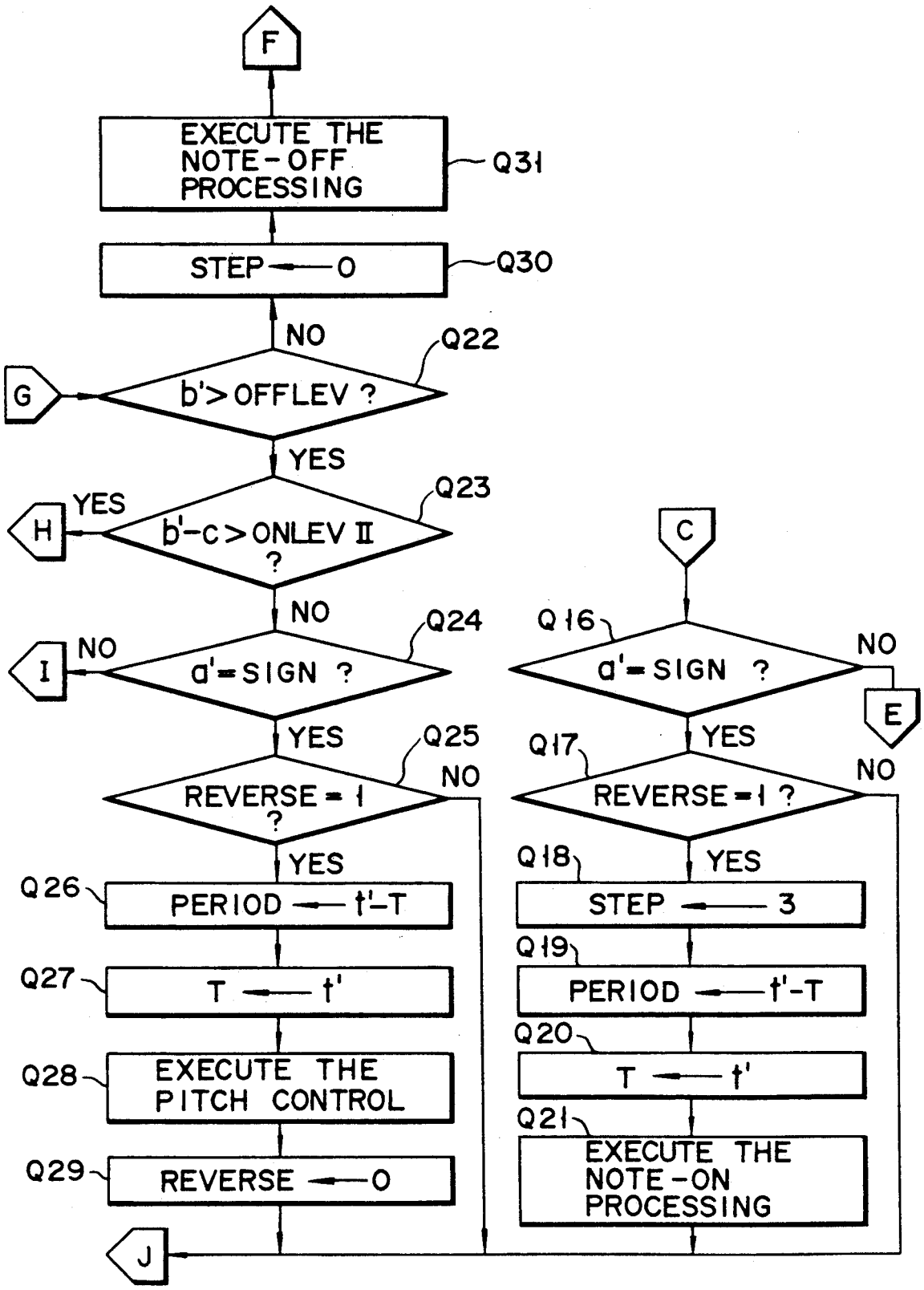

A interrupt routine, which is applied for CPU 600, and a main routine are illustrated in FIGS. 34, 35A and 35B. Although these routines are for only one string operation, the same processings are correspondingly applied for other five string operations. In processing these six string operations, CPU 600 executes the processings for six strings in a time divisional manner.

Figure 36:
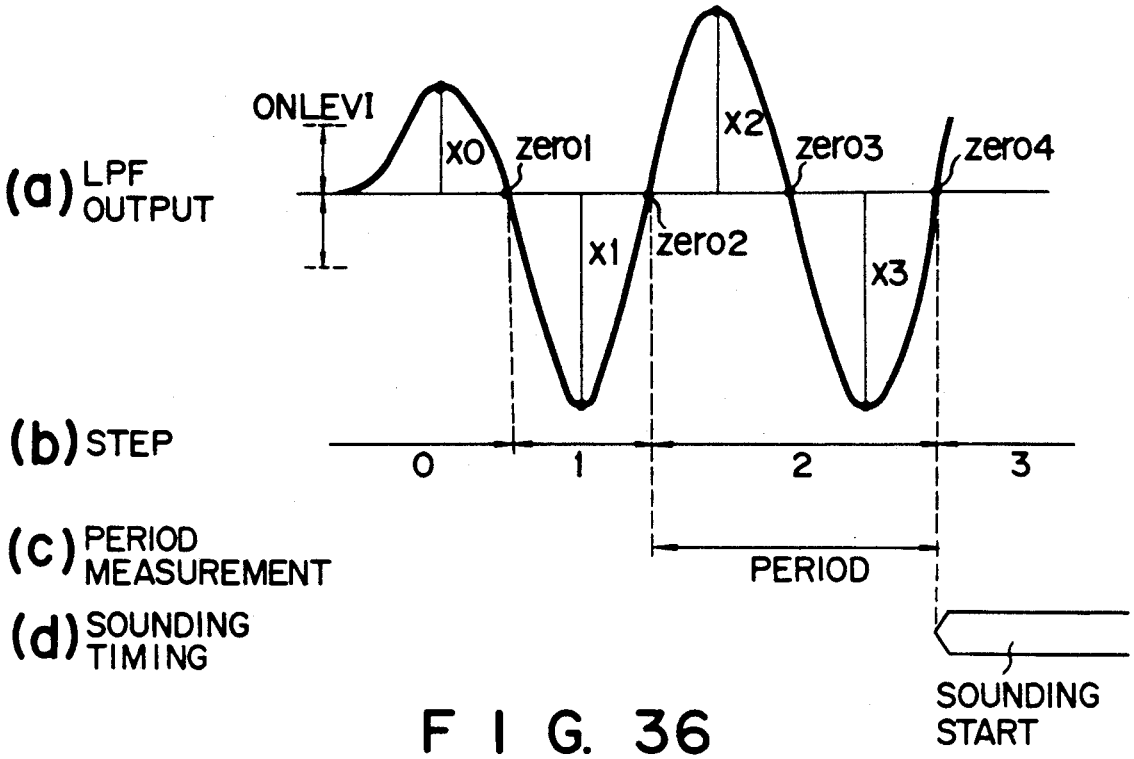
FIG. 36 shows a timing chart useful in explaining the operation for sounding start when the musical instrument of the sixth embodiment receives a waveform of an input signal.

Before proceeding with the detailed description of the CPU operation, main registers in work memory 601 will first be described. A STEP register contains four stages 0, 1, 2, and 3. The contents of the STEP register progressively change, as shown in FIG. 36(*b*) or FIG. 37(*b*), as the string is picked and vibrates (FIG. 36(*a*) or FIG. 37(*a*)). The contents 0 of this register represents the note-off state.

A SIGN register is use for indicating that the zero-cross point for period measurement is after the maximum peak point or the minimum peak point. The contents 1 of the register indicates that the zero-cross point after the maximum peak point, and the contents 2 of the register indicates the zero-cross point after the minimum peak point.

A REVERSE register stores the data to check whether the interrupt processing has been made, which is executed at the arrival of the zero-cross point after the peak point which has a reverse polarity with respect to the peak point at which to the zero-cross point is given by the SIGN register.

A T register stores the count of counter 7 at a specific point to measure the period of the input waveform. Count 7 free runs responsive to a given clock signal.

An AMP (i) register stores the maximum or minimum peak value, more exactly, its absolute value, which is applied from A/D converter 11 and latched in latch 12. An AMP (1) register stores the maximum peak value, and an AMP (2) is for minimum peak value storage.

A PERIOD register stores the data of measured. On the basis of the contents of this register, CPU 600 executes the frequency control against frequency ROM 8 and sound source circuit 9.

As will be described later, for various types of judgement, three constants (threshold levels) are contained in CPU 600. The first constants is ONLEVI. As shown in FIG. 36(*a*) and FIG. 37(*a*), the system is in the note-off mode. In this mode, when a peak level larger than ONLEVI, the CPU considers that a string has been picked, and starts the period measurement.

ONLEVII is used in such a way that in the note-on mode, when the difference between the previous and this-time detection levels is above the level of ONLEVEII, the CPU executes the relative-on processing even if the tremolo, for example, is used.

Figure 38:
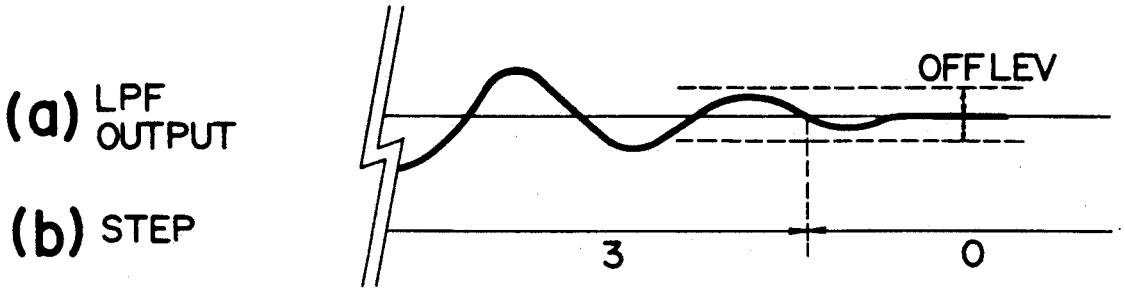
FIG. 38 shows a timing chart useful in explaining the operation for muting when the musical instrument of the sixth embodiment receives a waveform of an input signal.

OFFLEV is used in such a manner that in the note-on mode, if the peak value detected is below this level of OFFLEV, the note-off processing is executed (FIG. 38).

A main routine and interrupt routines, which are used in the sixth embodiment, will be described. The preparatory knowledge as mentioned above will assist you in understanding the routine description to follow.

CPU 600 receives the output signal of AND gate 224 or 225 as interrupt signal INTa or INTb, and executes the interrupt processing shown in FIG. 34.

When receiving interrupt signal INTa, the CPU executes step P1 and sets the a-register to "1". When receiving interrupt signal INTb, the CPU executes step P2 and sets the same resistor to "2".

In step P3, CPU 600 presets the count of counter 7 into the t-register in the CPU. In the next step P4, the CPU fetches the peak level data in A/D converter 411, and sets that data into the b-register of CPU 600. In step P5, CPU 600 clears FF 214 or 215. In step P6, CPU 600 transfers the contents of the a-, b-, and c-registers to work memory 601 for storage. At this point, the interrupt processing is completed.

In step Q1 of the main routine (FIGS. 35A and 35B), CPU 600 judges whether or not the contents of the a'-, b'-, and c'-registers have been stored into work memory 601, through the interrupt processing. Primed characters a', b' and c' corresponds to a, b and c above, and indicate that these items of data have previously stored, respectively. If no interrupt processing has been executed, the answer to step Q1 is NO, and CPU 600 repeats the execution of step Q1.

If the answer is YES, the CPU advances to step Q2. In this step, the CPU reads out the registered contents a', b' and t'. Then, the CPU goes to step Q3, and reads out the peak value at the peak point of the same type (maximum or minimum) which has been stored in AMP (a') register. The CPU sets the peak value b' extracted this time into AMP (a') register.

In step Q4 to Q6 the CPU checks if the contents of STEP register is 3, 2 or 1. When the system of the electronic guitar under discussion is in the initial condition, the STEP register is 0, and therefore the answer to steps Q4, Q5 and Q6 is NO. In step Q7, the CPU checks if the peak value b' detected this time is above or below the level of ONLEVI.

If the peak value b' is below ONLEVI, the sounding start processing is not executed and the CPU returns to step Q1. If it is above ONLEVI, step Q7 gives the answer of YES and the CPU advances to step Q8.

In step Q8, the CPU sets "1" to the STEP register. In the next step Q9, the CPU sets "0" to the REVERSE register. In step Q10, the CPU inputs the value of a' into the SIGN register. The value of a' is "1" at the zero-cross point immediately after the maximum peak point, and is "2" at the zero-cross point immediately after the minimum peak point.

In step Q11, the value of t' is set in the T register. As the result of it, the value of a' is set in the SIGN register, that of b' in the AMP register, and that of t' in the T register. In this instance, the value of the SIGN register is "1" (FIG. 36(*a*) and FIG. 37(*a*)). Then, the CPU returns to step Q1 again.

Figure 37:
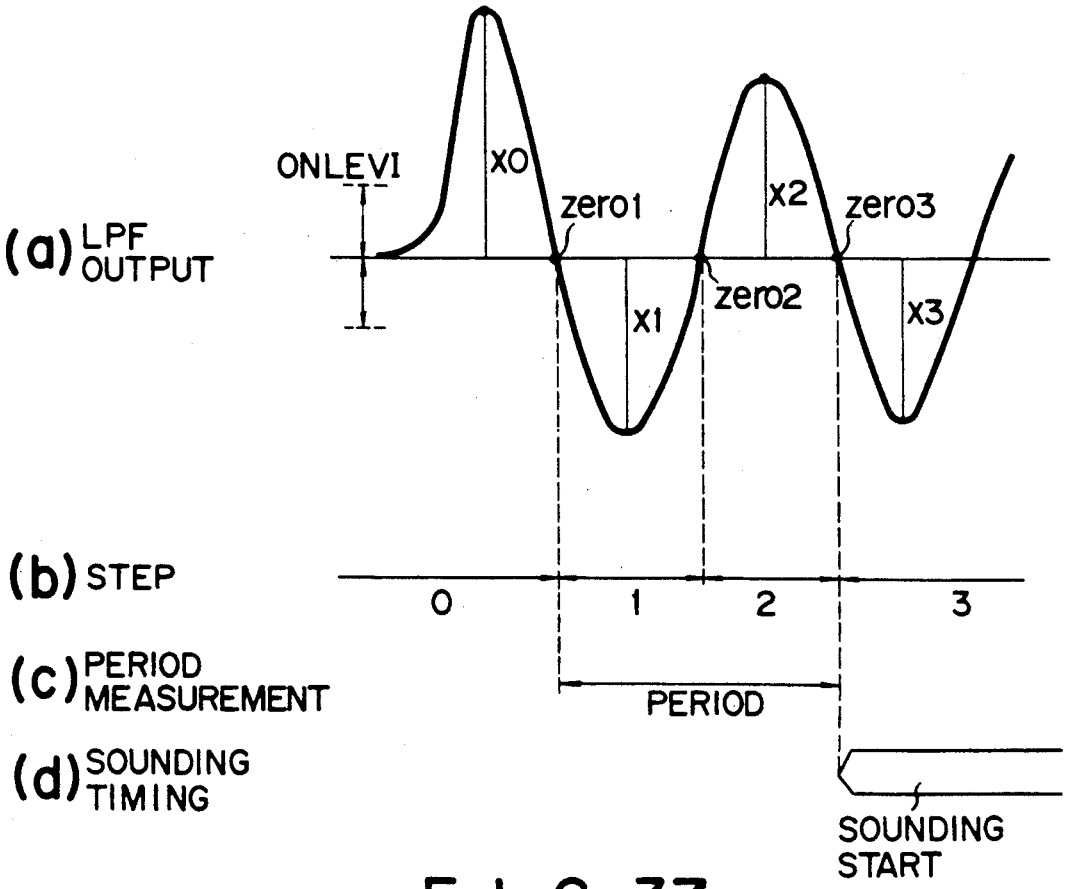
FIG. 37 shows a timing chart useful in explaining the operation for sounding start when the musical instrument of the sixth embodiment receives another waveform of an input signal.

The processing of the main routine immediately after zero-cross point Zero 1 in FIG. 36(*a*) and FIG. 37(*a*) is completed through the execution of the sequence of processing steps as explained above.

The main routine immediately after the zero-cross point Zero 2 will be described. In this processing, steps Q1, Q2, Q3, Q4, Q5 and Q6 will be executed. If the answer YES is given in step Q6, the CPU advances to step Q12.

When the input waveform rises at the time of waveform inputting as shown in FIG. 36(*a*) and FIG. 37(*a*), the SIGN register is "1". Since the present wave of the waveform has passed the negative peak, the register is "2" and NO is given. When the zero-cross point immediately after the peak point with the same polarity is reached, this step gives YES. The CPU does not execute any further processing and returns to step Q1.

In step Q12, NO is given, and after that, the CPU advances to Q13 and sets 2 in the STEP register (see FIG. 36(*b*) and FIG. 37(*b*)).

Following step Q13, the CPU executes step Q14 and compares the previous peak point (AMP (SIGN)) with the present peak point (b'). If the previous value X0 is smaller than the present value (X1>X0) as shown in FIG. 36(*a*), YES will be given. To set up the period measuring start point at time point t' (FIG. 36(*c*)), the CPU jumps from step Q14 to steps Q10 and Q11, to set 2 in the SIGN register and at the same time to transfer the contents of the t'-register to the T register.

On the contrary, if the previous peak point is above the present peak point, X1<X0, as shown in FIG. 37(*a*), NO is given in step Q14 and 1 is set in the REVERSE register in step Q15. In this case, the previous point 1 is maintained in the SIGN register. As the result of it, the previous zero-cross point Zero 1 is the period measuring start point, in this case (see FIG. 37(*c*)).

When the CPU executes the main flow after the next zero-cross point (Zero 3) is passed, the CPU advances to step Q16 after YES is given in step Q5. The present value of a' is 1, that of the SIGN register is 2 as shown in FIG. 36, and that of the SIGN register is 1 as shown in FIG. 37. Therefore, in the case of FIG. 36, NO is given in step Q16 and the CPU advances to Q15 and returns to Q1. In other words, CPU 600 recognizes that the first peak point (amplitude X2) is passed after the period measurement starts.

In FIG. 37, the CPU has the answer of YES in step Q16 and advances to step Q17 to check if the value of the REVERSE register is 1. If the value of the REVERSE register is not 1, the CPU judges NO and returns to step Q1. As mentioned above, after execution of step Q15, the value of this register is 1. Then, the CPU advances to step Q17 and Q18, and inputs 3 in the STEP register (see FIG. 37). In step 19, the CPU subtracts the value of the T register, i.e. the time of the zero-cross point Zero 1, from the value of the counter 7 given by the this-time interrupt processing, and the CPU loads it in the PERIOD register.

The time length PERIOD shown in FIG. 37(*c*) is that of one period. In step Q20, the CPU transfers the contents of t' to the T register, and starts the new period measurement.

In step Q12, CPU 600 issues a sounding start (note-on) command to frequency ROM 8 and sound source circuit 9 in accordance with the contents of the PERIOD register. At this time, the sounding starts.

In the case of FIG. 36, the main flow after the next zero-cross point Zero 4 is executed again, and the CPU jumps from step Q5 to Q16. Since the value of the SIGN register is now 2, YES is given in step Q16. Subsequently, steps Q17 to Q21 are executed. At this time, CPU 600 recognizes the time interval from zero-cross points Zero 2 to Zero 4 shown in FIG. 36(*c*), as one period. The guitar starts the sounding of the musical tone at the frequency as defined by the time length recognized (see FIG. 36).

Thus, the period measurement is executed from the next zero-cross point after the peak point whose value is big the period measurement is completed at the next zero-cross point located in the same side as the previous peak point. As the result of it, the period of low-pass filter 3 output waveform is extracted.

After the sounding start processing, the CPU advances from step Q4 to step Q22 in the main routine processing, and checks if the value of the present peak point b' is above OFFLEV as shown in FIG. 38.

If now that value is above this level, the CPU advances to step Q23, and judge whether or not the relative-on processing should be executed. In other words, the CPU checks if the value of the present peak point (b') is above that of the previous peak point by ONLEVII, i.e. checks if the value of the extracted peak point rapidly increases during sounding.

When a string is picked, the vibration of the string gradually damps toward zero. NO is given in step Q23. In case that before the vibration of the string previously picked damps to zero, another string is picked by the tremolo playing, for example, the answer to step Q23 is often YES.

In this case, the CPU jumps to step Q8 after judging YES in Q23, and then executes step Q9 to step Q11. As a result, the CPU sets "1" in the STEP register, and subsequently executes the same processing as that of the sounding start. In other words, after loading "1" in the STEP register, the CPU executes step Q16 to step Q21 again, and executes the relative-on processing.

In the normal picking, the CPU executes step Q23 followed by step Q24, and compares the contents of a'-register with those of the SIGN register. If these do not coincide, the CPU advances to step Q15 for the interrupt processing at the next zero-cross point. If these coincide, the CPU proceeds to step Q2 because the present wave of the waveform has the peaks with the opposite polarities (positive and negative peaks) in the past. Then the CPU judges whether or not the value of the REVERSE register is "1". If the result is NO, it returns directly to step Q1. If YES is given, the CPU advances from step Q25 to step Q26. Then the contents of the T register is subtracted from those of the t' register for obtaining a new period, and the result is set in the PERIOD register.

In step Q27, the contents of t' register are transferred to the T register. Subsequently, on the basis of the value of the PERIOD register obtained in step Q28, CPU 100 executes the frequency control for frequency ROM8 and sound source circuit 9.

Thus, this embodiment discretely picks up a variation of the frequency of string vibration, and controls the frequency according to the picked up discrete data in a real time manner.

The CPU advances from step Q28 to step Q29, and clears the REVERSE register, and finally executes the period measuring.

As described above, when the string vibration damps and the peak value becomes below the level of OFFLEV, the CPU jumps from step Q22 to step Q30 to clear the STEP register. In the next step Q31, the note-off processing is executed, and the CPU gives the note-off command to sound source circuit 9 to stop the sounding of musical tone.

Thus, if the waveform as shown in FIG. 32(*a*) is input, the time length of (b) is measured, and as the measurement terminates, the sounding start processing is executed. Since the on-level may be reduced, the vibration as shown in FIG. 32(*b*) can be detected. In the case of the waveform of FIG. 32(*c*), the sounding starts as soon as the period of (c) or the first wave is measured. Therefore, the sounding can be quickly started, providing a quick response.

In the above-mentioned embodiment, the CPU executes the interrupt processing at the zero-cross point immediately after each peak point followed by the various types of processings such as the sounding start, period calculation, relative-on and note-off. If necessary, these processings can be executed when each peak point is detected or when the zero-cross point immediately before the peak point is detected. Any other suitable measure may be taken for obtaining the reference point.

3 Effects

As described above, the maximum and minimum peak values immediately after the input waveform rises, are compared with each other. A time interval is detected as the period of the waveform. The time interval starts at a point relating to the larger peak point, and terminates at a peak point which is located in the same domain as that of the peak point as detected in a similar way, and satisfies a predetermined condition. The period control is performed by using the detected period. With such a scheme, the exact period measurement can be quickly performed at the start of sounding, with lessened delay when the waveform rises.

SEVENTH EMBODIMENT

1. General

A 7th embodiment of an electronic guitar according to this invention will be described referring to FIGS. 39 through 41. This embodiment proposed is able to extract the pitch of an input signal waveform even it contains much harmonic components as shown in FIG. 39.

Figure 39:
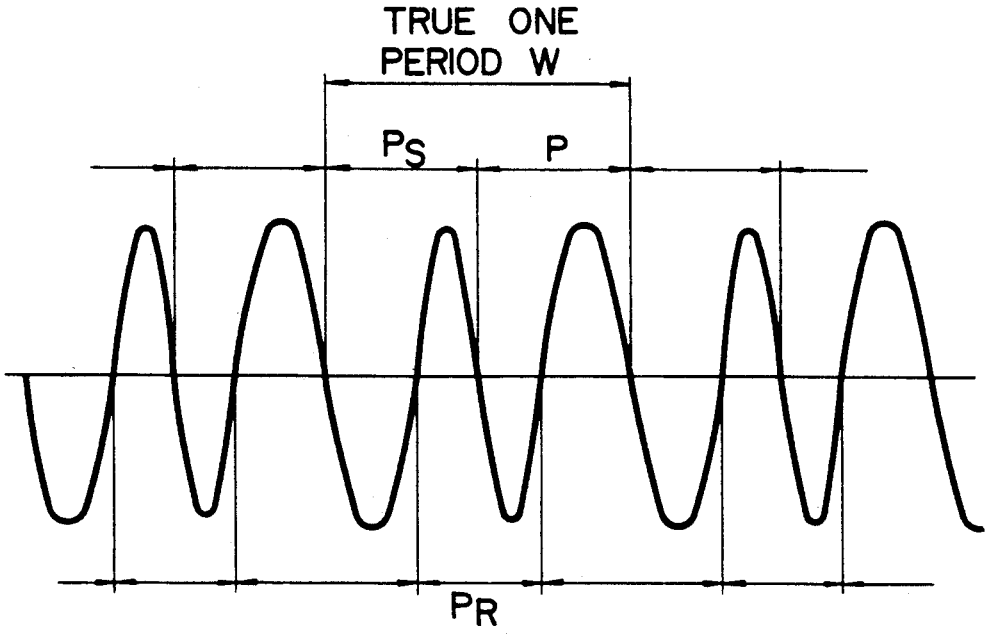
FIG. 39 shows a waveform possibly causing an erroneous in extracting the pitch of an input signal waveform, this erroneous operation problem being solved by a seventh embodiment of the present invention.
Figure 40A:
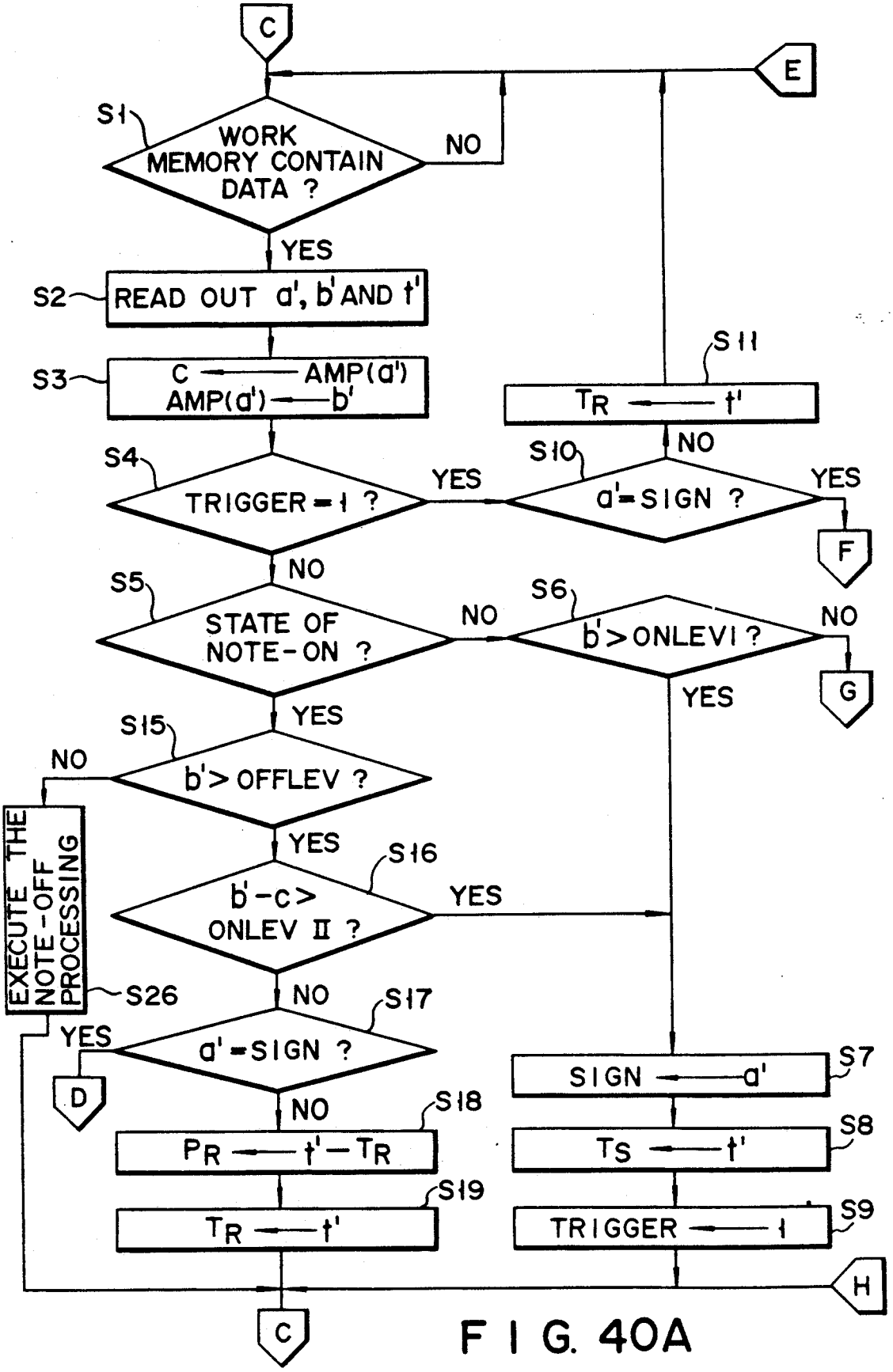
FIGS. 40A and 40B show a main routine executed by the CPU in the seventh embodiment.
Figure 40B:
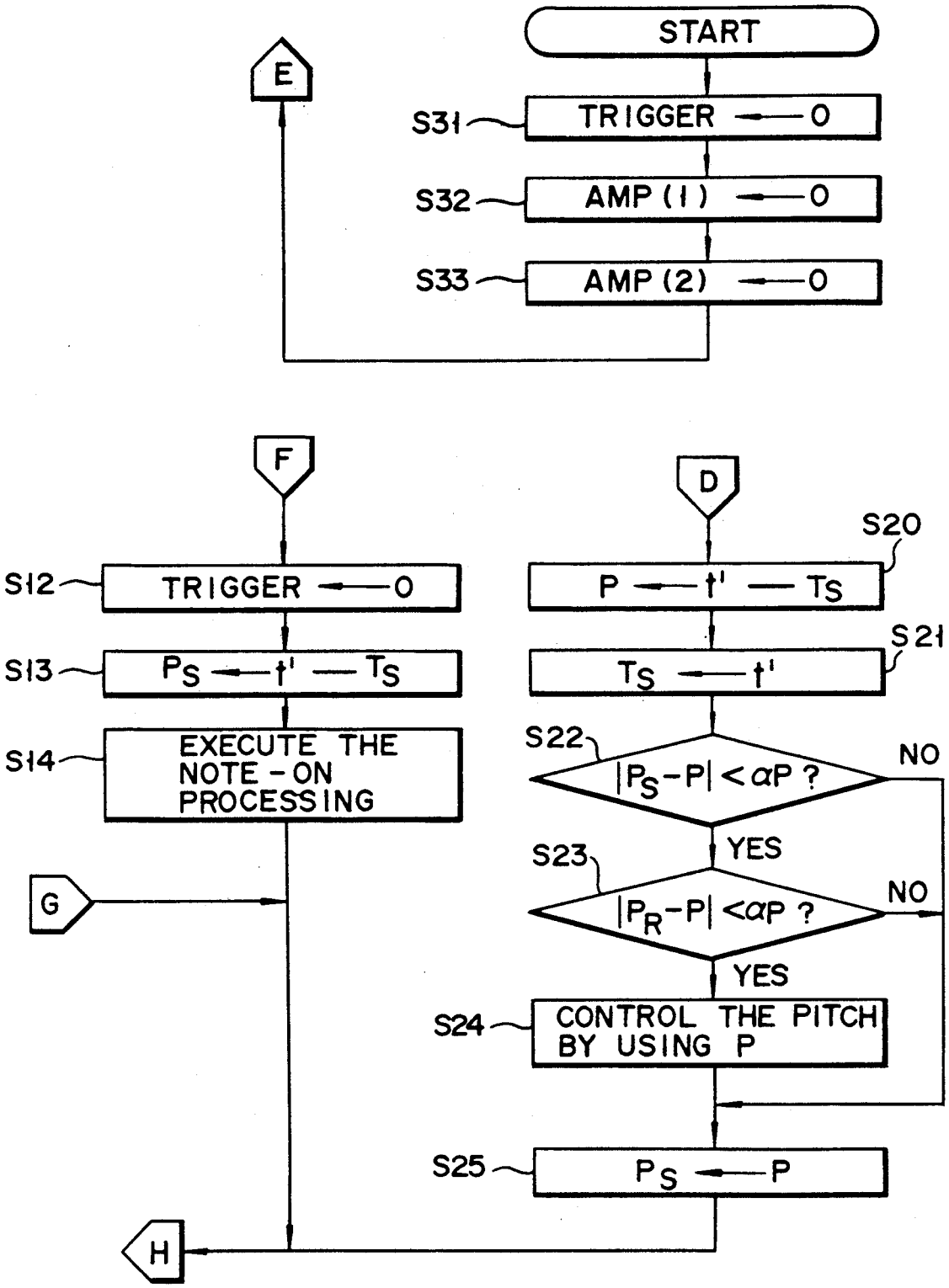

As shown in FIG. 39, the waveform contain much intensive harmonics has many peak points and cross points. If the electronic guitar receives such a waveform, it mistakenly measure one wave length time interval P as intervals PS and PR, which are each different from the true time interval P. The guitar sounds the musical tone at incorrect pitches. This is problematic in the technique disclosed in KOKOKU No. 61-51793. In this technique, when the adjacent waveform periods are substantially equal, the frequency control is executed on the basis of the time length of the period compared.

This embodiment is directed to solve such a problem, and provides an electronic guitar which can exactly extract the pitch of the much harmonic contained waveform and sounds the musical tone at the correct pitch.

To achieve this object, measurement is made of the time length of a first wave of an input waveform which partially overlaps one wave of the same waveform and the time length of a second wave also overlapping the first wave. If the measured time lengths are substantially equal, a control directs the sounding of a musical tone at the frequency as defined by the time length.

2. Description of Arrangement and Operation

1) Arrangement

An arrangement of the seventh embodiment is substantially the same as that of the sixth embodiment (FIG. 33). The interrupt routines INTa and INTb executed by CPU 600 are the same as those in the sixth embodiment.

2) Operation

The operation of the seventh embodiment will be given placing an emphasis on the main routine.

Before proceeding with the detailed description of the CPU operation, main registers in work memory 601 will first be described.

PS, PR and P registers store respectively the measuring time of one period PS, the measuring time of one period PR partially overlapping the period PS, and the measuring time of one period P partially overlapping the period PR. When these three pitch data PS, PR and P are substantially coincident, CPU 600 executes the frequency control for frequency ROM 8 and sound source circuit 9 on the basis of the last pitch data P. This will be described in detail later. At other time than the sounding start time, every one period, the pitch data of the P register is transferred intactly to the PS register. In the subsequent description, PS, PR and P will be referred to the first, second and third periods, respectively.

The TS register stores the count of counter 7 at the start of the period P. The TR register stores the count of counter 7 at the start of the PR period. These registers are used to obtain the respective pitch data. The counter 7 free runs to count at a given clock signal.

Figure 41:
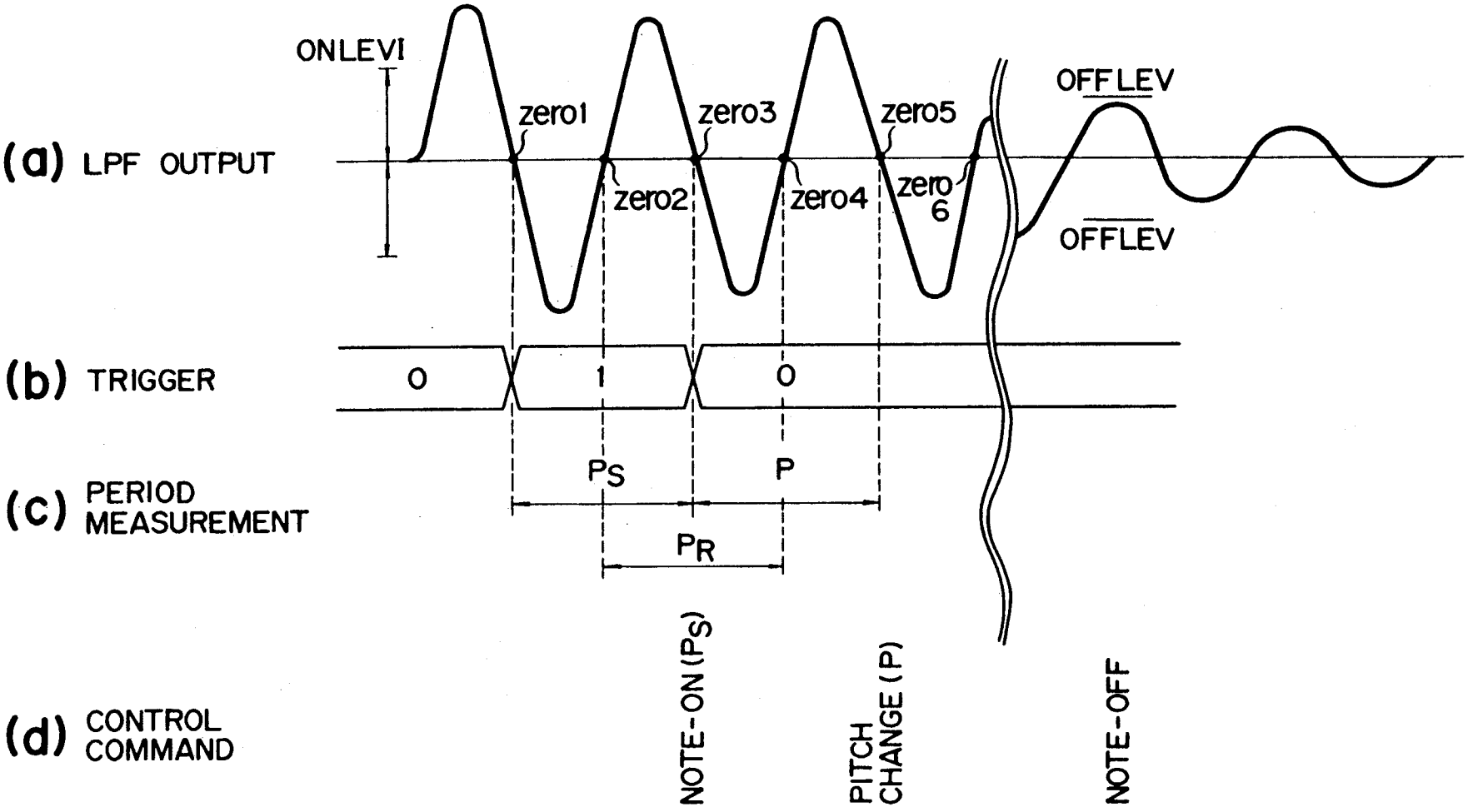
FIG. 41 shows a timing chart for explaining the operation of seventh embodiment.

A TRIGGER register is set to "1" during one period just before the sounding starts, as shown in FIG. 41. In other periods than this, this register has "0" and stores the data indicating "preparatory processing for sounding start being progressed".

A SIGN register is used to indicate that the zero-cross point for period measurement is located after the maximum peak point or the minimum peak point. The 1 of the register indicates that the zero-cross point after the maximum peak point, and the 2 of the register indicates the zero-cross point after the minimum peak point.

An AMP (i) register stores the maximum or minimum peak value, more exactly, its absolute value, which is applied from A/D converter 11 and latched in latch 412. An AMP (1) register stores the maximum peak value, and an AMP (2) register for minimum peak value storage.

Additionally, CPU 600 further contains three threshold levels ONLEVI, ONLEVII and ONLEV.

In main routine (FIGS. 40A and 40B), CPU 600 clears the each register of TRIGGER, AMP(1), and AMP(2) in steps S31 to S33 first. In step S1, the CPU executes the interrupt processing as mentioned above, and judges if the contents of a', b', and t' (corresponding to a, b, and t' and indicate the previous recording) have been saved into work memory 101. If no interrupt processing has been executed, the answer of NO is given, and this step S1 is executed repeatedly.

If step S1 gives YES, the next step S2 is executed to read out the contents a', b' and t'. In the next step S3, CPU 600 reads out the value of peak point of the same type (maximum or minimum from AMP(a') register, and loads it into the s' register in the CPU. Further, the CPU sets the peak value b' now extracted in the AMP(a') register.

In step S4, the CPU if the contents of TRIGGER register is "1" or not. If the system of the electronic guitar is in the initial condition "1" cannot be set in the register, the CPU goes to step S5 where it checks if the note-on condition has been set up or not. In this case, however, the note-on condition has not been set up, and the CPU returns to step S1. If the input signal whose level is larger than ONLEVI comes in, step S6 gives the answer of YES and then step S7 will be executed.

In step S7, the a' value is input to the SIGN register. The value of a' is 1 at the zero-cross point immediately after the maximum peak point, and is 2 at the zero-cross point immediately after the minimum peak point.

In steps S8 and S9, the CPU the value of t' as the count value at the start of the first period PS, into the TS register, and loads "1" into the TRIGGER register. As the result the value of a' is loaded into the SIGN register (in the case of FIG. 41(*a*), this register contains "1"). The value of b' is set in the AMP register, and the value of t' to the TS register. Then the CPU returns to step S1.

The processing of main routine immediately after the zero-cross point Zero 1 (FIG. 41(*a*) is completed at this point.

The processing in the main routine immediately after the zero-cross point Zero 2 will be disturbed. In steps S1 to S3 the data set processing is executed and in step S4 the answer is YES and step S10 is then executed.

When the waveform goes positively at the time of waveform inputting, as shown in FIG. 41(*a*), the SIGN register contains "1". The present waveform having the negative peak in the past and therefore the a'-register contains "2". And this condition, NO is given and step S11 is executed. In this step, the value of t' as the count value at the start of the second period PR is set in the TR register. Then, the CPU returns to step S1.

After the next zero-cross point Zero 3, if the main routine is executed again, the answer of YES is given in step S4 and then the CPU jumps to step S10. The present value of a' is "1" and SIGN is "1". Therefore step S10 gives the answer YES and step S12 is executed to clear the TRIGGER register. In the succeeding step S13, the value of the TS register, i.e., the time at zero-cross point Zero 1 is subtracted from the count of counter 7 which is accepted in this-time interruption and is contained in the t'-register. The result of subtraction is loaded into the PS register.

In this way the pitch data of the first period PS whose length is PS shown in FIG. 41(*c*) is obtained.

In step S14, as shown in FIG. 41(*d*), CPU 600 gives a note-on command to the frequency ROM 8 and sound source circuit 9, according to the contents of the PS register. And the sounding starts at this time point. Alternatively, the musical tone as given by the open string in place of the contents of the PS register may be generated.

In the main routine processing immediately after the next zero-cross point Zero 4, the note-on mode is set up. The CPU cause from step S5 to step S15 and checks if the value of b' as the peak value fetched just now is above the OFFLEV level. If it is above the OFFLEV the CPU checks if the relative-on processing is executed. More specifically, the CPU checks if the this-time peak value b' is by ONLEVII larger than the previous peak value "c", that is to say, checks if the extracted peak value abruptly increases during the sounding.

When the string is picked, the string gradually damps toward zero. The answer of this step S16 is NO. In case where before the vibration of a string is damped to zero, the string is picked again, by the tremolo playing, the answer of step S16 may be YES, although this is a rare case. In this case step S16 gives YES and flow jumps to step S17 and steps S8 and S9 are executed consecutively. As a result, "1" is set in the TRIGGER register and exactly the same operation as that at the sounding start will be executed. In other words, steps S12 to S14 are successively executed to effect the relative-on processing.

In a normal condition, step S17 following step S16 is executed to compare the value of a' and the value of the SIGN register. If these are not coincident as in the case of zero-cross points Zero 4, Zero 6, . . . , steps S18 and S19 are executed. In these steps the contents of the TR register is subtracted from the t' register to obtain the second period PR. The PR is set in the PR register, and the value of t' is set in the TS register in order to obtain the pitch data of the next period PR.

At the zero-cross point Zero 5, Zero 7, . . . , whose characteristics are reverse to those of zero-cross points Zero 4 and Zero 6, sequences of steps S1 to S5 and S15 to S17 are executed. In this instance, the contents of the a'-register coincides with the contents of the TS register. Therefore, step S20 is executed. In the step the contents difference between the t'-register and TS register is obtained to have the pitch data of the next third period. The difference is set in the P register. The value t' is set in the TS register in order to obtain the pitch data of the next third period P, in step S21.

Subsequently, in step S22, CPU 600 checks if the data difference between the first and third periods PS and P is within a predetermined error tolerance which is times the third period P ($0<\alpha<0.4$). Further, in step S23 the CP checks if the data difference between the second and third periods PR and P falls within a predetermined error tolerance which is times the third period P ($0<\alpha<0.4$). If these three items of pitch data PS, PR and P are coincident within the tolerance, in step S24 the CPU executes the frequency control (pitch change) for frequency ROM 8 and sound source circuit 9 as shown in FIG. 5(*d*). If these are not coincident with each other, the CPU does not execute the pitch change processing in step S24, and maintains the pitch thus far used.

As described above, by comparing three items of pitch data, exact pitch extraction is performed, with sounding of the musical tone at the correct pitch.

The electronic guitar discretely picks up the frequency variation in the string vibration time to time, and executes the frequency control on the basis of the picked up data in a real time manner.

The CPU goes from step S24 to step S25, and transfers the pitch data of the third period in the P register into the PS register. That pitch data is used as the pitch data of the next new first period.

As described above, the string vibration gradually damps and its level is below the OFFLEV level, the CPU goes from step S15 to step S26, and executes the note-off processing (sounding-off processing), as shown in the right portion of FIG. 41. The CPU gives a note-off command to sound source circuit 9 to stop the sounding.

In this way, the sounding preparation and sounding start processings in the steps S7 to S9, step S11, and steps 12 to S14 are performed at the respective zero-cross points of the first period. At the zero-cross points immediately after the minimum peak points of the respective periods, viz., at the even-numbered zero-cross points of the input waveform of FIG. 41, the pitch change processing is executed in steps S18 and S19. At the zero-cross points immediately after the maximum peak points, viz., at the odd-numbered zero-cross points of the input waveform of FIG. 41, the same processing is executed in steps S20 to S25. Finally, the note-off processing is performed in step S26.

As seen from the description relating to FIG. 39, even if the input waveform contains much harmonics the frequency change processing is not performed unless the periods PS, PR and P are equal to one another. The result reduces the possibility of the erroneous pitch extraction.

In the pitch comparing processing in steps S2 and S23, the comparison of PS and PR is allowed in addition to the comparison of PS and P, PR and P. The essential is to check if these three factors are equal or not. The pitch data used in the pitch changing processing in step S24 following the detection of three factors equality may be the arithmetic mean or the geometrical means PS, PR and P, in addition to the P. Additionally, two or three of these factors are appropriately weighted, and then averaged for that data.

In the above-mentioned embodiment, the sounding of the musical tone is started according to the contents of the PS register, improving the response of the musical instrument system. Alternatively, after detection of the coincidence of these three factors PS, PR and P, the musical tone at the extracted frequency may be sounded.

While in the above-mentioned embodiment, the pitch between the zero-cross points is measured, it is allowed to measure the period between any other suitable points, such as the maximum peak point and zero-cross point, the minimum peak point and zero-cross point, and the maximum and minimum peak points. In such a case, the signal output from maximum or minimum peak detector 4 or 5 is used as the interrupt signal INT, and the same effects can be obtained. Additionally, a similar processing may be executed upon detection of the zero-cross point immediately before the peak point. Any other measure may be used to set up the reference point for pitch extraction.

In the above-mentioned embodiment, the respective processings are executed in the main flow, but these may be executed in the interrupt processings.

While in the above-mentioned embodiment, the present invention is applied for the electronic guitar, it can be applied for any other systems of the type in which pitches are extracted from a sound signal or an electrical vibration as input from a microphone, for example, and an acoustic signal, which is different from the original signal, is generated at the pitches or note frequencies corresponding to those of the original signal. Specific examples of such are electronic pianos with key boards, electronic wind instrument electronic string instruments such as electronic violins and koto (Japanese string instrument).

3. Effects

As seen from the foregoing description, in the seventh embodiment, measurement is made of the time length of a first wave of an input waveform which partially overlaps one wave of the same waveform, and the time length of a second wave also overlapping the first wave. If the measured time lengths are substantially equal, the CPU directs the sounding of a musical tone at the frequency as defined by the time length. Therefore, the system of the electronic guitar, which is best on the three periods comparison, can exactly extract the pitch of the waveform even if it contains much harmonics.

EIGHTH EMBODIMENT

1. General

An eighth embodiment of an electronic guitar according to the present invention will be described with reference to FIGS. 42 through 45.

The eighth embodiment provides the improvements in that when the guitar is played in a tremolo mode, the guitar follows up in operation a rapid variation of the input musical tone waveform due to the tremolo playing and sounds the musical tone with natural feelings.

To realize this, when the input waveform rapidly increases during the sounding of musical tone, the system detects this and gives a relative-on command. Through the relative-on processing, volume and timbre of the musical tone are appropriately adjusted so that the guitar electronic system follows up the actual tremolo playing.

2. Description of Arrangement and Operation

1) Arrangement

An arrangement of the eighth embodiment may be that of each embodiment as mentioned above, for example, that of FIG. 21.

2) Operation

Figure 42:
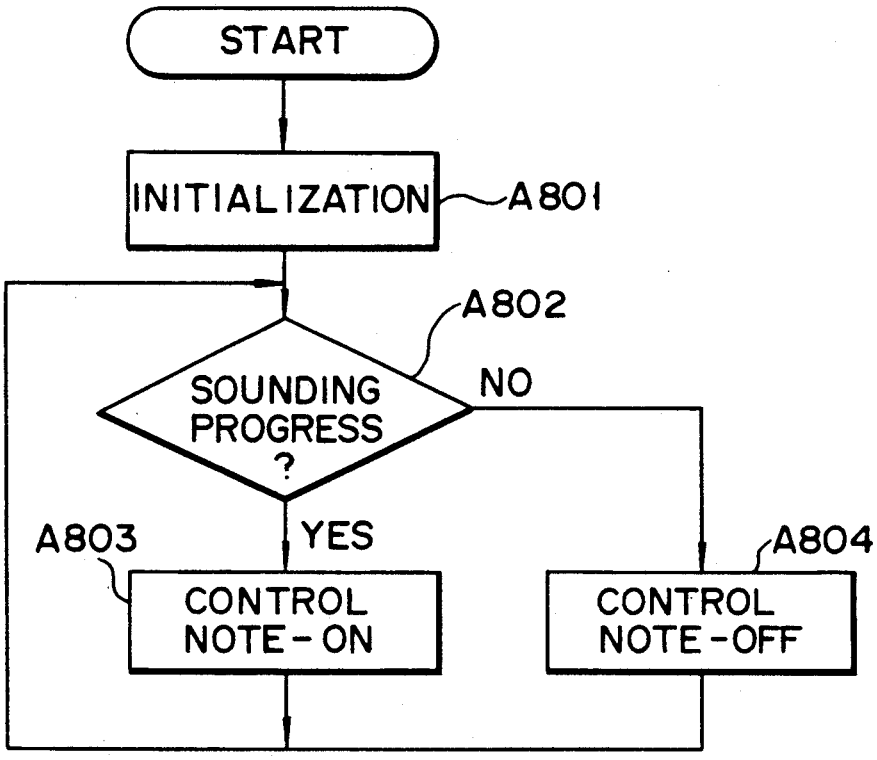
FIG. 42 shows a flowchart of a main routine executed by the CPU in an eighth embodiment.

A main routine of CPU 400 is shown in FIG. 42. This main flow is for only one string processing. The processings of other strings are each substantially equal to the FIG. 42 processing. Therefore, in an actual system, the CPU executes these routines in a time divisional manner. The CPU first executes the initial setting in step A801, and checks if the sounding progressing, in step A802. If the sounding is progresses, the CPU goes step A803 and executes the frequency change processing on the basis of the time interval data tn and Tn, and returns to step A802.

If step A802 gives the answer is NO and goes to step A804. In the step each register is initialized or a necessary command is sent to sound source circuit 9. Following this step, the CPU returns to step A802.

Figures 43A, 43B, 43C, 43D, 43E, 43F, 43G, 43H:
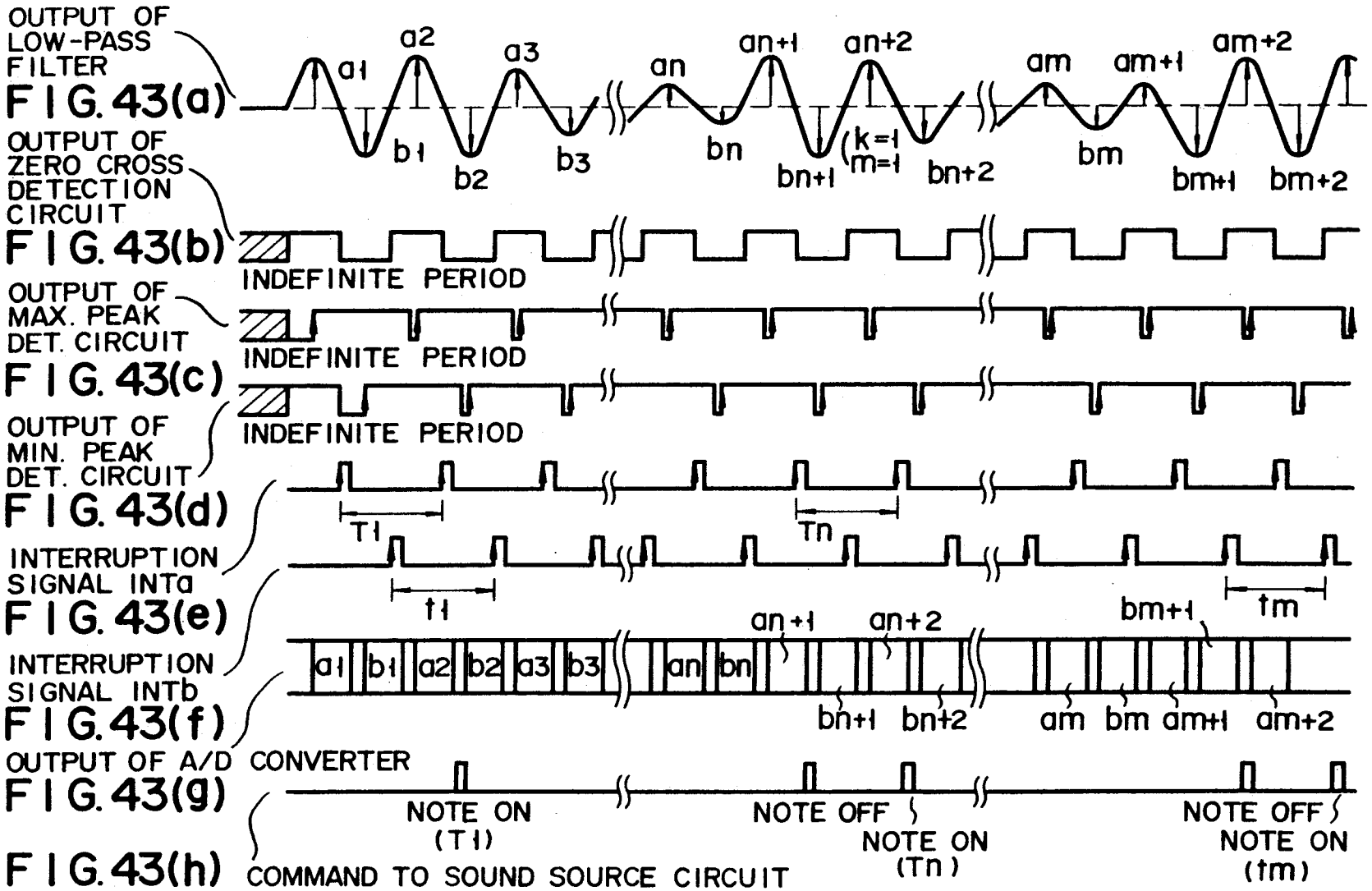
FIG. 43 shows a timing chart for explaining the operation of the eighth embodiment.

The operation of the electronic guitar when a string of the guitar is picked will be described in more detail. When the string is picked and an input signal waveform rises, low-pass filter 3 produces an output signal with a waveform as shown in FIG. 43(*a*). Simultaneously, zero-cross point detector 6, maximum peak detector 4 and minimum peak detector 5 produce respectively output signals, as shown in FIGS. 43(*b*) to 43(*d*). As a result, as shown in FIG. 43(*g*), latch 412 produces the output of A/D converter 411.

Figure 44:
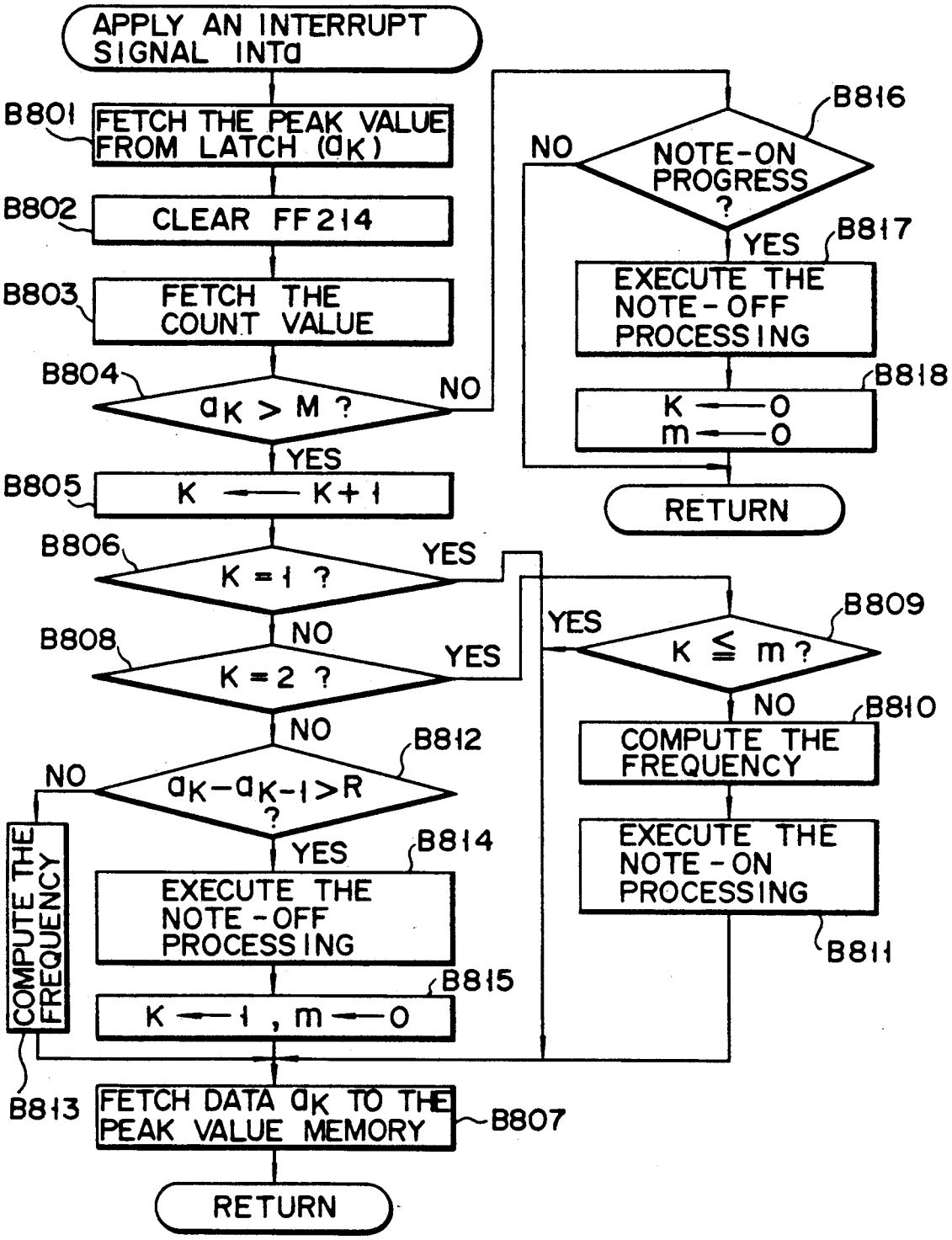
FIG. 44 shows a flowchart of an interrupt routine executed by CPU of the eighth embodiment when the zero-cross point is detected immediately after a maximum or positive peak point is detected.

After the half period of the input waveform, interrupt command signal INTa is first applied to AND gate 224. In turn, the interrupt shown in FIG. 44 is executed.

In step B801, the CPU fetches the maximum peak value from latch 412, and in step 802 sets the peak value in FF 214. For this operation, reference is main to the time chart of interrupt signal INTa shown in FIG. 43(*e*).

At this timing, the CPU saves the count of counter 7 into a predetermined memory area of in-maximum memory 201 in step B803. In step 804 the CPU checks if the peak value ak (at this time it is al), which has fetched in step B801, is larger than the reference value M.

If the peak value al is satisfactorily large, and the answer of YES is given in step B804, the CPU increments the value of "k" in the next step B805. Actually, a memory area to store the value of "k" is contained in the work memory of CPU 400. Since "k" is 0, step B805 sets up k=1.

In the next step B806, CPU 400 checks if k=1. The result of this check is YES and the next step B807 is executed. This step saves the peak value a1 extracted in step B801, into a peak memory (not shown), which is provided in CPU 400. The CPU then returns to the main routine.

Figure 45:
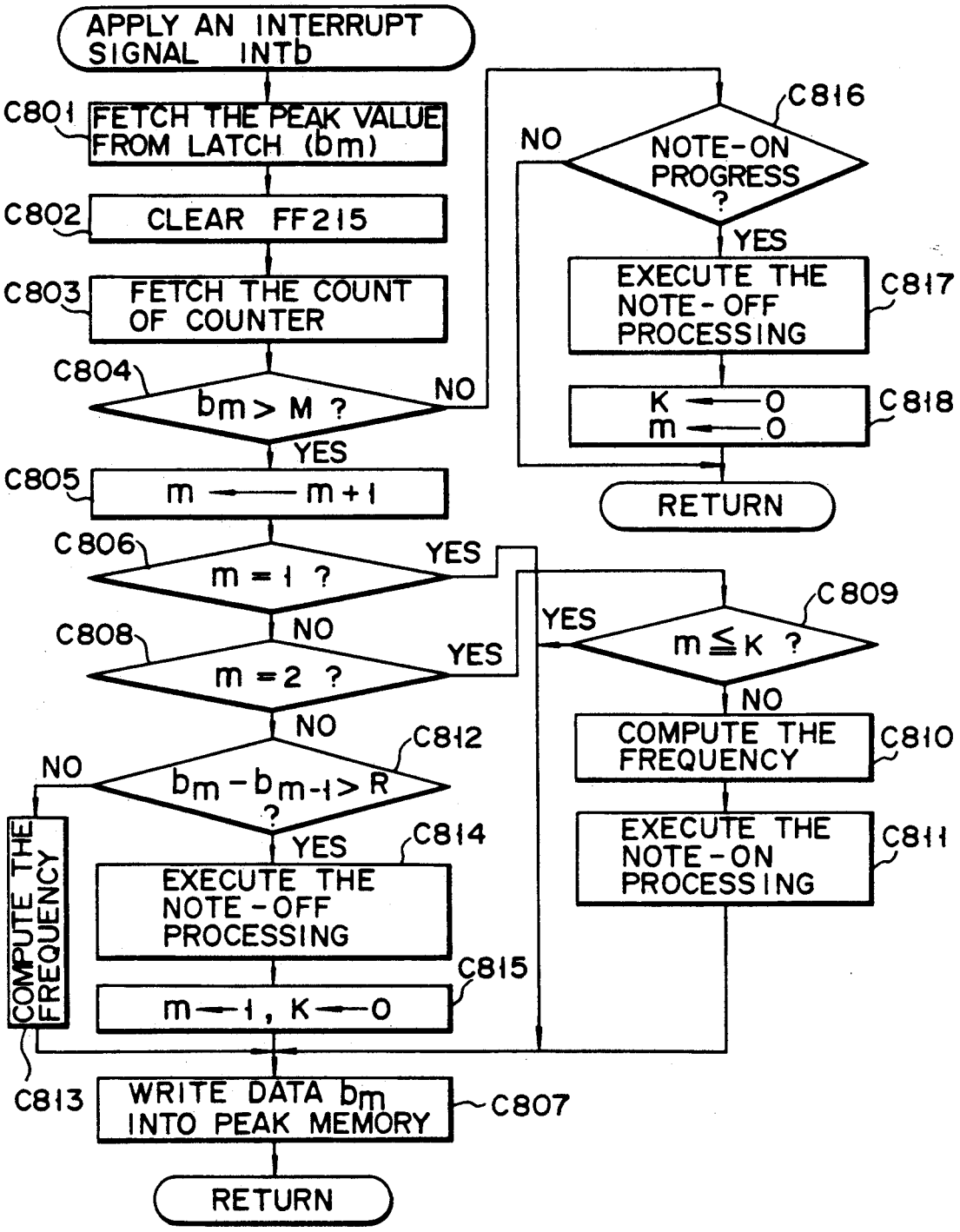
FIG. 45 shows a flowchart of an interrupt routine executed by the CPU of the eighth embodiment immediately when the zero-cross point is detected after a minimum or negative peak point is detected.

After a negative peak point with the peak value b1 is passed, the zero-cross point is detected, interrupt signal INTb is generated as shown in FIG. 43(*f*), and control enters into the interrupt processing of FIG. 45. This processing is almost the same as that of FIG. 44, and hence will be described in brief.

In the first step C801, CPU 400 fetches the peak value b1, clears FF 215 in step C802, and saves the count of counter 7 into in-minimum memory 202 in step C803, and checks if peak value b1 is larger than reference value M, b1>M, in step C804. In this instance, the result of this check is YES, and control goes to step C805 to increment of "m". The result is m=1.

Control goes to step C806, and further to step C807 to write the value of b1 into a predetermined memory area of the peak memory.

Interrupt signal INTa is generated. In response to this signal, the CPU executes the interrupt processing of FIG. 44, again. In step b801, step B801 is executed to fetch the value of a2, and steps B802 to B805 are consecutively executed to set the value of "k" to "2" Then, step B805 is executed. Since k=2, YES is given and control goes to step B809.

This step compares m (now n=1) with k (now k=1). This is made to check if the interrupt command to first be executed is INTa or INTb (see FIGS. 44 and 45). In this case, the processing based on the command INTa (since the input waveform first varies positively or rises) is first processed, as described above. The judgement of this step B809 is not k≦m, but k>m, i.e., NO, and control advances to step B810.

In step B810, subtraction is applied to two time data stored in in-maximum memory 201, to obtain time Tn (now n=1) shown in FIG. 43, and hence the musical tone frequency with the period of T1. Actually, this step seeks the fret used for the picked string. In step B811, CPU 400 directs frequency ROM 8 and sound source circuit 9 to start the sounding of the musical tone with that frequency, and executes the note-on processing. This is illustrated in FIG. 43(*h*). The musical tone is sounded from this point.

The CPU executes step B807 and returns to the main routine.

Upon detection of the zero-cross point immediately after the minimum peak point (peak value b2), the FIG. 45 interrupt processing is executed through a series of steps C801 to C806. m=2 is obtained and control flows to step C809. In this instance, m=k=2, that is, the note-on processing is performed in step B811 as described above, and step C809 gives the decision of YES. Therefore, no note-on processing is performed (steps C810 and C811), and control flows through step C807 to the main routine.

The next interrupt processing INTa is executed. Peak value a3 is fetched (step B803), and control flows through steps B802 to B808. Now k=3, and then control jumps from step B8808 to B812. Step B808 checks if interrupt processing by INTa is executed three times or more.

In step B812, CPU 400 checks the difference between the present peak value ak (now k=3) and the previous peak value ak-1 (now k=2), ka−ak-1, exceeds reference value R. Generally, the string vibration gradually damps if any action is taken. The difference (ak−ak-1) takes a negative value. The answer to step B812 is NO, and control flows to step B813. As described later, when the tremolo playing is made, and ak-1<ak, CPU 400 checks if ak−ak-1>R holds. If it holds, viz., the relative-on must be done, this processing is executed in steps B814 and B815. This will subsequently be described in detail.

In this instance, control flows through step B813 (equivalent to step B810) and B807 and returns to the main routine.

When interrupt processing INTb arrives, the processing about the peak value b3 will be executed in a similar manner. Steps C801 to C806, C808, C812 to C813, and C807 are consecutively executed in this order, to complete this interrupt processing.

In this way, following the note-on processing, the frequency change processing, for example, is appropriately executed in step A803 in a progressive manner.

As shown in FIG. 43(*a*), when the tremolo playing is made, and before the sounding terminates, a string is picked again, the interrupt processing is executed when the zero-cross point following the maximum peak of an-1 is reached, in step B812, the answer of YES is given since an+1−an>R, and control flows step B814. In this step, the CPU gives the note-off command to sound source circuit 9 and abruptly drops the sounding level (FIG. 43(*h*)).

In the next step B815, "k" is set to "1" and "m" is set to "0" for starting the relative-on processing. After executing step B807, the CPU returns to the main flow.

In the next interrupt processing by INTb (for peak value bn+1), step C805 sets up m=1, and control flows through steps C806 and C807, and returns to the main flow.

The interrupt processing by INTa (for peak value an+2) is then executed. Step B805 sets up k=2, and steps B808 and B809 are executed. In this instance, k (=2)>m (=1). Steps B810 and B811 are successively executed to sound the musical tone at the frequency as defined by the time interval Tn.

With progression of the procedural steps as mentioned above, the maximum peak value an-1 of the waveform exceeds the difference between them. At this time, the sounding is ceased, and then started again. In this case, the sounding musical tone is assigned to another sounding channel of sound source 9. Change is made in accordance with volume and timbre, for example.

The instance as mentioned above is an+1>an +R. Also in the reverse case where the minimum peak value abruptly decreases, i.e., bn+1>bn+R (FIG. 43(*c*), the relative-on processing is performed in a similar way.

In this case, in the interrupt processing INTb (for peak value bn+1), the above condition is detected (step C812), and the note-on processing is executed in step C814, and m=1 and k=0 are set up in step C815.

In this case, in the interrupt processing INTa (for peak value an+2), k=1 is set up in step B805, steps B806 to B807 are used. In the next interrupt processing by INTb (for peak value bn+2), m=1 and k=0 are set up in step. In steps C808 to C811, the relative-on processing is executed. The frequency of the musical tone is determined by the time tm in FIG. 43(*f*).

The input waveform damps and NO is given in step B804 (or step C804). Then, control flows to step B816 (or CB16). When the sounding progresses, CPU 400 executes the note-off processing in the next step B818, and gives a command of such to sound source circuit 9. In step B818 (or C818), k and m are set to "0" for initializing. Following this step B818, step B816 is executed, and if NO is given, control returns to the main flow.

In the embodiment as mentioned above, the interrupt processing of FIG. 44 is first executed because the waveform rises (varies positively) at the start of waveform inputting. Conversely, when it falls (varies negative), the interrupt processing of FIG. 45 is first executed. The operation of the former case may be applied for the operation of the latter case which therefore will not be described.

In this embodiment, when the maximum and minimum peak values of the waveform increase by R relative to the peak value, the CPU judges that the waveform abruptly rises, and execute the relative-on processing in which the sounding is ceased and is started again. Therefore, the electronic guitar system operates following up the rapid playing of the tremolo.

In the above-mentioned embodiment, in steps B812 and C812, the difference between the previous and this-time peak values is used for the check of the rapid variation of waveform by the CPU. Alternatively, a ratio of those peaks may be used for the same purpose; ak/ak-1>S or bk/bk-1>S (S is an integer of more than 1).

Additionally, the comparison of the peak value two peaks before and the this-time peak value may be used, although the comparison of the previous peak value and the this-time peak value is used.

Further, in the embodiment as mentioned above, the relative-on processing is executed when one of the peak values ak and bk satisfies the relation ak−ak-1>R or bk−bk-1>R. It is evident that when these relations are both satisfied, the relative-on processing is executed.

Furthermore, any other suitable detection may be used for detecting the rapid increase of the waveform during the sounding.

While in the above-mentioned embodiment, the present invention is applied for the electronic guitar, it can be applied for any other systems of the type in which pitches are extracted from a sound signal or an electrical vibration as input from a microphone, for example, and an acoustic signal, which is different from the original signal, is generated at the pitches or note frequencies corresponding to those of the original signal. Specific examples of such are electronic pianos with key boards, electronic wind instruments' electronic string instruments such as electronic violins and koto (Japanese string instrument).

As described above, when the rapid increase of the input waveform signal is detected during the sounding of the musical tone, the CPU issues a note-on command again. The electronic system of the guitar can follow up the rapid variation of the waveform, and hence the tremolo playing of the guitar.

NINTH EMBODIMENT

1. General

Figure 46A:
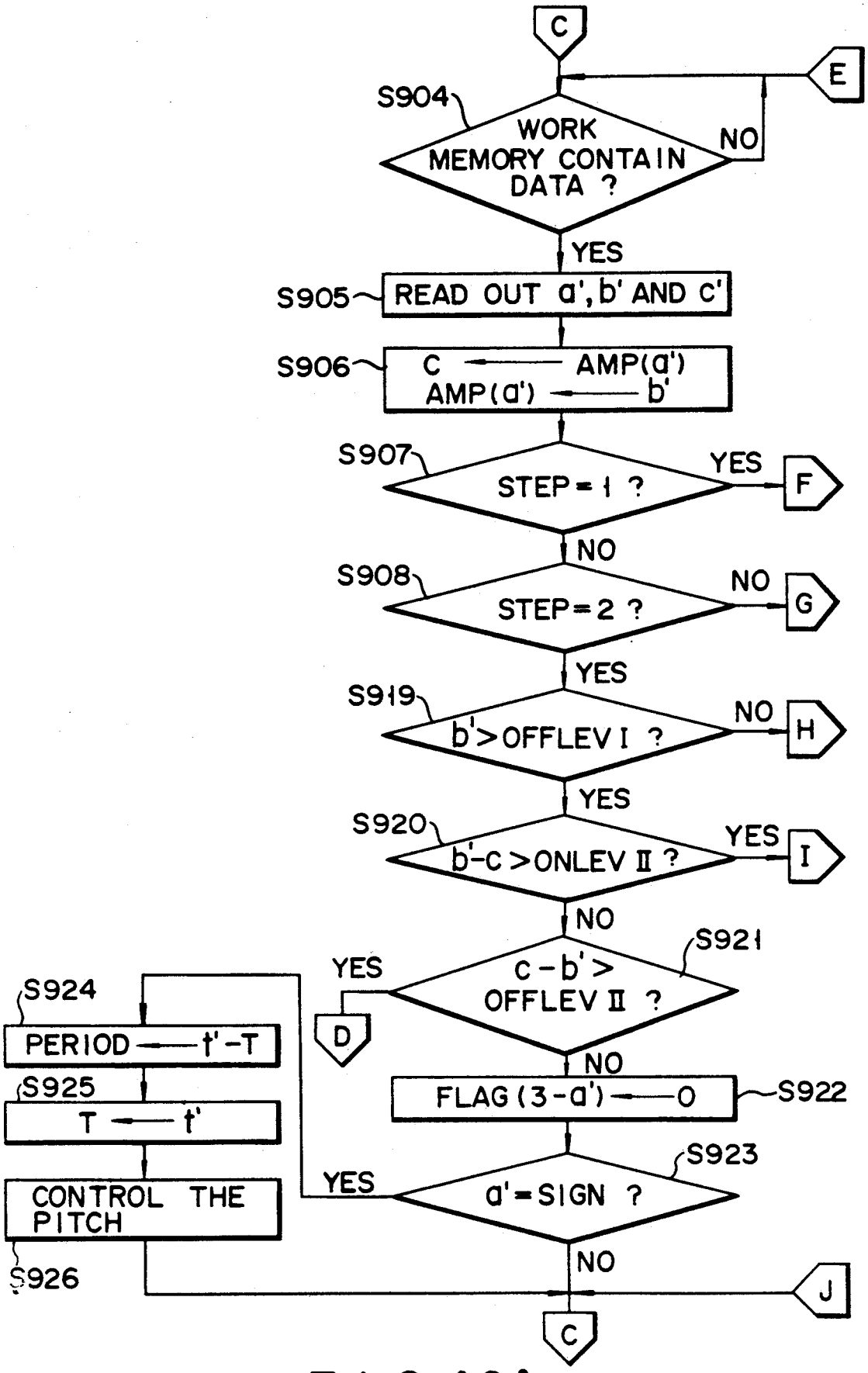
FIGS. 46A and 46B show a flowchart of a main routine of the CPU in a ninth embodiment.
Figure 46B:
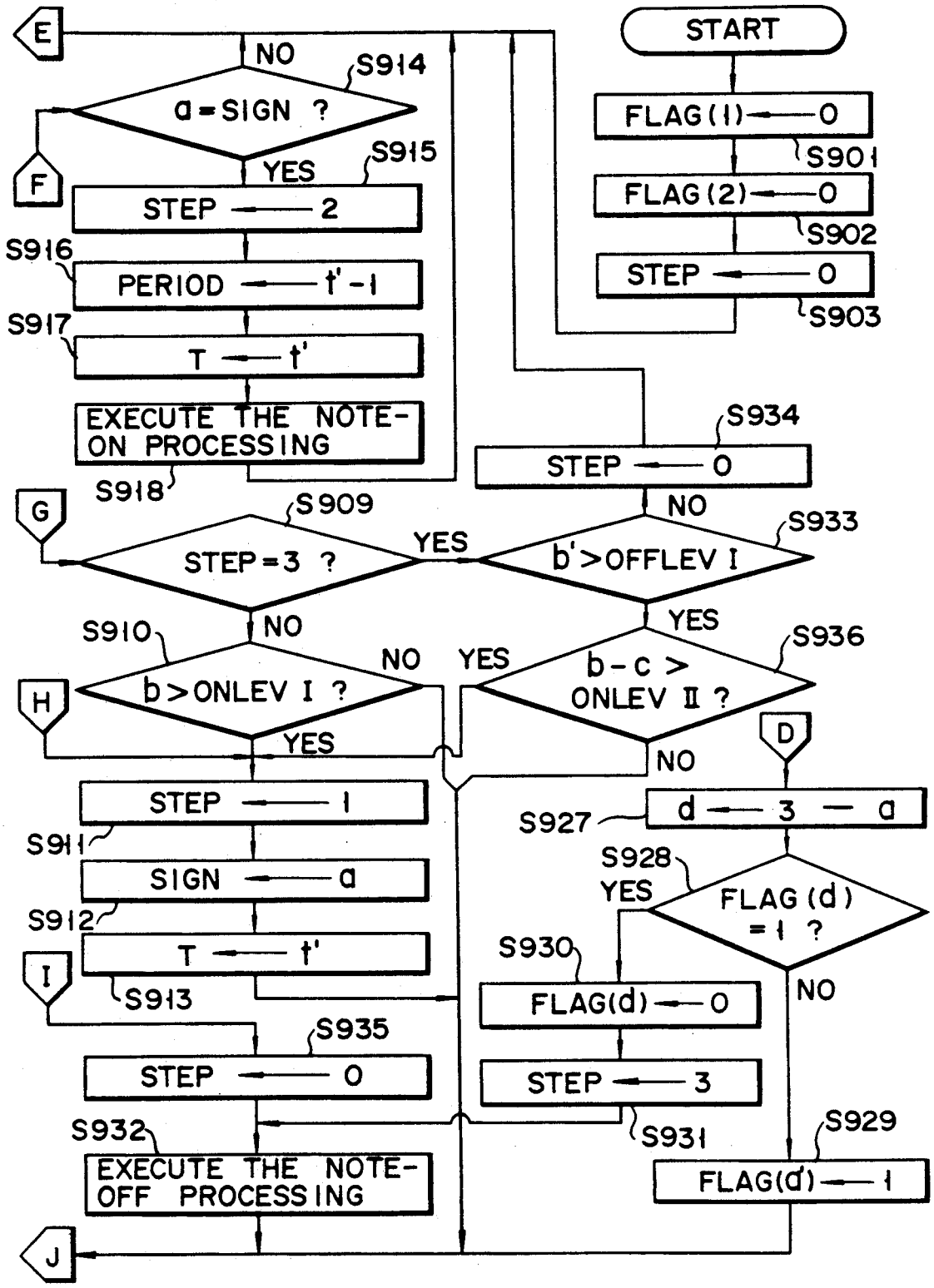

A ninth embodiment of an electronic guitar according to the present invention will be described referring to FIGS. 46A, 46B, . . . 49. The ninth embodiment is proposed to prevent the electronic guitar from erroneously operating when tone is turned off by detaching the player's finger from the fret board.

The ninth embodiment achieves the following objects: 1) to ensure the sounding stop, which is made by removing the finger of a player from the fret can be reliably made; 3) to eliminates the sounding of the musical tone at the pitch, which is different from that of the musical tone sounded before the finger is removed from the fret; 3to realize artificial musical tones approximate to those generated by natural musical instruments including the string instruments.

To achieve the above objects, the ninth embodiment is based on the scheme that the note-off is executed if the maximum and minimum peak values of the input waveform are below those previous peaks, respectively.

2. Description of Arrangement and Operation

1) Arrangement

The ninth embodiment is operable with an arrangement similar to that of any embodiment as described above. For example, the arrangement of FIG. 33 is available for the ninth embodiment. Further, the interrupt routines may be that of FIG. 34.

2) Operation

Before proceeding with the detailed description of the CPU operation, main registers in work memory 601 will first be described.

A FLAG (i) register is used in the following way. When the maximum or minimum peak value is by an OFFLEVII smaller than the corresponding peak value, "1" is set in this register. The FLAG (1) is for the maximum peak, and the FLAG (2) for the minimum peak. When "1" is set to the FLAG (i) register, the note-off processing is executed even if the peak is not below the OFFLEVII level.

Figure 47:
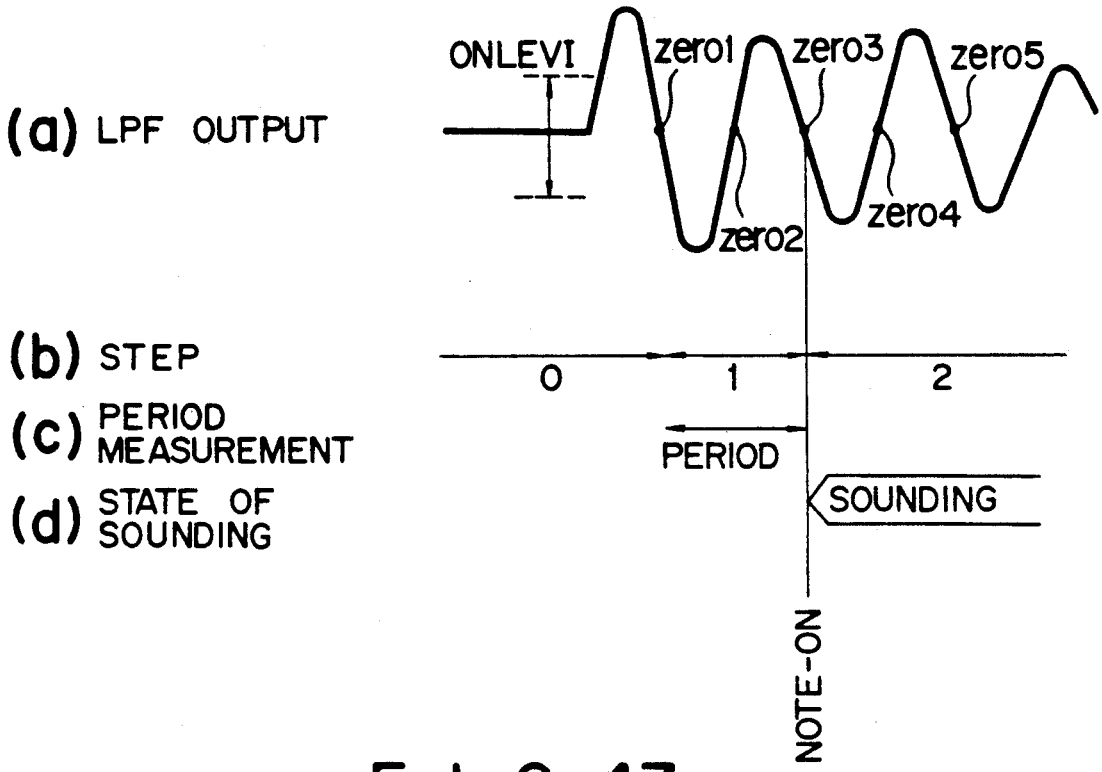
FIG. 47 shows a timing chart useful in explaining the operation for sounding start when the musical instrument of the ninth embodiment receives a waveform of an input signal.

A STEP register contains four values 0, 1, 2, and 3. The contents of the STEP register progressively change, as shown in FIG. 47(*b*) or FIG. 48(*b*), as the string is picked and vibrates (FIG. 47(*a*) or FIG. 48(*a*)). The contents 0 of this register represents the note-off mode. "3" of the register indicates a state that the peak becomes below the previous peak by OOFLEVEII, and the note-off command has been issued. "1" and "2" of the register indicate that the normal sounding progresses.

A PERIOD register stores the data of measured period. On the basis of the contents of this register, CPU 600 executes the frequency control against frequency ROM 8 and sound source circuit 9.

A SIGN register is used for indicating that the zero-cross point for period measurement is located after the maximum peak point or the minimum peak point. The contents 1 of the register indicates that the zero-cross point after the maximum peak point, and the contents 2 of the register indicates the zero-cross point after the minimum peak point.

An AMP (i) register stores the maximum or minimum peak value, more exactly, its absolute value, which is applied from A/D converter 11 and latched in latch 412. An AMP (1) register stores the maximum peak value, and an AMP (2) is for minimum peak value storage.

As will be described later, for various types of judgement, four constants (threshold levels) are contained in CPU 600.

The first constants is ONLEVI. As shown in FIG. 47(*a*), the electronic system of the guitar is in the note-off mode. In this mode, when a peak level larger than ONLEVI, the CPU judges that a string has been picked, and starts the period measurement.

ONLEVII is used in such a way that in the note-on mode, when the difference between the previous and this-time detection levels is above the level of ONLEVEII, the CPU executes the relative-on processing even if the tremolo playing, for example, is used.

OFFLEVI is used in such a manner that in the note-on mode, if the peak value detected is below this level of OFFLEVI, the note-off processing is executed (FIG. 48(*a*)).

OFFLEVII is used in such a manner that in the note-on mode, if the difference between the maximum or minimum peak value and those previous peak values is detected and is below this level of OFFLEVI, the note-off processing is executed (FIG. 48(*b*)).

A main routine and interrupt routines, which are used in the sixth embodiment, will be described. The preparatory knowledge as mentioned above will assist you in understanding the routine description to follow.

In the main routine (FIGS. 46A and 46B), after clearing each register of FLAG (1), FLAG (2) and STEP in steps S901 to S903, the CPU judges whether or not the contents of a'-, b'- and t'-register are saved into work memory 601 through the interrupt processing in step S904. Primed characters a', b' and t' correspond to a, b and c above, and indicate that these items of data have previously stored, respectively. If no interrupt processing has been executed, the answer to step S904 is NO, and the CPU repeats the execution of step S904.

If YES is given in step S904, the CPU advances to step S905, and reads out contents a', b' and t'. Then, the CPU goes to step S906, and reads out the peak value at the peak point of the same type (maximum or minimum) which has been stored in AMP (a') register. The CPU sets the peak value b' extracted this time into AMP (a'). In steps S907 to S909, the CPU checks if the contents of the STEP register is 1, 2 or 3. When the system of the electronic guitar is in the initial condition, the STEP register is 0, and therefore the answer to steps S907, S908, S909 is NO. In step S910, the CPU checks if the peak value b' detected this time is above or below the level of ONLEVI.

If NO is given in step S910, the note-on or sounding start processing is not executed and the CPU returns to step S904. As shown in FIG. 47(*a*), if the peak value, which is output through low-pass filter 3, is above ONLEVI, YES is given in step S910 and the CPU advances to step S911.

In step S911, the CPU sets "1" in the STEP register. In the next step S912, the CPU inputs the value of a'-register into the SIGN register. The value of a'-register is "1" at the zero-cross point immediately after the maximum peak point, and is "2" at the zero-cross point immediately after the minimum peak point.

In step S913, the CPU sets the value of t'-register, i.e., the zero-cross point Zero 1, in the T register.

Thus the contents of a'-register (FIG. 47(*a*)) is set in the SIGN register, those of b'-register in the AMP (1) register, those of t'-register (the time of the zero-cross point Zero 1) in the t-register. Then, the CPU advances to step S904.

The processing of the main routine immediately after the zero-cross point Zero 1 in FIG. 47(*a*) is completed by the execution of the sequence of processing steps as mentioned above. In the processing of the main routine immediately after the zero-cross point Zero 2, the CPU executes the data set processing in steps S904 to S906. Then, YES is given in step S907, and the CPU advances to step S914.

When the input waveform rises at the time of waveform inputting as shown in FIG. 47(*a*), the SIGN register contains "1". Since the present wave of the waveform has passed the negative peak, a'-register contains 2, and NO is given in step S914. Then, the CPU does not execute any further processing and returns to step S904.

When the zero-cross point Zero 3 is reached, the CPU executes steps S904 to S907 and S914 again. In this step, YES is given, and the CPU advances to step S915, and inputs 2 in the STEP register as shown in FIG. 47. In step S916, the CPU subtracts the time of the zero-cross point Zero 1 in the T register from the time given by the this-time interrupt processing in the t'-register. Then the CPU loads the difference, i.e., the time length shown in FIG. 47(*c*) or the one period in the PERIOD register.

Subsequently, the CPU advances to step S917, and transfers the contents of t'-register to the T register, and starts new period measurement. In step S918, CPU issues the note-on command so that musical tone, which has the frequency in accordance with the contents of the PERIOD register mentioned above, can be generated from sound source circuit 9. Then, the sounding starts.

In the processing of the main routine immediately after the next zero-cross point Zero 4 (see FIG. 47(*a*)), the CPU executes steps S904 to S908. In step S908, the contents of the STEP register is 2, and YES is given. Then the CPU advances to step S919, and checks if the peak value b' is above or below the level of OFFLEVI (see FIG. 48(*a*)). Now the peak level is above OFFLEVI, and YES is given in step S919, and the CPU advances to step S920.

In step S920, the CPU judges whether or not the relative-on processing should be executed. In other words, the CPU checks if the value of the present peak point (b') is above that of the previous peak point by ONLEVII, i.e., checks if the extracted peak point rapidly increases during sounding.

When a string is picked, the vibration of the string gradually damps toward zero, NO is given in step S920. In case that before the vibration of the string previously picked damps to zero, another string is picked by the tremolo playing, for example, the answer to step S920 is often YES.

In this case, the CPU jumps from step S920 to step S911, and then, executes steps S912 and S913. As a result, the CPU sets "1" in the STEP register, and subsequently, executes the same processing as that of the sounding start. In other words, after loading "1" in the STEP register, the CPU executes steps S907, S914, S915, S916, S917 and S918, and executes the relative-on processing. In this case, the relative-on processing with the attack starts.

In the normal state, the CPU goes from step S920 to step 921. In this step the CPU checks if the peak value b' is by OFFLEVII smaller than the previous peak value "c", that is, if the tone-off operation by removing the finger of a player from the fret board has been done.

If the fret board remains held by the finger, in step 921 No is given and in step S922 the FLAG (3-a') register is cleared. "3-a'" indicates the FLAG register relating to the peak point located opposite to the preceding peak point. If at the present time point a'=1 and it is the zero-cross point immediately after the maximum peak point, a FLAG (2) for the minimum peak point is cleared. If at the present time point a'=2 and it is the zero-cross point immediately after the minimum peak point, a FLAG (1) for the maximum peak point is cleared. In this case, the zero-cross point immediately after the minimum peak point is Zero 4 and FLAG (1) is cleared.

Subsequently, CPU 600 checks if the contents of SIGN register is coincident with the contents of the a'-register. The present zero-cross point is Zero 4. Then, the SIGN register contains "1" and the a'-register "2". In step S923, No is given and the CPU returns to step 904. When the zero-cross point Zero 5 is detective, sequences of steps S904 to S908, and S919 to S923 are executed and YES is given in step S23. Then, a sequence of steps 924 to 926 is executed to set a new period ranging from Zero 3 to Zero 5 into the PERIOD register and transfers the contents of the t'-register into the T register. Then, new period measurement starts. The CPU issues a frequency change command to frequency ROM 8 and sound source circuit 9, according to the pitch this time detected and stored in the PERIOD register.

Figure 48:
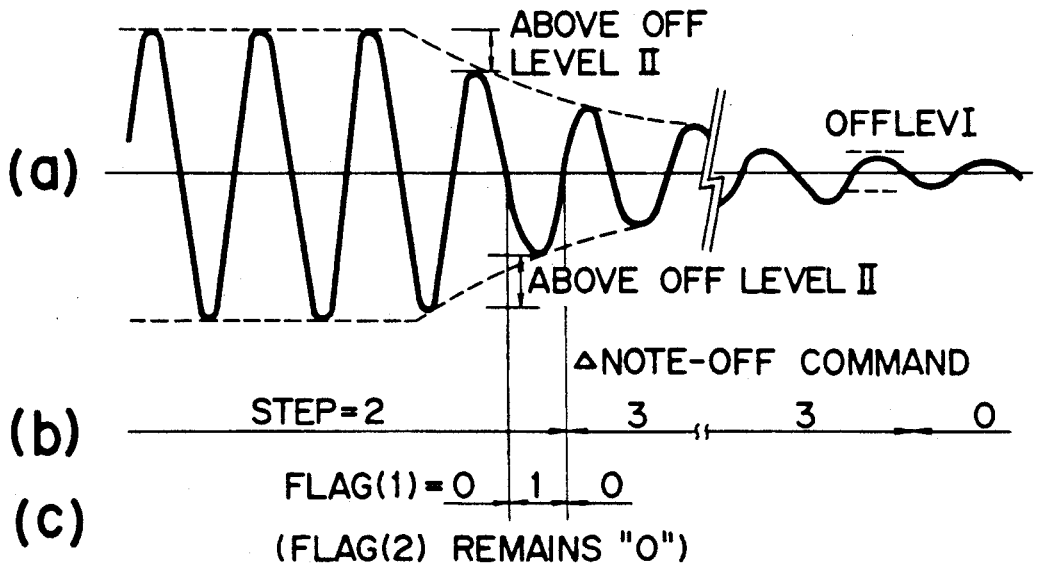
FIG. 48 shows a timing chart useful in explaining the operation for sounding start when the musical instrument of the ninth embodiment receives another waveform of an input signal.

If the note-off operation is performed the maximum and the minimum peak values become small as shown in FIG. 48(*a*). When the difference between the previous peak value and the present peak value becomes below the OFFLEVII level. Then, the CPU executes the sequences of steps S904 to S905, and S919 to S921, and YES is given in step S921. In step S927, the CPU computes d=3 a', which indicates the peak point located opposite to the peak point immediately before the this-time peak point. In step S928, the CPU checks if the FLAG (d) for this "d" is "1".

At present, the FLAG (i) registers are both "0" and hence the CPU advances to step S929 and sets 1 in the FLAG (a') register for the peak point immediately before the peak point detected this time, and returns to step S904.

Subsequently, the next zero point is reached after the opposite peak point is passed, CPU 600 executes the sequence of steps S904 to S908, and S919 to S921, and in steps S927 and 928 the CPU checks if "1" is set in the FLAG (i) for the opposite peak point. At present the register contains "1" and therefore the CPU clears the FLAG (i) register on the opposite side, and sets "3" in the STEP register. In step 932, the CPU executes the note-off processing, and gives to sound source circuit a command to stop the sounding of the musical tone from sound source circuit 9.

In this way, the subsequent sounding will be stopped and if the player removes his finger from the fret, the note-off is ensured.

In this case, when of these two types of levels, only one type level drops below the OFFLEVII, step S921 and steps S927 to 929 are executed to set "1" in one of the FLAG (i) registers. In step 921 to check if the peak level is below the OFFLEVII, NO is given. Step S922 clears the FLAG (i) register with "1". Then steps 923 to 926 for note-off continue processing are progressively executed.

Figure 49:
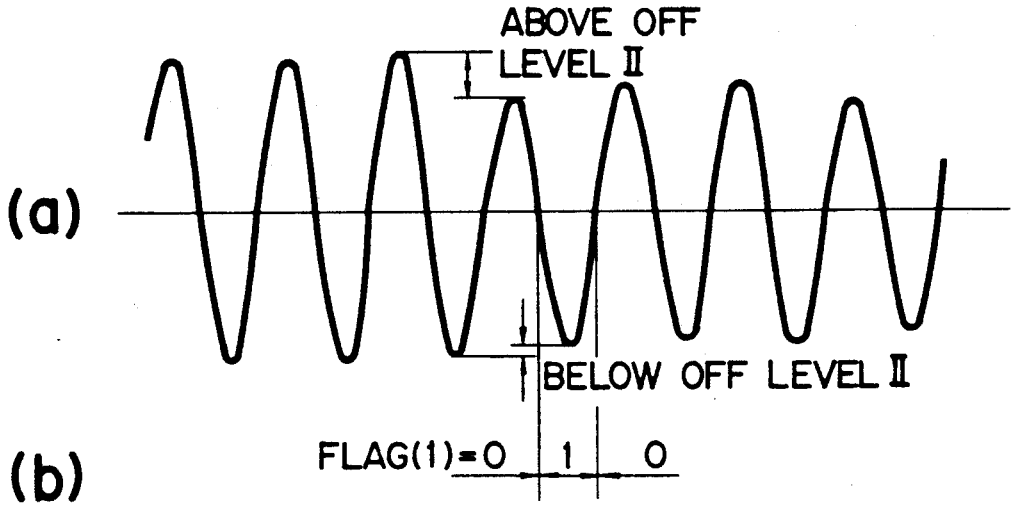
FIG. 49 is a timing chart showing the operation of the ninth embodiment when it does not perform the muting operation.

In Summary, in the case of FIG. 48, steps S921 and S927 to S929 judges that one of the two types of levels is below OFFLEVII. Then, the FLAG set processing is first executed In steps S921, S927 to S928, and S930 to S932, the other peak level below the OFFLEVII level is detected and the note-off processing starts. In the case of FIG. 49, in steps S921 and S927 to S929, the first type of peak level below the OFFLEVII level is detective and the flag is set. In steps S921 and S922, the CPU detects that the second type of peak level is not yet below OFFLEVII and sets the flag. In steps S921 and S922, the flag is cleared since the second peak level is not yet below OFFLEVII. The CPU executes the note-on processing in steps S923 to S926.

After the step register has "3" and the sounding stopped in this way, CPU 600 goes through steps S901 to S908, and reaches step 909. In the last step, YES is given. The CPU jumps to step S933 to check if the peak level b' is below OFFLEVI. Immediately after "3" is said in the STEP register, the peak level is not yet OFFLEVI. The CPU goes step S936. This step, like step S920, checks if the relative-on processing is to be executed. If this-time peak level b' is above the previous peak level "c" by ONLEVII, the note-on processing is executed in steps S911 to S913. If the former is below the later, the CPU returns to step S904.

If the peak level becomes below OFFLEVI, step S933 the answer of NO, and in step S934 the STEP register is cleared.

In a normal sounding mode in which the STEP register contains "2", if peak level drops below OFFLEVI, step 919 gives the answer of NO. Then, the CPU goes to step S935 to clear the STEP register and executes the note-off processing in step 936 to stop the sounding of musical tone from sound source circuit 9.

The OFFLEVII, which is used for stop the sounding when the finger is removed from the fret board, may be a fixed level or the product of multiplying the previous peak value by a fixed rate. In the above-mentioned embodiment the time interval between the adjacent zero-cross points for pitch measurement. This time interval may be substituted by the time interval between the maximum peak point and the zero-cross point, the minimum peak point and zero-cross point, or the maximum peak point and the minimum peak point. In such a case, the interrupt signal INT may be the signal from maximum or minimum peak detector 4 or 5. The same processing may be executed upon detection of the zero-cross point immediately before the peak point. Any other suitable measure may be used for setting up the reference point.

While in the above-mentioned embodiment, the present invention is applied for the electronic guitar, it can be applied for any other systems of the type in which pitches are extracted from a sound signal or an electrical vibration as input from a microphone, for example, and an acoustic signal, which is different from the original signal, is generated at the pitches or note frequencies corresponding to those of the original signal. Specific examples of such are electronic pianos with key boards, electronic wind instruments, electronic string instruments such as electronic violins and koto (Japanese string instrument).

As seen from the foregoing, when the maximum and minimum peak values of the input waveform are both below those previous peak values, respectively, the note-off is executed. This ensures the sounding stop, which is made by removing the finger of a player from the fret. The electronic guitar never sounds the musical tone at the pitch, which is different from that of the musical tone sounded before the finger is removed from the fret. This realizes artificial musical tones approximate to those generated by natural musical instruments including the string instruments. Further, the ninth embodiment eliminates useless pitch (fundamental frequency) extractions to be performed after the finger detaches from the guitar string.

TENTH EMBODIMENT

1. General

A tenth embodiment of an electronic guitar according to the present invention will be described referring to FIGS. 50 to 54.

Figure 50:
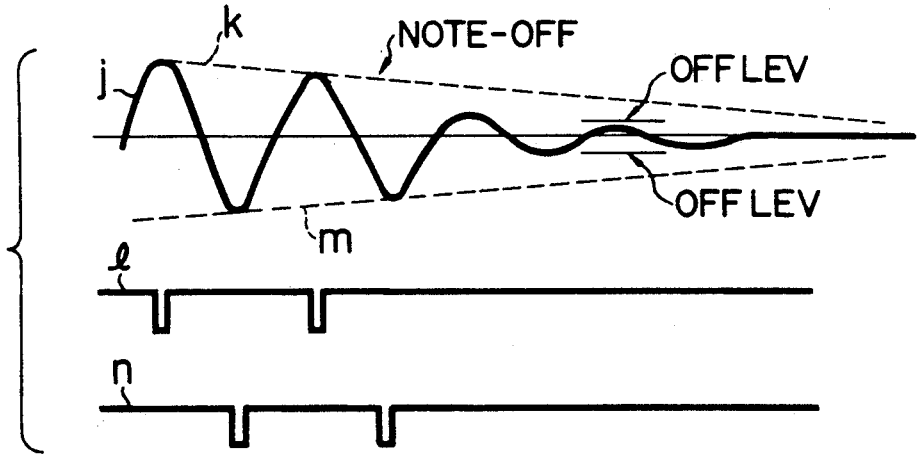
FIG. 50 shows a waveform for explaining the technical problems to be solved by the tenth embodiment according to the present invention.

Technical problems to which this embodiment is directed is illustrated in FIG. 50. In the figure, (j) indicates an input waveform, (k) an envelope connecting positive peaks, (l) a waveform of a positive peak detect signal, (m) an envelope connecting negative peaks, and (n) a waveform of a negative peak detection signal.

As shown in FIG. 50, when the input waveform abruptly damps by the mute playing, for example, if the peak level is below a predetermined level OFFLEV, control execute the note-off processing to stop the sounding. In this approach, however, it is very difficult to pick up peak points. For this reason, the note-off processing is delayed.

According to this embodiment, if the input signal level abruptly damps to such an extent to make it difficult to detect the peaks of the input signal waveform, this damping can be detected quickly and reliably, and the note-off processing can be executed.

When the input signal waveform drops below a predetermined value for a predetermined period of time, control gives a note-off command.

2. Description of Arrangement and Operation

1) Arrangement

Figure 51:
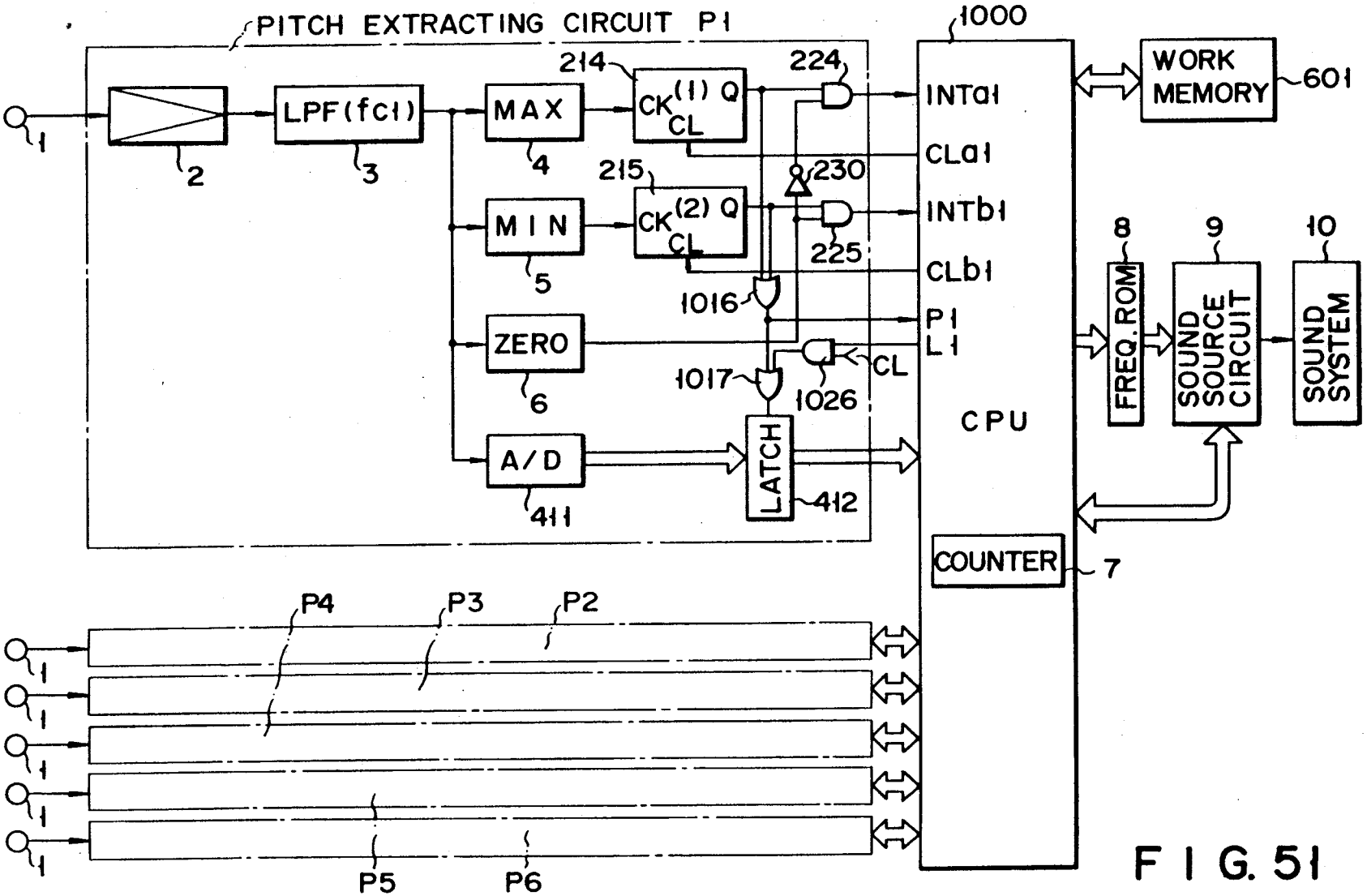
FIG. 51 shows a block diagram of a tenth embodiment.

An overall arrangement of the tenth embodiment is shown in FIG. 51. This arrangement is substantially equal to that of FIG. 33. Like portions are designated by like symbols in FIG. 33, for simplicity.

Some of main features of this embodiment are 1) to apply a latch lock to latch 412 at the maximum (positive) and minimum (negative) peak detections, via OR gates 1016 and 1017, and 2) to apply a clock signal CL through AND gate 1026 and OR gate 1017 when CPU 1000 applies a latch command signal L in logical high.

Figure 52:
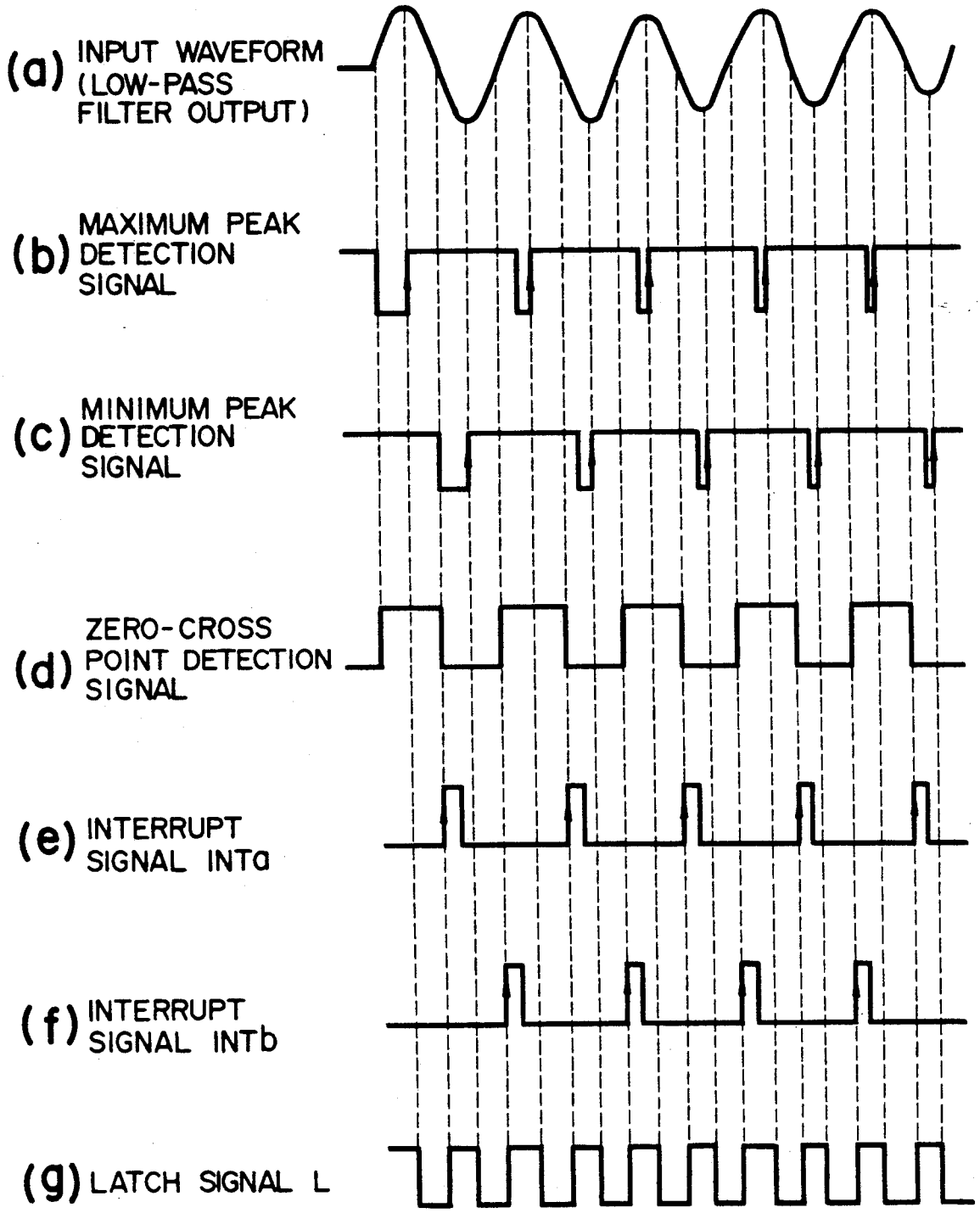
FIG. 52 shows a set of waveforms of the signals at the key portions in the tenth embodiment.
Figure 53A:
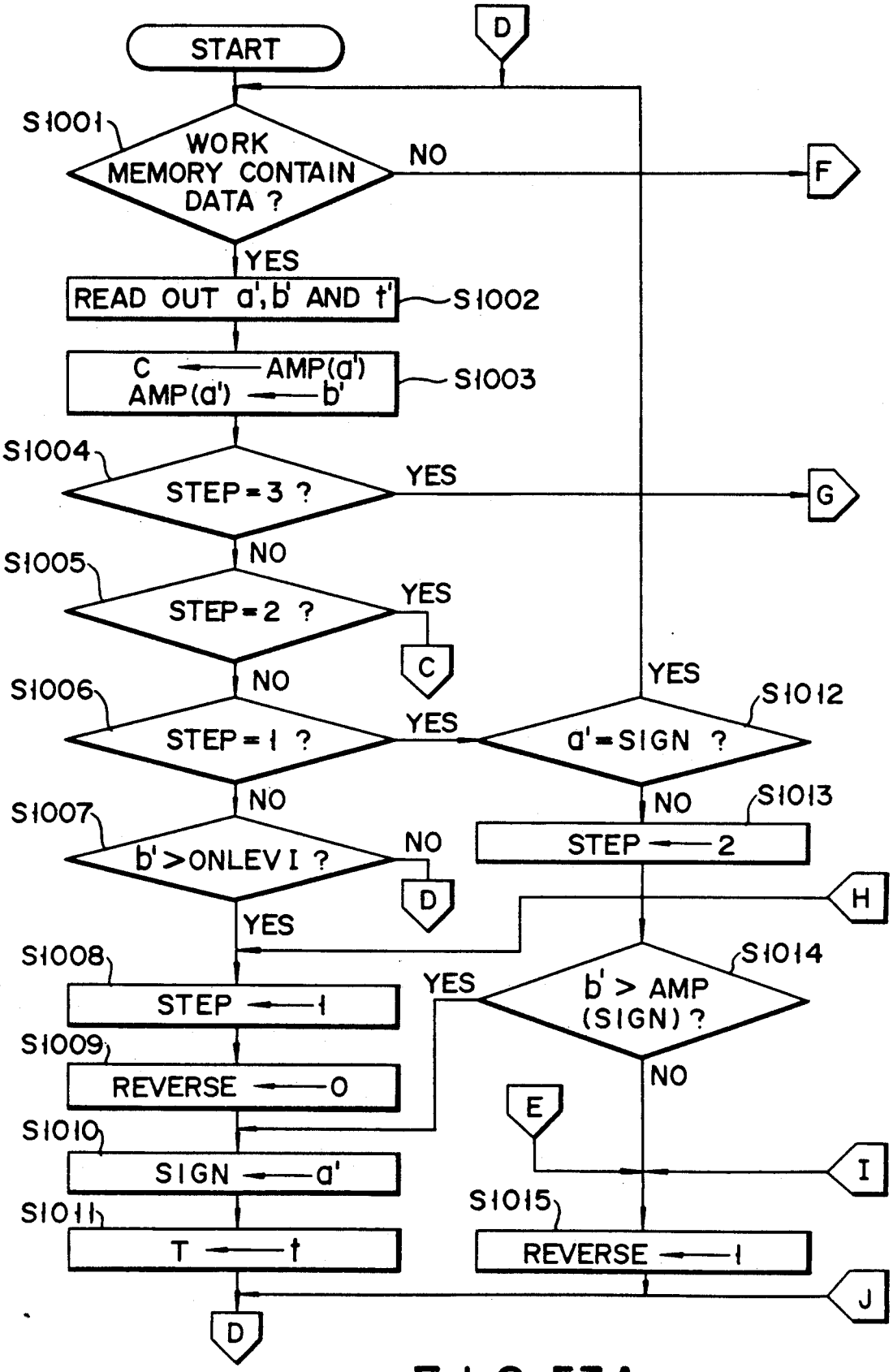
FIGS. 53A and 53B show a timing chart a flowchart of a main routine executed by the CPU used in the tenth embodiment.
Figure 53B:
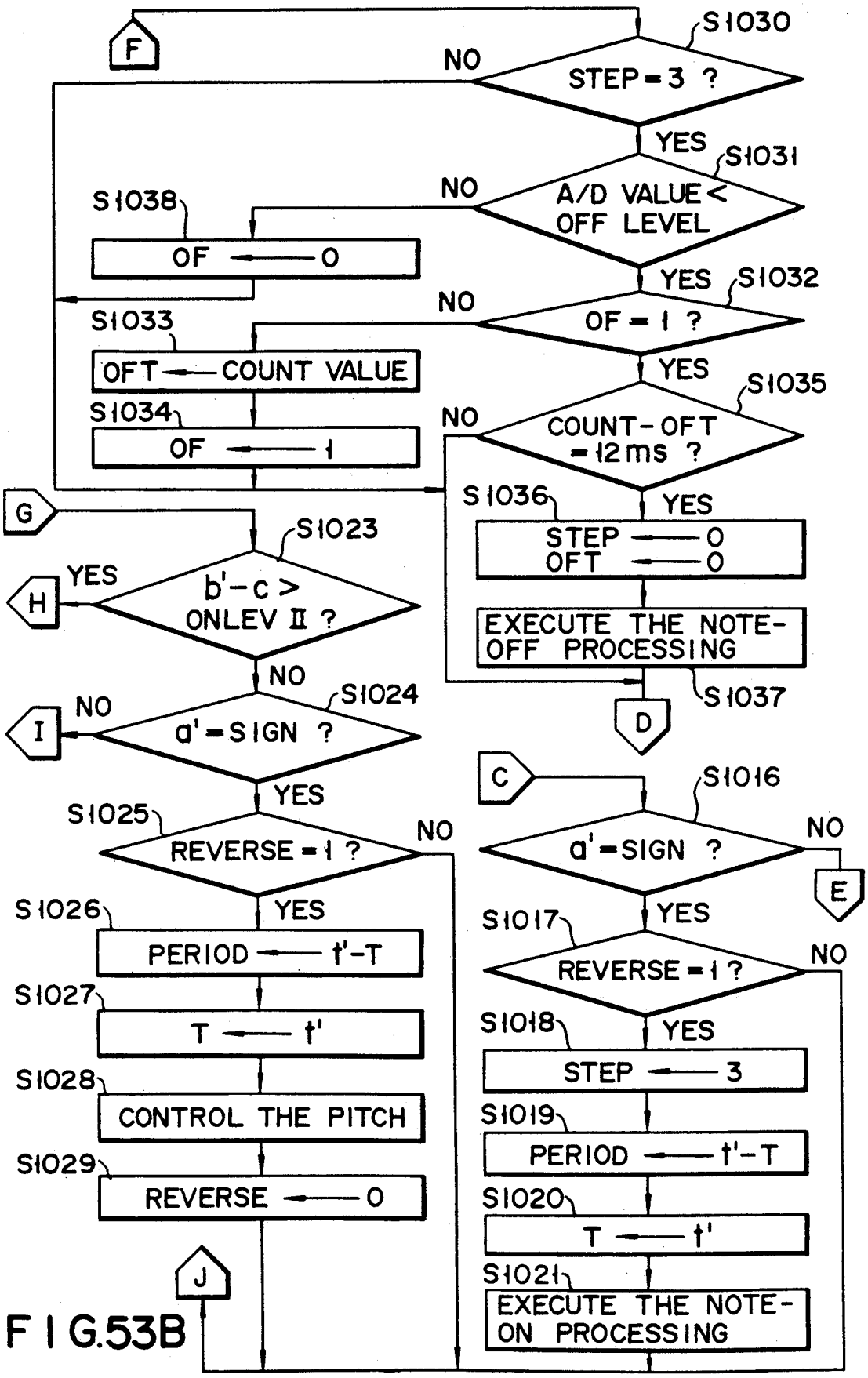

The waveforms (a) to (g) of the signals at key portions in FIG. 51 are shown in FIG. 52. Of those signals, latch command signal (g) continues logical high during the period ranging from an instant that CPU 100 fetches the peak values from latch 412 at the maximum and minimum peak points in response to interrupt signals INTa and INTb until the next peak detect signals (b) and (c) are applied.

During the period with application of interrupt signals INTan and INTbn ("n" is any of 1 to 6), in the case of a sine wave as an input signal waveform, the peak values are latched in the first half of the wave between the top and bottom, i.e. between the zero-cross point and the maximum or minimum peak point. In the range from the maximum or minimum peak point and the next zero-cross point the peak value is held.

The output signal from each latch 412 is applied to CPU 1000. This data is used for controlling the controls such as note-on, note-off, pitch extraction start, pitch extraction stop, and control of sounding level (volume control). The peak values as latched in each latch 412 before the output of latch command signals L1 to L6 are stopped, are successively stored into work memory 601.

When the absolute value of the data representative of the waveform level as applied from A/D converter 411 is above a predetermined value, CPU 1000 executes the note-on and the pitch (fundamental frequency) extraction. When the data is below the note-off level OFFLEVE shown in FIG. 54, the volume level is abruptly stopped to terminate the sounding. The operation of this will be given in detail later.

In the circuit arrangement, A/D converter 411 is provided for each pitch extraction circuit P1 to P6. If necessary, a single A/D converter may be used in common for those pitch extraction circuits, and be operated in a time-divisional manner.

2) Operation

A main routine of CPU 1000 is illustrated in FIG. 29.

A interrupt routine, which is applied for CPU 600, may be substantially equal to that of FIG. 34. Although these routines are for only one string operation, the same processings are correspondingly applied for other five string operations. In processing these six string operations, CPU 1000 executes the processings for six strings in a time divisional manner. FIGS. 36 to 37 will be used for explaining the operation of this embodiment.

a) Registers in work memory 601

Before proceeding with the detailed description of the CPU operation, main registers in work memory 601 will first be described. A STEP register contains four stages 0, 1, 2, and 3. The contents of the STEP register progressively change, as shown in FIG. 36(*b*) or FIG. 37(*b*), as the string is picked and vibrates (FIG. 36(*a*) or FIG. 37(*a*)). The contents 0 of this register represents the note-off state.

A SIGN register is use for indicating that the zero-cross point for period measurement is after the maximum peak point or the minimum peak point. The contents 1 of the register indicates that the zero-cross point after the maximum peak point, and the contents 2 of the register indicates the zero-cross point after the minimum peak point.

A REVERCE register stores the data to check whether the interrupt processing has been made, which is executed at the arrival of the zero-cross point after the peak point which is located in opposition to the zero-cross point as given by the SIGN register. This is used for checking the pitch (fundamental frequency) extraction control for each period.

A T register stores the count of counter 7 at a specific point to measure the period of the input waveform. Count 7 free runs responsive to a given clock signal.

An AMP (i) register stores the maximum or minimum peak value, more exactly, its absolute value, which is applied from A/D converter 411 and latched in 412. An AMP (1) register stores the maximum peak value, and an AMP (2) is for minimum peak value storage.

A PERIOD register stores the data of measured. On the basis of the contents of this register, CPU 1000 executes the frequency control against frequency RDM 8 and sound source circuit 9.

Figure 54:
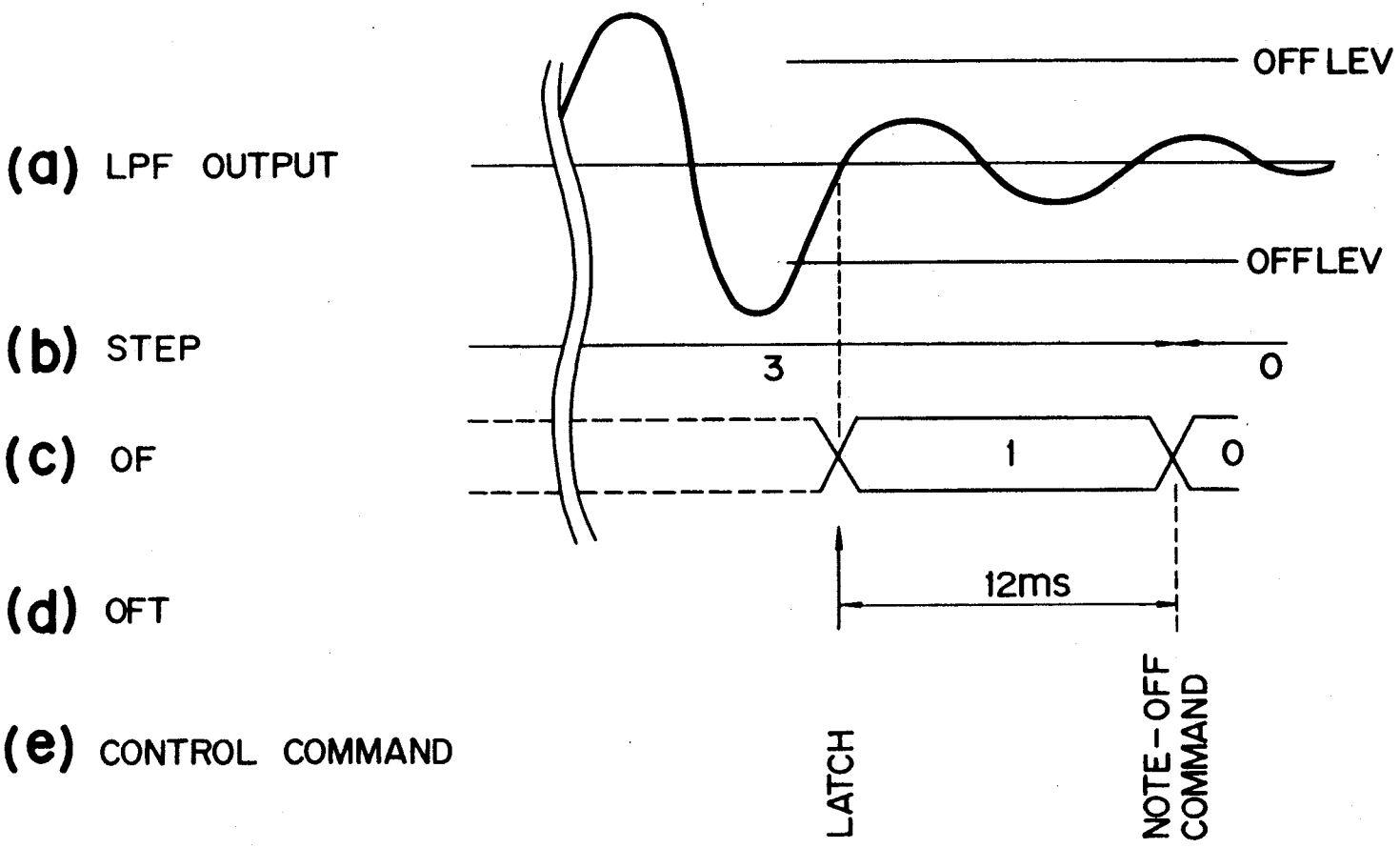
FIG. 54 shows a timing chart for explaining the muting operation when the mute is executed in the tenth embodiment.

An OFF register contains "1" when the level data of the input waveform latched in latch 412 is below OFFLEV as the note-off level shown in FIG. 54. It contains "0" when it is above OFFLEV during the sounding.

An OFT register stores the count of counter 7 when 21" is set in the OF register. If the time duration of the state of "1" in the OF register is a predetermined time duration, for example, the period of a string vibration in the open string mode, more exactly, 12 msec for the sixth string, for example, the note-off processing is executed.

As will be described later, for various types of judgement, three constants (threshold levels) are contained in CPU 1000.

The first constants is ONLEVI. As shown in FIG. 36(*a*) and FIG. 37(*a*), the system is in the note-off mode. In this mode, when a peak level larger than ONLEVI is detected, the CPU decides that a string has been picked, and starts the period measurement.

ONLEVII is used in such a way that in the note-on mode, when the difference between the previous and this-time detection levels is above the level of ONLEVEII, the CPU executes the relative-on processing even if the tremolo, for example, is used.

OFFLEV is used in such a manner that in the note-on mode, if the peak value detected is below this level of OFFLEV, the note-off processing is executed (FIG. 54(*a*)).

A main routine and interrupt routines, which are used in the tenth embodiment, will be described. The preparatory knowledge as mentioned above will be of assistance in understanding the routine description to follow.

b) Processing of the main routine

In step S1001 of the main routine (FIGS. 53A and 53B), CPU judges whether or not the contents of the a'-, b'-, and c'-registers have been stored into work memory 601, through the interrupt processing. Primed characters a', b', and c' corresponds to a, b and c above, and indicate that these items of data have previously stored, respectively. If no interrupt processing has been executed, the answer to step S1001 is NO, and the CPU repeats the execution of step S1001 by going through the note-off processing in steps S1030 to S1038.

If the answer is YES, the CPU advances to step S1002. In this step, the CPU reads out the registered contents a', b' and t'. Then, the CPU goes to step S1002, and reads out the peak value at the peak point of the same type (maximum or minimum) which has been stored in AMP (a') register. The CPU sets the peak value b' extracted this time into AMP (a') register.

In steps S1004 to S1006, the CPU checks if the contents of STEP register is 3, 2 or 1. When the system of the electronic guitar under discussion is in the initial condition, the STEP register is 0, and therefore the answer to steps S1004, S1005 and S1006 is NO. In step S1007, the CPU checks if the peak value b' detected this time is above or below the level of ONLEVI.

If the peak value b' is below ONLEVI, the sounding start processing is not executed, and the CPU returns to step S1001. If it is above ONLEVI as shown in FIG. 36(*a*) and FIG. 37(*a*), step S1007 gives the answer of YES, and the CPU advances to step S1008.

In step S1008, the CPU sets "1" in the STEP register. In the next step S1009, the CPU sets "0" in the REVERSE register. In step S1010, the CPU inputs the value of a'-register into the SIGN register. The value of a'-register is "1" at the zero-cross point immediately after the maximum peak point, and is "2" at the zero-cross point immediately after the minimum peak point.

In step S1011, the value of t'-register is set in the T register. As a result, the contents of a'-register is set in the SIGN register (now SING is "1" in the case of FIGS. 36(*a*) and FIG. 37(*a*)), the contents of the b'-register is set in the AMP register. The content of the t'-register is loaded into the T register. Then, the CPU returns to step S1.

The processing of the main routine immediately after the zero-cross point Zero 1 in FIG. 36(*a*) and FIG. 37(*a*) is completed through the execution of the sequence of processing steps explained above.

The main routine immediately after the zero-cross point Zero 2 will be described. In this processing, the data set processing and the note-on step discrimination processing in steps S1001, S1002, S1003, S1004, S1005 and S1006 will be executed. If the answer YES is given in step S1006, the CPU advances to step S1012.

When the input waveform rises at the time of waveform inputting as shown in FIG. 36(*a*) and FIG. 37(*a*), the SIGN register contains "1". Since the present wave of the waveform has passed the negative peak, the a'-register contains "2", and NO is given. When the zero-cross point immediately after the peak point with the same polarity is reached, YES is given in this step S1012. The CPU does not execute any further processing and returns to step S1001.

In step S1012, NO is given, and then, the CPU advances to step S1013, and sets "2" in the STEP register (see FIG. 36(*b*)).

Following step S1013, the CPU executes step S1014, and compares the previous peak point (AMP (SIGN)) with the present peak point (b'). If the previous value X0 is smaller than the present value (x1>x0) as shown in FIG. 36(*a*), YES will be given. To set up the period measuring start point at time point t' (FIG. 36(*c*)), the CPU jumps from step S1014 to steps S1010 and S1011, to set "2" in the SIGN register and at the same time to transfer the contents of the t'-register to the T register.

On the contrary, if the previous peak point is above the present peak point, x1<x0, as shown in FIG. 37(*a*), NO is given in step S1014 and "1" is set in the REVERSE register. In this case, the previous point "1" is maintained in the SIGN register. As a result, the previous zero-cross point Zero 1 is the period measuring start point, in this case (see FIG. 37(C)).

When the CPU executes the main flow after the next zero-cross point (Zero 3) is passed, the CPU advances to step S1016 after YES is given in step S1005. The present value of the a'-register is "1", that of the SIGN register is "2" as shown in FIG. 36, and that of the SIGN register is "1" as shown in FIG. 37. Therefore, in the case of FIG. 36, NO is given in step S1016 and the CPU advances to step S1015 and returns to step S1001. In other words, CPU 1000 recognizes that the first peak point (amplitude×2) is passed after the period measurement starts.

In FIG. 37, the CPU has the answer of YES in step S1016, and advances to step S1017 to check if the REVERSE register contains "1". If the value of the REVERSE register is "1", the CPU has the answer of NO, and returns to step S1001. As mentioned above, after execution of step S1015, the value of this register is "1". Then, the CPU advances to step S1018, and inputs "3" in the STEP register (see FIG. 37(b)). In step S1019, the CPU subtracts the value of the T register, i.e., the time of the zero-cross point Zero 1, from the value of the counter 7 given by the this-time interrupt processing, and the CPU loads it in the PERIOD register.

The time length PERIOD shown in FIG. 37(*c*) is that of one period. In step S1020, the CPU transfers the contents of the t'-register to the T register, and starts the new period measurement.

In step S1021, CPU 1000 issues a sounding start (note-on) command to frequency ROM 8 and sound source circuit 9 in accordance with the contents of the PERIOD register. At this time, the sounding starts.

In the case of FIG. 36, the main flow after the next zero-cross point Zero 4 is executed again, and the CPU jumps from step S1005 to S1016. Since the value of the SIGN register is now 2, YES is given in step S1016. Subsequently, the sounding start processing in steps S1017 to S1021 are executed. At this time, CPU 1000 recognizes the time interval from zero-cross points Zero 2 to Zero 4 shown in FIG. 36(*c*), as one period. The guitar starts the sounding of the musical tone at the frequency as defined by the time length recognized (see FIG. 36(*d*)).

Thus, the period measurement is executed from the next zero-cross point after the peak point whose value is big. The period measurement is completed at the next zero-cross point located in the same side as the previous peak point. As the result of it, the period of low-pass filter 3 output waveform is extracted.

After the sounding start processing, the CPU advances from step S1004 to step S1023 in the main routine processing, and judges whether or not the relative-on processing should be executed. In other words, the CPU checks if the value of the present peak point (b') is above that of the previous peak point by ONLEVII, i.e. checks if the value of the extracted peak point rapidly increases during sounding.

When a string is picked, the vibration of the string gradually damps toward zero. NO is given in step S1023. In case that before the vibration of the string previously picked damps to zero, another string is picked by the tremolo playing, for example, the answer to step S1023 is often YES.

In this case, the CPU jumps to step S1008 after judging YES in S1023, and then executes the preparatory processing for note-on in step S1009 to step S1001. As a result, the CPU sets "1" in the STEP register, and subsequently executes the same processing as that of the sounding start. In other words, after loading "1" in the STEP register, the CPU executes step S1016 to step S1021 again, and executes the relative-on processing.

In the normal picking, the CPU executes step S1023 followed by step S1024, and compares the contents of the a'-register with those of the SIGN register. If these do not coincide, the CPU advances to step S1015 for the interrupt processing at the next zero-cross point. If these coincide, the CPU proceeds to step S1025 because the present wave of the waveform has the peaks with the opposite polarities (positive and negative peaks) in the past. Then the CPU judges whether or not the value of the REVERSE register is "1". If the result is NO, it returns directly to step S1001. If YES is given, the CPU advances from step S1025 to step S1026. Then the contents of the T register is subtracted from those of the t'-register for obtaining a new period, and the result is set in the PERIOD register.

In step S1027, the contents of the t'-register are transferred to the T register. Subsequently, on the basis of the value of the PERIOD register obtained in step S1028, CPU 1000 executes the frequency (pitch) control for frequency ROM 8 and sound source circuit 9.

Thus, this embodiment discretely picks up a variation of the frequency of string vibration, and controls the frequency according to the picked up discrete data in a real time manner.

The CPU advances from step S1028 to step S1029, and clears the REVERSE register, and finally executes the period measuring.

Figure 4:
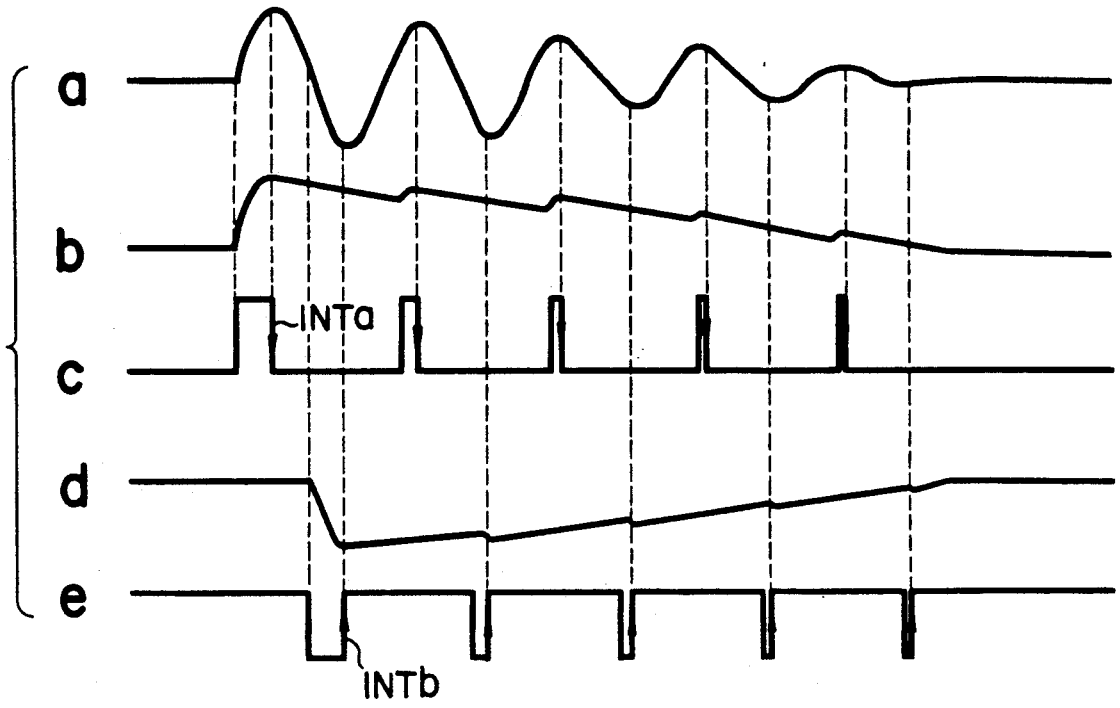
FIG. 4 shows a timing chart useful in explaining the operation of the FIGS. 2 and 3 circuits.

When the string vibration abruptly damps by the mute playing, and the peak level falls below OFFLEV, as shown in FIG. 4, in step S1030, CPU decides that the present contents of the STEP register is 3. As shown in FIG. 54(*c*), the CPU detects that the waveform level of the input signal, which is derived from A/D converter 411 and latched in latch 412, becomes below the note-off level OFFLEV (step S1031). "1" is set in the OF register which has stored "0", and the count of counter 7 is set to the OFT register. The CPU returns step S1001 (steps S1023 to S1034).

Since the peak value is below the OFFLEV level, if the input waveform reaches the peak, the waveform level of the signal, which is applied from a/D converter 412 to latch 412, never exceeds OFFLEV. Therefore, the CPU never goes from steps S1030 and S1031 to step S1038, so that "1" is maintained in the OF register. If the state that the waveform level is below OFFLEV is continued for the length of one wave of the string vibration, for 12 msec or more in the case of the sixth string, CPU 1000 in step S1035 recognizes this by u sing the difference between the count as set in the OFT register and the present count of counter 7. In step S1036, CPU 1000 clears the STEP register and the OF register, and executes the note-off processing in step S1037, and gives a note-off command to sound source circuit 9, to stop the sounding.

In this way, the note-off processing can be executed quickly and reliably, even if the waveform level abruptly changes, by detecting that the waveform level below OFFLEV for 12 msec, for example.

Since such damping temporarily occurs, if the peak level exceeds OFFLEV, CPU 1000 detects this in step S1031, and clears the OF register in step S1038, and does not execute the note-off processing. Therefore, if the abrupt drop of the waveform level occurs as shown in FIG. 50, and neither of interrupt signals INTa and INTb is generated, clock signal CL is always applied to latch 412. The latch command signal L as indicated by (8) in FIG. 52 keeps high level state. Then, the output of A/D converter 411 is applied to CPU 1000 via latch 12. The CPU executes the note-off processing according to this peak value. As a result, the note-off response is improved.

The above-mentioned embodiment is so arranged that when the waveform level of the 6th string is below the level of OFFLEV, the note-off is executed. In an alternate approach, the note-off may be executed when such a level of the input waveform is continued for the other time duration than 12 ms, i.e., the period or more of the musical tone a generated by the electronic guitar. The above-mentioned embodiment is also so arranged that CPU 1000 executes the interrupt processing immediately at the zero-cross point after each peak point, followed by the note-on start, period computation, relative-on, note-off start, etc. Such processing may be performed immediately after each peak point detection. In this case, the same effects as those attained by the former case may be attained. Additionally, these processings may be done upon detection of the zero-cross point immediately before the peak point. Any other suitable measure may be used for the reference point setting up.

Each processing, which is executed in the main routine in the above-mentioned embodiment, may be done in each interrupt processing.

While in the above-mentioned embodiment, the present invention is applied for the electronic guitar, it can be applied for any other systems of the type in which pitches are extracted from a sound signal or an electrical vibration as input from a microphone, for example, and an acoustic signal, which is different from the original signal, is generated at the pitches or note frequencies corresponding to those of the original signal. Specific examples of such are electronic pianos with key boards, electronic wind instruments, electronic string instruments such a electronic violins and koto (Japanese string instrument).

3. Effects

As described above, in the tenth embodiment, when the input signal level below a predetermined level continues for a predetermined time duration, the note-off is executed. If the mute playing is made, and the waveform abruptly drops to such a level to be too low for detecting the peak point, the level drop can reliably and quickly be detected, to execute the note-off processing. This cannot be realized by the conventional system of the type in which the note-off is executed upon detection of the dropping of the peak of the input signal wave below a predetermined value. With such an arrangement, good performance is obtained. The electronic system of the electronic guitar more quickly enters the new note-on processing of the musical tone.

ELEVENTH EMBODIMENT

1. General

An eleventh embodiment of an electronic guitar according to the present invention will be described referring to FIGS. 55A, 55B, and 56.

In an electronic musical instrument of the type in which the artificial musical tone is formed by using the pitch extracted from a waveform of a natural musical tone generated from musical instrument such as an electronic guitar, harmonics are contained in the natural waveform. The harmonics possibly cause erroneous frequency change control, when these are detected.

In playing the guitar, a player holds a 7th fret or 5th fret and picks a string, and then he detaches his finger from the string and executes the mute. In this case, the string of the conventional electronic guitar vibrates at the frequency of the second harmonic.

Therefore, when playing the conventional guitar, the player makes the mute, the guitar sounds the second harmonic musical tone. This is the serious problem of the conventional electronic guitar.

The eleventh embodiment improves the electronic guitar of the above type so that the guitar never produces the harmonics musical tone even when it extracts the harmonics.

To achieve this, when the frequency of the input signal is approximately doubled, or increased by about one octave, CPU decides that the harmonic waveform is applied to the guitar, and issues a note-off command.

2. Description of Arrangement and Operation

1) Arrangement

An arrangement of the eleventh embodiment may be that of FIG. 33. The interrupt routines by interrupt commands INTa and INTb may also be substantially the same as those of the embodiment relating to FIG. 33. Description of the operation of this embodiment will be given mainly in connection of the main routine.

Figure 55A:
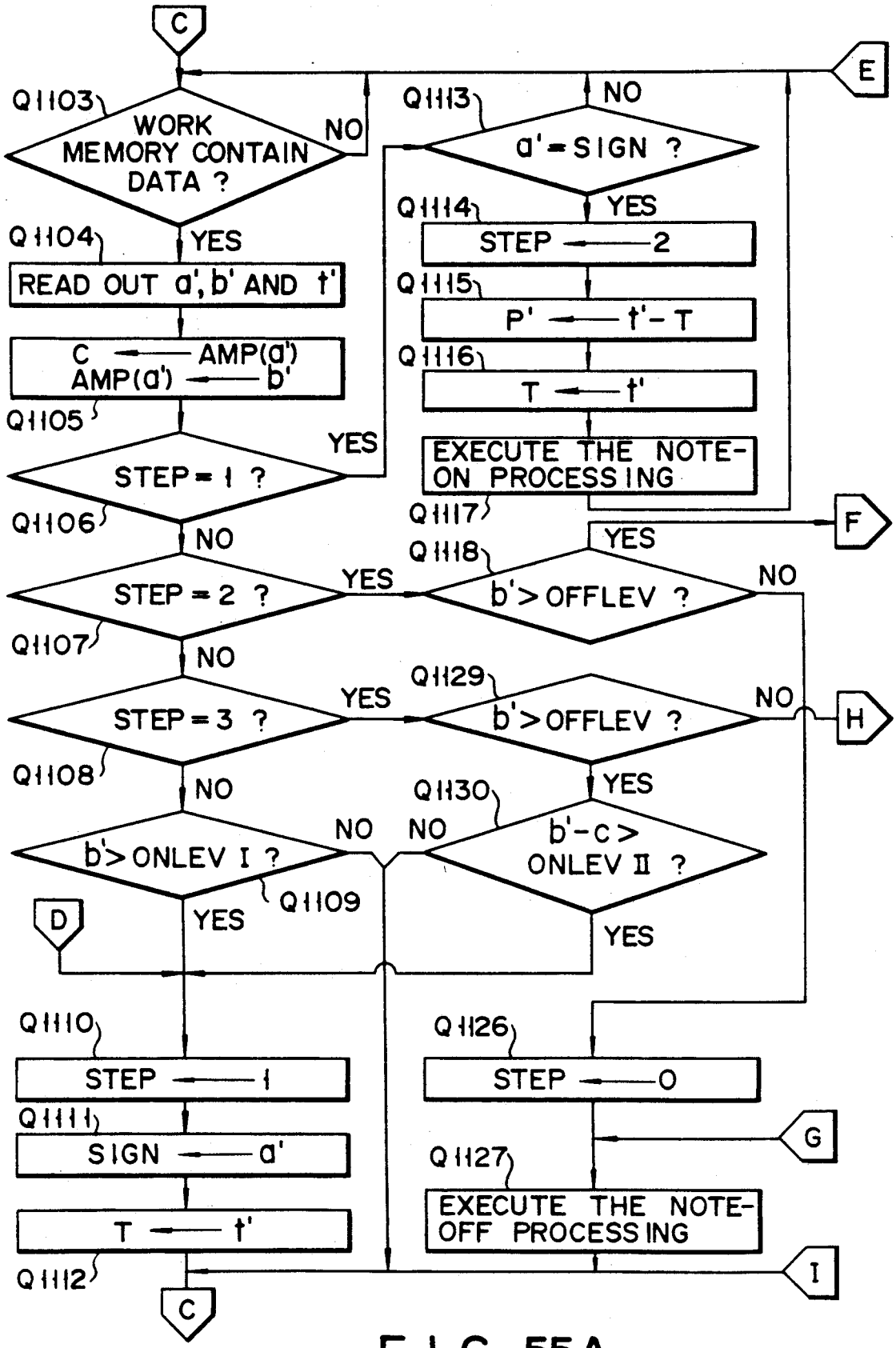
FIGS. 55A and 55B show a flowchart of a main routine by the CPU used in a 11th embodiment according to the present invention.
Figure 55B:
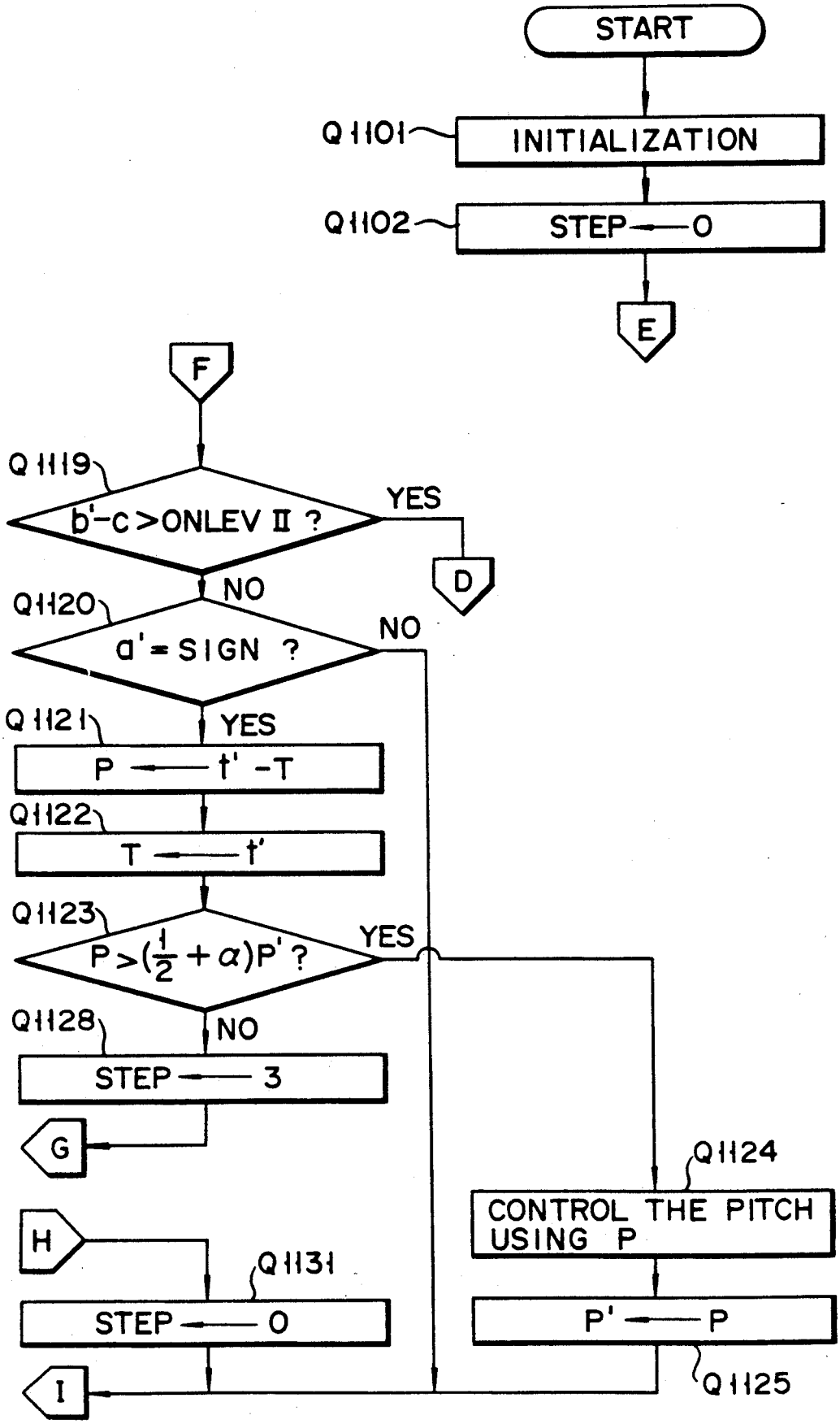

2) Operation o FIGS. 55A and 55B show a flowchart of a main routine used in this embodiment. The main routine is for picking of only one string. In an actual guitar, six strings are used, and CPU 600 executes the main routine in a time divisional manner.

Before proceeding with the detailed description of the CPU operation, main registers in work memory 601 will first be described.

A STEP register may contain 0, 1, 2 for a normal mode, and 0, 1, 2, and 3 for an abnormal mode when harmonics are extracted. The contents of the register changes as the string of guitar is picked and vibrates, as shown in FIG. 56(*a*). The contents of "0" of this register indicates the note-off mode.

A SIGN register is used for indicating that the zero-cross point for period measurement is located after the maximum peak point or the minimum peak point. The contents 1 of the register indicates that the zero-cross point after the maximum peak point, and the contents 2 of the register indicates the zero-cross point after the minimum peak point.

A T register stores the count of counter 7 at a specific point for measuring the period of an input waveform.

An AMP (i) register stores the maximum or minimum peak value, more exactly, its absolute value, which is applied from A/D converter 11 and latched in latch 412. An AMP (1) register stores the maximum peak value, and an AMP (2) is for minimum peak value storage.

A P or P' register receives the data representing the measured period. Using the contents of this register, CPU 600 executes the frequency change control for sound source circuit 9.

As will be described later, for various types of judgement, three constants (threshold levels) are contained in CPU 600.

The first constants is ONLEVI. As shown in FIG. 56(*a*), the electronic system of the guitar is in the note-off mode (STEP=0). In this mode, when a peak level is larger than ONLEVI, the CPU judges that a string has been picked, and starts the period measurement.

ONLEVII is used in such a way that in the note-on mode, when the difference between the previous and this-time detection levels is above the level of ONLEVEII, the CPU executes the relative-on processing even if the tremolo playing, for example, is used.

OFFLEV is used in such a manner that in the note-on mode, if the peak value detected is below this level of OFFLEV, the note-off processing is executed (FIG. 56(*a*)).

A main routine and interrupt routines, which are used in the sixth embodiment, will be described. The preparatory knowledge as mentioned above will assist you in understanding the routine description to follow.

In step Q1101 of FIGS. 55A and 55B, CPU 600 initializes the registers, for example, contained in the electric system of the electronic guitar. In step S1102, "0" is set in the STEP register.

If the answer is YES in step Q1103, the CPU advances to step Q1105. In this step, the CPU reads out the registered contents a', b' and t'. Then, the CPU goes to step Q1105, and reads out the peak value at the peak point of the same type (maximum or minimum) which has been stored in AMP (a') register. The CPU sets the peak value b' extracted this time into AMP (a') register.

In steps Q1106 to Q1108, the CPU checks if the contents of STEP register is 1, 2 or 3. When the system of the electronic guitar under discussion is in the initial condition, the STEP register is 0, and therefore the answer to steps Q1106, Q1107, and Q1108 is NO. In step Q1107, the CPU checks if the peak value b' detected this time is above or below the level of ONLEVI.

If the answer of NO is given in step Q1109, the CPU returns to step Q1103. If it derived from low-pass filter 3 is above ONLEVI, step Q1109 gives the answer of YES and the CPU advances to step Q1110.

In step Q1110, the CPU sets "1" to the STEP register. In the next step Q1111, the CPU sets the value of a'-register into the SIGN register. The value of a' is "1" at the zero-cross point immediately after the maximum peak point, and is "2" at the zero-cross point immediately after the minimum peak point.

In step Q1112, the value of t', i.e., the time at the zero-cross point Zero 1, is set in the T register.

In this way, the value of a' ( it is "1" in the case of FIG. 56) is set in the SIGN register, that of b' in the AMP (1) register, and that of t' (the time at the zero-cross point Zero 1) in the T register. Then, the CPU returns to step Q1103, again.

Figure 56:
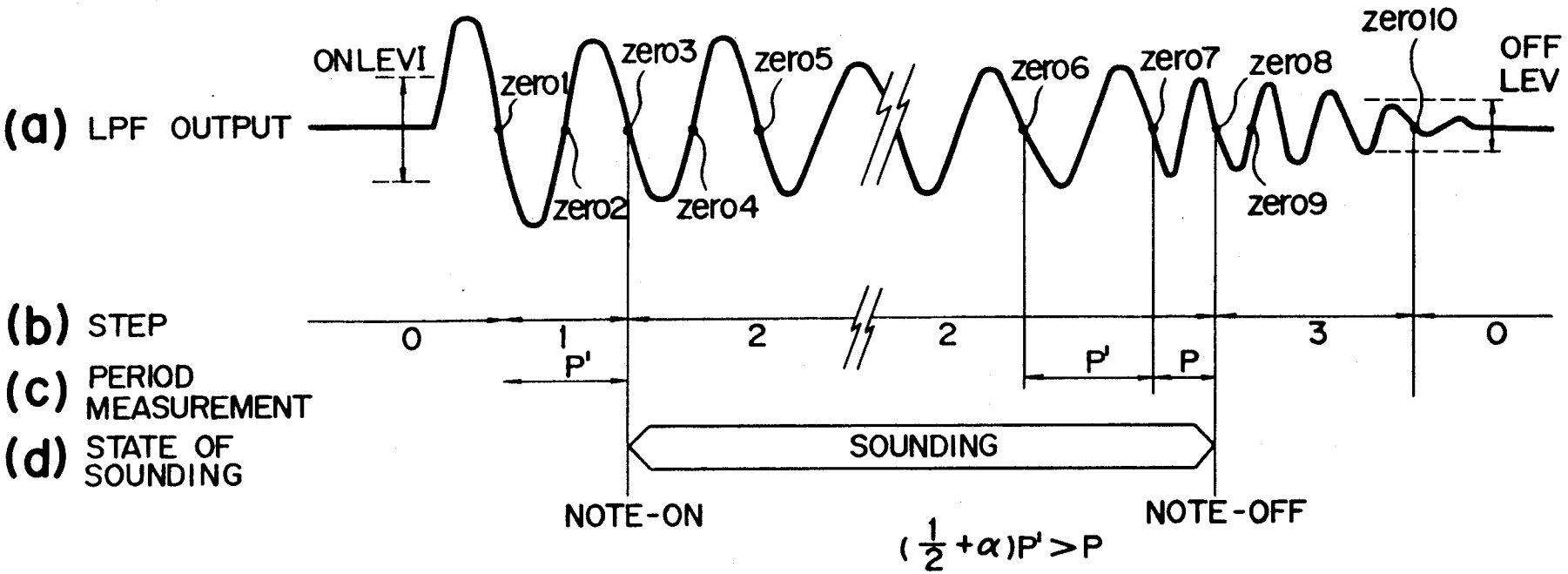
FIG. 56 shows a time chart for explaining the operation of the 11th embodiment.

The processing of the main routine immediately after zero-cross point Zero 1 in FIG. 56(*a*) is completed through the execution of the sequence of processing steps as explained above.

The main routine immediately after the zero-cross point Zero 2 will be described. In this processing, steps Q1103 to A115 will be executed. If the answer YES is given in step Q1106, the CPU advances to step Q1113.

When the input waveform rises at the time of waveform inputting as shown in FIG. 56(*a*), the SIGN register is "1". Since the present wave of the waveform has passed the negative peak, i.e., the minimum peak point, the register is "2" and NO is given. The CPU does not execute any further processing and returns to step Q1103.

When the zero-cross point Zero 3 is reached, steps Q1103 to A1106 are executed, step Q113 gives the answer of YES. In step Q114, "2" is set to the STEP register as shown in FIG. 56(*b*). In step Q11, the time at the zero-cross point Zero 1 in the T register is subtracted from the this-time interrupt time in the t'-register. The result of the subtraction, i.e., the time length P' of one period of the waveform, is stored into the P' register.

In step Q1165, the contents of t'-register is transferred to the T-register, and a new period measurement starts. In step Q1117, the CPU directs sound source circuit 9 to generate the musical tone at the frequency based on the contents of the P' register, that is, gives a note-on command. The sounding starts from this timing, as shown in FIG. 56(*d*).

In the main routine immediately after the next zero-cross point Zero 4 (FIG. 56(*a*)), steps Q1103 to Q1107 are executed. Since the P register contains 2", step Q1107 gives the answer of YES. Then, in step Q118, the CPU checks if the value of b' is above or below OFFLEV (FIG. 56(*a*)). In this instance, the peak level is still high, and the answer to step Q1118 is YES, and the operation goes to step Q1119.

In step Q1119, CPU judges whether or not the relative-on processing should be executed. In other words, the CPU checks if the value of the present peak point (b') is above that of the previous peak point by ONLEVII, i.e. checks if the value of the extracted peak point rapidly increases during sounding.

When a string is picked, the vibration of the string gradually damps toward zero. NO is given in step Q119. In the case where, before the vibration of the string previously picked damps to zero, another string is picked by the tremolo playing, for example, the answer to step Q1119 may be YES.

In this case, the CPU jumps from step 1119 to step Q1110, and then executes step Q9 to step Q11. As a result, the CPU sets "1" in the STEP register, and subsequently executes the same processing as that of the note-on or sounding start. In other words, after loading "1" in the STEP register, the CPU executes step Q11106, Q1113 to Q1117, and executes the relative-on processing. At this time, the relative-on processing with the attach is executed.

In the normal picking, the CPU executes step Q1120 followed by step Q1119, and compares the contents of a'-register with those of the SIGN register. If these do not coincide, this step Q1120 gives NO, and returns to step Q1103 since the present cross-point is Zero 4, and the SIGN register contains "1" and the a'-register is "2".

When the zero-cross point Zero 5 is detected, steps Q1103 to Q1107 and Q1118 to Q112n are executed. In step Q1120, YES is given. Steps 1121 and Q1122 are executed to set a new period, i.e., the time from Zero 3 to Zero 5, into the P register.

In step Q1123, the CPU checks if P is larger than $(\frac{1}{2}+a)$ of P' using the this-time and previous period P and P'. In the relation, "a" is selected to be between 0 and 0.06, for example, allowing for an error of semitone or less. For obtaining an exact value of "a", it may be obtained experimentally.

In step Q1123, normally, YES is given, and then step Q1124 is executed. In this step, the CPU gives a command for frequency change to sound source circuit 9 according to the detected pitch.

In this way, the frequency may be changed for each semitone or the unit of smaller than semitone, in a real time manner. In the subsequent step Q1125, the contents of the P register is transferred to the P' register in step Q1115, and the CPU returns to step Q3.

In the processing of the main routine following the interrupt processing, the CPU executes steps Q1103 to Q1107, and Q1118 to Q1120, and returns to Q1103. Alternatively, it executes steps Q1103 to Q1107, and Q1118 to Q1125, when no relative-on processing is executed.

In step Q1118, if the input peak value is below OFFLEV, step Q1118 gives NO, and in step Q1126, the STEP register is cleared. The note-on processing is executed in step Q1127. As described, the musical tone thus sounded from sound source circuit is stopped.

When the musical tone is generated with the period (P' in FIG. 56(*c*)) as the time interval between the zero-cross points Zero 6 and Zero 7, if a player detaches his finger from the fret to make the mute (left-hand mute), the harmonic sound with the approximately halved period appears, and the zero-cross point Zero 8 is detected. Immediately thereafter, the main routine is processed. In this routine, steps Q1103 to Q1107 and Q1118 to Q1123 are executed, and in step Q1123, $P<(11/2+a)\times P'$ is detected. The CPU advances from step Q1123 to Q1128, to set 3 into the STEP register. In the subsequent step Q1127, t note-off processing is executed. At this time point, the CPU gives a note-off command to sound source circuit.

In the main routine immediately after the zero-cross point Zero 9, steps Q1103 to Q1108 are executed. In step Q1108, YES is given. Then, control flows to step Q1127. At the zero-cross point Zero 9, the value of b' is larger than OFFLEV (FIG. 56(*a*)), YES is given. The CPU goes to step Q1130 and executes the processing for relative-on as in step Q1119.

If the answer to step Q1130 is YES, steps Q1110 to Q1112 are executed, and subsequently, the note-on processing is executed.

In step Q1130, NO is given, and the CPU returns to step Q1103. Hence, steps Q1103 to Q1108 and Q1129 and Q1130 are executed whenever the zero-cross point is reached.

At the zero-cross point Zero 1 in Fig. FIG. 56(*a*), the next main routine is executed and in steps Q1103 to 1108, and Q1129 are executed. Since the contents of the b'-register are smaller than OFFLEVE, in step Q1129 NO is given. In the subsequent step Q1131, the STEP register is cleared. In this way, the CPU completes a sequence of note-on procedural steps and returns to step Q1103.

As described above, when the harmonic is input, CPU 6 detects it and correspondingly controls the electric system of the guitar, so that the circuit erroneously operates. Therefore, unnatural musical tones are never sounded from the guitar. Further, the mute (note-off) is made from that time, the performance by the guitar can be made, as the player intends.

Additionally, when the system is in the normal note-off, the STEP register is instantaneously set to "0". When the pitch changes by one octave of more, 3 is set to the STEP register. Then, the CPU waits till the input signal level becomes satisfactorily small, and "0" is set to the register. The string vibration often continues when the harmonic is input. It is possible to prevent the guitar system from being triggered for the relative-on by the waveform with the level above ONLEVI.

In the above-mentioned embodiment, CPU 600 executes the interrupt processing at the zero-cross point immediately after each of the maximum and minimum peak points. In the main routine immediately after each peak point, the note-on, period computation, relative-on, and note-off processings are performed. These processings may be immediately after these peak points are detected or upon detection of the zero-cross point immediately before the peak point. Various other suitable measures may be used for the reference point setting up. The correlative method may be used for the pitch extraction.

While in the above-mentioned embodiment, the respective processing operations are executed in the main flow, these may be executed in the respective interrupt routines.

While the present invention is applied to an electronic guitar, it can be applied to any other systems of the type in which pitches are extracted from a sound signal or an electrical vibration as input from a microphone, for example, and an acoustic signal, which is different from the original signal, is generated at the pitches or note frequencies corresponding to those of the original signal. Specific examples of such are electronic pianos with key boards, electronic wind instruments, electronic string instruments such as electronic violins and koto (Japanese string instrument).

3. Effects

As described above, when the frequency of the input waveform is approximately doubled, that is, increased by about one octave, the CPU decides that the harmonic comes in, and issues a command of note-off. Therefore, the intended mute effects can be obtained, thus eliminating unnatural musical tone generation.

TWELFTH EMBODIMENT

1. General

A twelfth embodiment of an electronic guitar according to the present invention will be described referring to FIGS. 57 to 59B.

This embodiment improves the pitch change control, which is applied for the sound source circuit.

In the electronic instrument including electronic guitars, it is a common practice that the pitch is extracted from an input signal waveform, and then control issues to a sound source circuit a command to sound a musical tone at the pitch as defined by the extracted pitch.

In the instrument of this type, when the pitch change command is frequently applied to the sound source circuit, the sound source circuit cannot follow up the pitch change.

Particularly in such a case that the pitch of the sounding musical tone is determined based on the pitch data of semitone or less, the sound source circuit needs a long time for the processing based on one pitch change command. Therefore, there is a situation that a new pitch change command is issued when the one command processing is in progress.

To cope with this, an approach has been proposed, which uses a coarse resolution of the pitch data to specify the pitch (in an extreme case, the semitone is the unitary resolution). This approach, however, is ineffective for discrete pitch variation or vibrato.

With the view to solve this problem, the twelfth Embodiment provides an electronic guitar in which the sound source circuit can follow up the discrete and rapid pitch variation with improved pitch resolution but without any modification of the sound source circuit, thereby realizing natural musical tone sounding.

To achieve this, if once a note-on command or a pitch change command is issued, a time count means prohibits the issuance of a new pitch change command until a predetermined period of time elapses. This confines the time interval between the adjacent pitch change commands within a predetermined time period, and ensures a correct processing of the sound source circuit.

Therefore, the pitch resolution of the sounded musical tone can be increased or made more discrete without the processing speed.

2. Description of Arrangement and Operation

1) Arrangement

Figure 57:
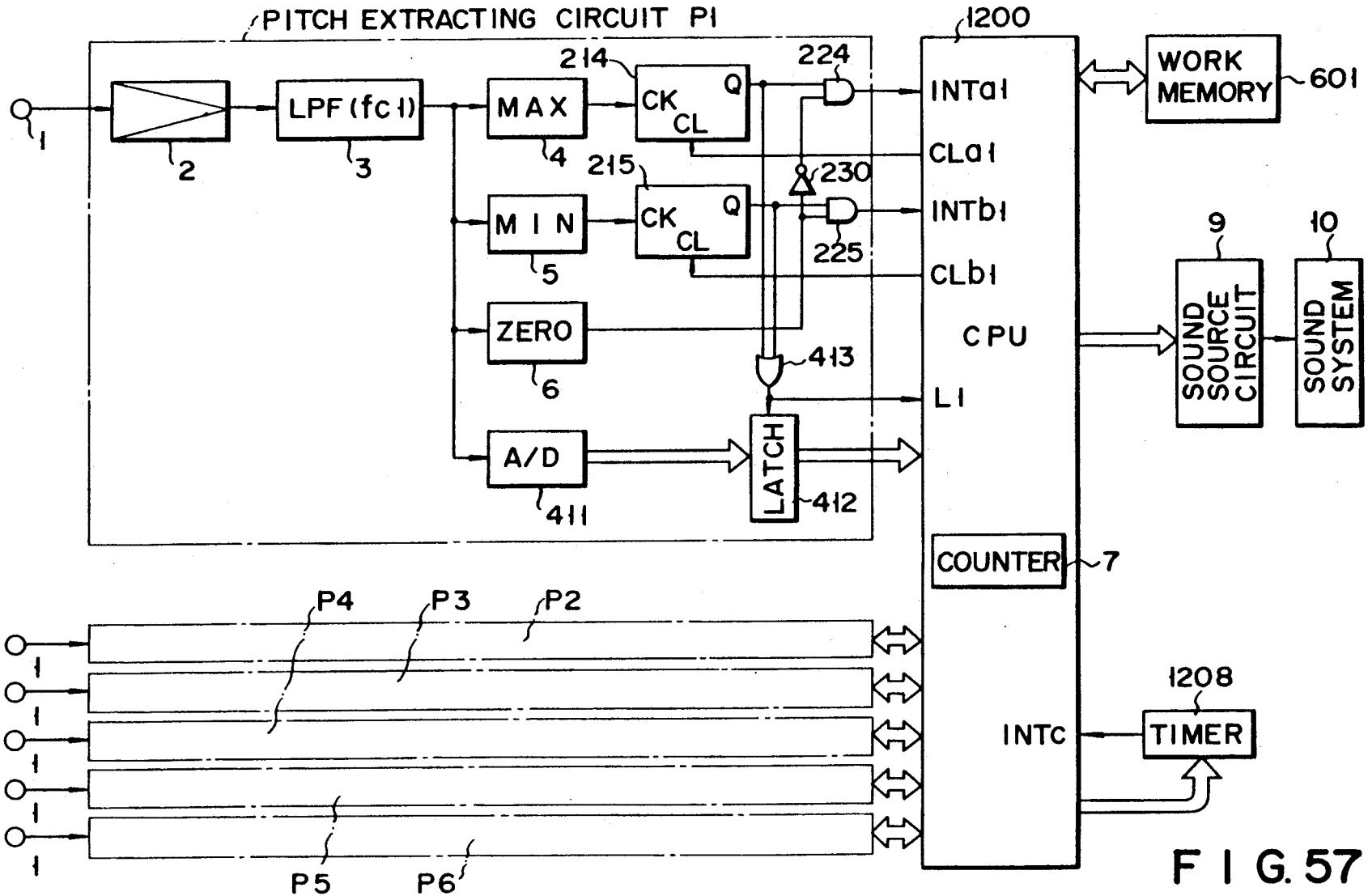
FIG. 57 shows a block diagram of a circuit arrangement of a 12th embodiment according to the present invention.

An overall circuit arrangement of the twelfth embodiment is shown in FIG. 57, and is substantially equal to that of FIG. 33. Like reference symbols are used for like portions, for simplicity.

In the FIG. 57 circuit, CPU 1200 issues a note-on command to sound source circuit 9. Upon receipt of this, a sound source circuit progressively controls the frequency of a sounding musical tone according to the time interval data, which are successively obtained. Before a pitch change command is applied to sound source circuit 9, timer 1208 counts a predetermined time duration or the time duration required for one command execution. More specifically, timer 1208 receives a control signal from CPU 1200, and measures the predetermined time, and then applies an interrupt signal INT to CPU 1200. Upon receipt of this interrupt command, the CPU executes the interrupt processing. This will be described in detail. As the result of the interrupt processing, sound source circuit 9 generates a musical tone at the frequency as defined by the pitch change command. The sound system sounds the musical tone.

2) Operation

The interrupt processings by interrupt signals INTa and INTb are substantially the same as those of FIG. 34. The description of these will be omitted.

Figure 58:
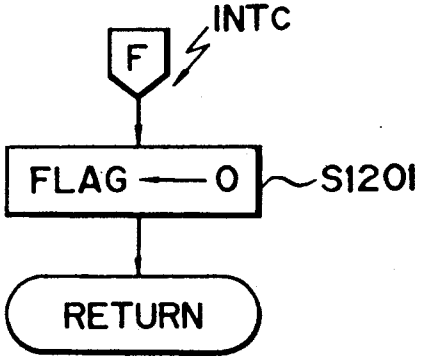
FIG. 58 shows a flowchart of a routine executed in response to an interrupt signal from a timer used in the FIG. 57 circuit.
Figure 59A:
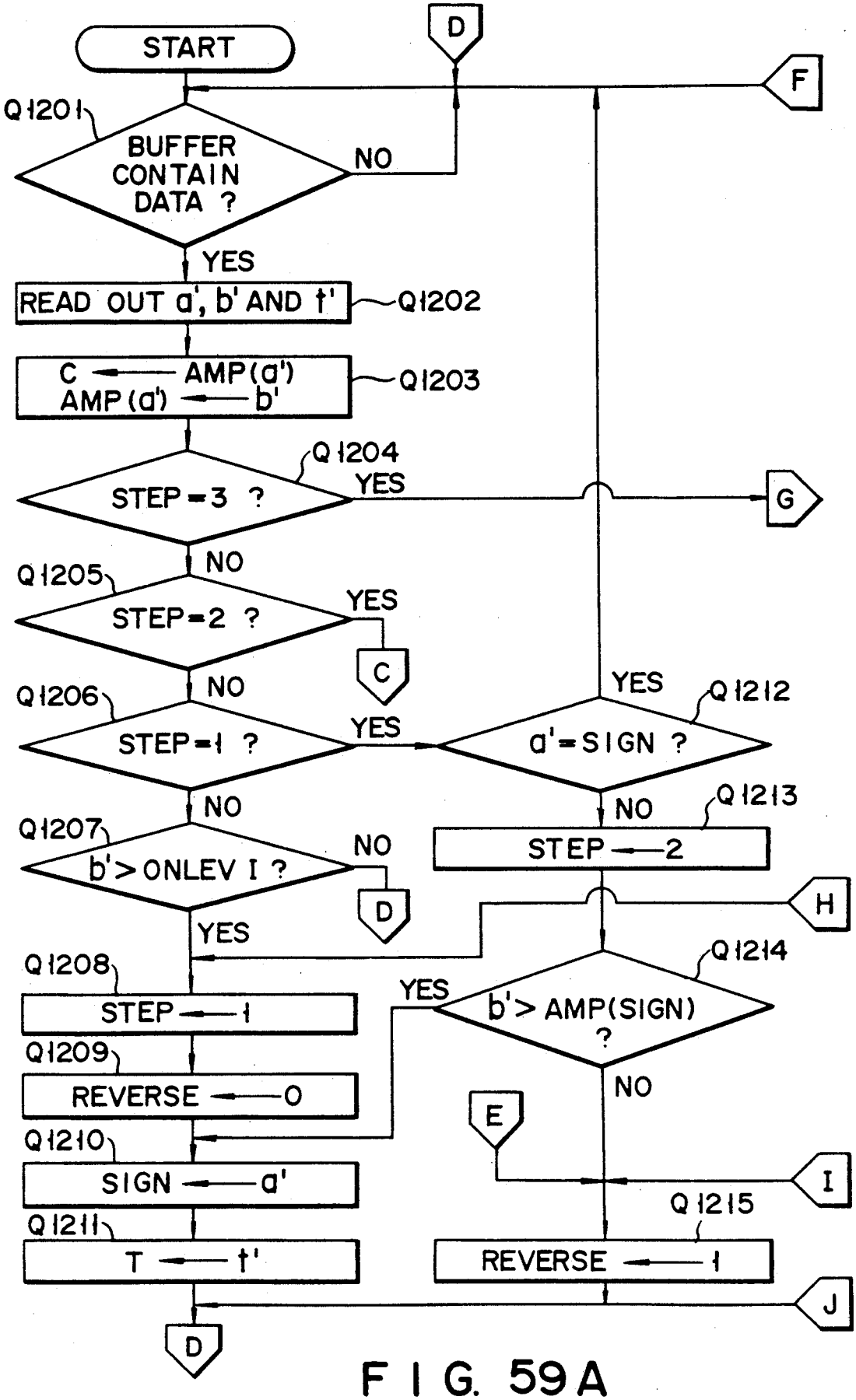
FIGS. 59A and 59B show a flowchart showing a main routine executed by the in the FIG. 57 circuit.
Figure 59B:
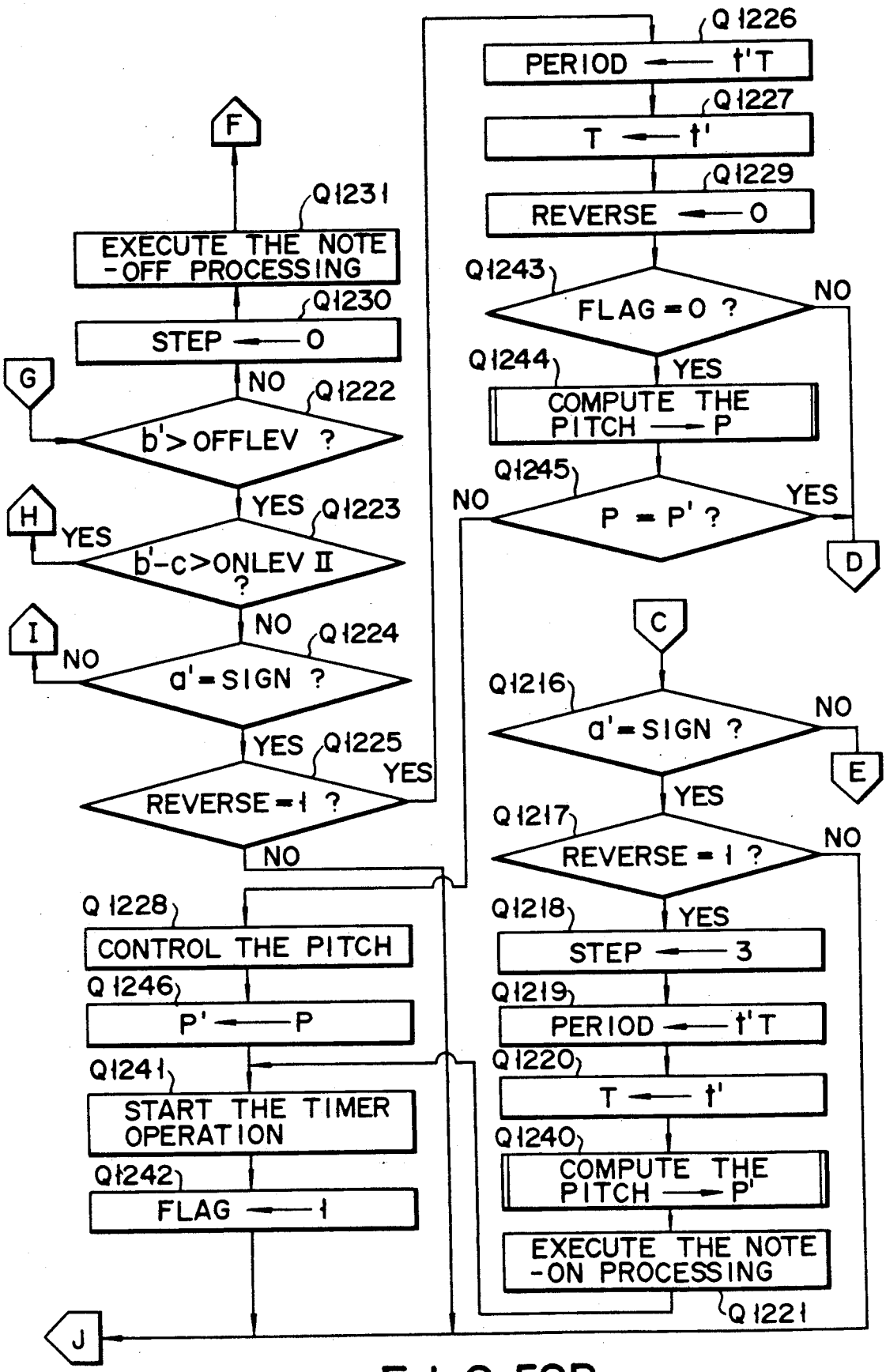

An interrupt routine by interrupt signal INTc is illustrated in FIG. 58. A main routine of the twelfth embodiment is shown in FIGS. 59A and 59B. The main routine is for the processing of the waveform generated by one string. The processing of the main routine is correspondingly applied for the waveforms of other strings. In the actual circuit operation of the electronic guitar, CPU 1200 executes these main routines in a time divisional manner.

The timing charts of signals of the electronic guitar according to this embodiment, when it receives the input signal of musical tone, are substantially the same as those of FIGS. 36 to 38. These figures will be used in this embodiment.

Before proceeding with the detailed description of the CPU operation, main registers in work memory 601 will first be described.

A STEP register contains four contents 0, 1, 2, and 3. The contents of the STEP register progressively change, as shown in FIG. 36(*b*) or FIG. 37(*b*), as the string is picked and vibrates (FIG. 36(*a*) or FIG. 37(*a*)). The contents 0 of this register represents the note-off state.

A SIGN register is used for indicating that the zero-cross point for period measurement follows the maximum peak point or the minimum peak point. The contents 1 of the register indicates the zero-cross point after the maximum peak point, and the contents 2 of the register indicates the zero-cross point after the minimum peak point.

A REVERSE register stores the data to check whether the interrupt processing has been made, which is executed at the arrival of the zero-cross point after the peak point which is located in opposition to the zero-cross point as given by the SIGN register.

A T register stores the count of counter 7 at a specific point to measure the period of the input waveform. Count 7 free runs responsive to a given clock signal.

An AMP (i) register stores the maximum or minimum peak value, more exactly, its absolute value, which is applied from A/D converter 11 and latched in 12. An AMP (1) register stores the maximum peak value, and an AMP (2) is for minimum peak value storage.

A PERIOD register stores the data of measured periods. On the basis of the contents of this register, CPU 1200 executes the frequency control for frequency ROM 8 and sound source circuit 9.

A FLAG register is used for control purposes. When timer 1208 counts a predetermined time, it contains "0". Before its counting, the FLAG register contains 21".

P and P' registers store the frequency data representing the extracted pitches including the frequencies of semitone or less expressed in cent, for example).

As will be described later, for various types of judgement, three constants (threshold levels) are contained in CPU 1200.

The first constant is ONLEVI. As shown in FIG. 36(*a*) and FIG. 37(*a*), the system is in the note-off mode. In this mode, when a peak level higher than ONLEVI is detected, the CPU decides that a string has been picked, and starts the period measurement.

ONLEVII is used in such a way that in the note-on mode, when the difference between the previous and this-time detection levels is above the level of ONLEVEII, the CPU decides that the tremolo playing is performed, and executes the relative-on processing.

OFFLEV is used in such a manner that in the note-on mode, if the peak value detected is below this level of OFFLEV the note-off processing is executed (FIG. 38(*a*)).

A main routine and interrupt routines, which are used in the twelfth embodiment, will be described. The preparatory knowledge as mentioned above will assist you in understanding the routine description to follow.

Upon arrival of interrupt command signal INTc, CPU 1200 executes the interrupt processing shown in FIG. 58. In step S1201, the CPU clears the FLAG register to "0", and completes this routine processing.

In step Q1201 of the main routine (FIGS. 59A and 59B), CPU 1200 judges whether or not the contents of the a'-, b'-, and c'-registers have been stored into work memory 601, through the interrupt processing. Primed characters a', b' and c' correspond to a, b and c above, and indicate that these items of data have previously stored, respectively. If no interrupt processing has been not executed, the answer to step Q1201 is NO, and CPU 1200 repeats the execution of step Q1201.

If the answer is YES, the CPU advances to step Q1202. In this step, the CPU reads out the registered contents a', b' and t'. Then, the CPU goes to step Q1203, and reads out the peak value at the peak point of the same type (maximum or minimum) which has been stored in AMP (a') register. The CPU sets the peak value b' extracted this time into AMP (a') register.

In step 1204 to Q1206, the CPU checks if the contents of STEP register is 3, 2 or 1. When the system of the electronic guitar under discussion is in the initial condition, the STEP register is 0, and therefore the answer to steps 1204, Q1205 and Q1206 is NO. In step Q1207, the CPU checks if the peak value b' detected this time is above or below the level of ONLEVI.

If the peak value b' is below ONLEVI, the sounding start processing is not executed and the CPU returns to step Q1201. If it is above ONLEVI, as shown in FIG. 36(*a*) and FIG. 37(*a*), step Q1207 gives the answer of YES and the CPU advances to step Q1208.

In step Q1208, the CPU sets "1" to the STEP register. In the next step Q1209, the CPU sets "0" to the REVERSE register.

In step Q1210, the CPU inputs the value of a' into the SIGN register. The value of a' is "1" at the zero-cross point immediately after the maximum peak point, and is "2" at the zero-cross point immediately after the minimum peak point.

In step Q1211, the value of t' is set in the T register. As the result of it, the value of a' is set in the SIGN register, that of b' in the AMP register, and that of t' in the T register. In this instance, the value of the SIGN register is "1" (FIG. 36(*a*) and FIG. 37(*a*)). Then, the CPU returns to step Q1201 again.

The processing of the main routine immediately after zero-cross point Zero 1 in FIG. 36(*a*) and FIG. 37(*a*) is completed through the execution of the sequence of processing steps as explained above.

The main routine immediately after the zero-cross point Zero 2 will be described. In this processing, steps Q1201, Q1202, Q1203, 1204, Q1205 and Q1206 will be executed. If the answer YES is given in step Q1206, the CPU advances to step Q1212.

When the input waveform rises at the time of waveform inputting as shown in FIG. 36(*a*) and FIG. 37(*a*), the SIGN register is "1". Since the present wave of the waveform has passed the negative peak, the register is "2" and NO is given. When the zero-cross point immediately after the peak point with the same polarity is reached, this step gives YES. The CPU does not execute any further processing and returns to step Q1201

In step Q1212, NO is given, and after that, the CPU advances to Q1213 and sets 2 in the STEP register (see FIG. 36(*b*) and FIG. 37(*b*)).

Following step Q1213, the CPU executes step Q1214 and compares the previous peak point (AMP (SIGN)) with the present peak point (b'). If the previous value X0 is smaller than the present value (X1>X0) as shown in FIG. 36(*a*), YES will be given. To set up the period measuring start point at time point t' (FIG. 36(*c*)), the CPU jumps from step Q1214 to steps Q1210 and Q1211, to set 2 in the SIGN register and at the same time to transfer the contents of the t'-register to the T register.

On the contrary, if the previous peak point is above the present peak point, X1<X0, as shown in FIG. 37(*a*), NO is given in step Q1214 and 1 is set in the REVERSE register in step Q1215. In this case, the previous value 1 is maintained in the SIGN register. As the result of it, the previous zero-cross point Zero 1 is the period measuring start point, in this case (see FIG. 37(*c*)).

When the CPU executes the main flow after the next zero-cross point (Zero 3) is passed, the CPU advances to step Q1216 after YES is given in step Q1205. The present value of a' is 1, that of the SIGN register is 2 as shown in FIG. 36, and that of the SIGN register is 1 as shown in FIG. 37. Therefore, in the case of FIG. 36, NO is given in step Q1216 and the CPU advances to Q1215 and returns to Q1201. In other words, CPU 1200 recognizes that the first peak point (amplitude X2) is passed after the period measurement starts.

In FIG. 37, the CPU has the answer of YES in step Q1216 and advances to step Q1217 to check if the value of the REVERSE register is 1. If the value of the REVERSE register is not 1, the CPU judges NO and returns to step Q1201. As mentioned above, after execution of step Q1215, the value of this register is 1. Then, the CPU advances to step Q1217 and Q1218, and inputs 3 in the STEP register (see FIG. 37(*b*)). In step S1219, the CPU subtracts the value of the T register, i.e. the time of the zero-cross point Zero 1, from the value of the counter 7 given by the this-time interrupt processing, and the CPU loads it in the PERIOD register.

The time length PERIOD shown in FIG. 37(*c*) is that of one period. In step Q1220, the CPU transfers the contents of t'-register to the T register, and starts the new period measurement.

In the subsequent step Q1240, the CPU computes the pitch of the musical tone to be generated on the basis of the PERIOD register, and loads the pitch data (some other data representing the computed data) into the P' register. The pitch data preferably contains octave, note, and the pitch of semitone or less, which are expressed in the unit of cent. In the next step S1221, CPU 1200 issues a note-on command to sound source circuit 9 in response to the contents of the P' register. From this time point, the musical tone is generated. The CPU flows to step Q1241. In this step, timer 8 starts its count and counts a predetermined time under control of the CPU. In step Q1242, "1" is set in the FLAG register.

In the case of FIG. 36, the main flow after the next zero-cross point Zero 4 is executed again, and the CPU jumps from step Q1205 to Q1216 Since the value of the SIGN register is now 2, YES is given in step Q1216. Subsequently, steps Q1217 to Q1240, Q1221, and Q1241 to 1242 are executed. At this time, CPU 1200 recognizes the time interval from zero-cross points Zero 2 to Zero 4 shown in FIG. 36(*c*), as one period. The guitar starts the sounding of the musical tone at the frequency as defined by the time length recognized (see FIG. 36(*d*)).

Thus, the period measurement is executed from the next zero-cross point after the peak point whose value is larger. The period measurement is completed at the next zero-cross point located in the same side as the previous peak point. As the result of it, one period of low-pass filter 3 output waveform is extracted.

After the sounding start processing, the CPU advances from step 1204 to step Q22 in the main routine processing, and checks if the value of the present peak point b' is above OFFLEV as shown in FIG. 38.

If now that value is above this level, the CPU advances to step Q1223, and judges whether or not the relative-on processing should be executed. In other words, the CPU checks if the value of the present peak point (b') is above that of the previous peak point by ONLEVII, i.e. checks if the value of the extracted peak point rapidly increases during sounding.

When a string is picked, the vibration of the string gradually damps toward zero. NO is given in step Q23. In case that before the vibration of the string previously picked damps to zero, another string is picked by the tremolo playing, for example, the answer to step Q23 is often YES.

In this case, the CPU jumps to step Q1208 after judging YES in Q23, and then executes step Q1209 to step Q1211. As a result, the CPU sets "1" in the STEP register, and subsequently executes the same processing as that of the sounding start. In other words, after loading "1" in the STEP register, the CPU executes step Q1216 to step Q1221 again, and executes the relative-on processing.

In the normal picking, the CPU executes step Q1223 followed by step Q1224, and compares the contents of a'-register with those of the SIGN register. If these do not coincide, the CPU advances to step Q1215 for the interrupt processing at the next zero-cross point. If these coincide, the CPU proceeds to step Q1202 because the present wave of the waveform has the peaks with the opposite polarities (positive and negative peaks) in the past. Then the CPU judges whether or not the value of the REVERSE register is "1". If the result is NO, it returns directly to step Q1201. If YES is given, the CPU advances from step Q1225 to step Q1226. Then the contents of the T register is subtracted from those of the t' register for obtaining a new period, and the result is set in the PERIOD register.

In step Q1227, the contents of t' register are transferred to the T register. In the next step Q1229, CPU 1200 clears the REVERSE register and executes the next period measurement.

In the subsequent step 1243, the CPU checks if the FLAG register contains "0". If the answer is NO, the CPU returns to step Q1201. No pitch change processing is performed on the period data as stored in the PERIOD register. When YES is given in step Q1241, that is, timer Q1208 has counted time from the previous note-on processing and pitch change processing, and the interrupt processing (FIG. 58) has been made, if a new frequency change command is applied to sound source circuit 9, the circuit 9 accepts the command for its appropriate processing.

Control flows to the next step Q1244, whose processing is similar to that of step Q1240. In the step Q1244, the pitch frequency data is set to the P register. In step Q1245, the CPU checks if the frequency data stored in the P' register is coincident with that in the P register obtained this time.

If these are coincident, no frequency change is required, and control flows from step Q1245 to Q1201. If these are not coincident, the CPU decides that the frequency of the input signal has been changed by the guitar playing, for example, and executes the following processing to change the frequency of the output musical tone.

When NO is given in step Q1245, control flows to step Q1228. In this step, the pitch data in the register is transferred to sound source circuit 9. In response to a new pitch change command, the circuit changes the old frequency of the musical tone to the new one.

In step Q1228, CPU 1200 transfers the contents of the P register to the P' register, and in steps Q1241 and 1242, is ready for the next pitch change.

Thus, this embodiment discretely and momently picks up a variation of the frequency of string vibration, and controls the frequency according to the picked up discrete data in a real time manner.

As described above, when the string vibration damps and the peak value becomes below the level of OFFLEV, as shown in FIG. 38, the CPU jumps from step Q1222 to step Q1230 to clear the STEP register. In the next step Q1231, the note-off processing is executed, and the CPU gives the note-off command to sound source circuit 9, to stop the sounding of musical tone.

As seen from the foregoing, after the note-on command and the note-off command are applied to sound source circuit 9, and further at least a predetermined time counted by timer 1208, viz., the time required for sound source circuit 9 to complete its processing, is elapsed, a new pitch change command is applied to sound source circuit 9. Therefore, the electronic guitar of this embodiment can execute the satisfactory processing when receiving a musical tone with continually and rapidly changing pitches This can be realized with high resolution of pitch, and regardless of the data transfer speed between CPU 1200 and sound source circuit 9.

As soon as a note-on command or a note-off command is issued, CPU 1200 executes the corresponding processing, and gives a necessary command to sound source circuit 9. In this respect, the guitar system is good in response.

In the above-mentioned embodiment, the CPU executes the interrupt processing at the zero-cross point immediately after each peak point followed by the various types of processings such as the sounding start, period calculation, relative-on and note-off. If necessary, these processings can be executed when each peak point is detected or when the zero-cross point immediately before the peak point is detected. Any other suitable measure may be taken for obtaining the reference point. If necessary, an additional pitch extraction system may be used, which is based on the auto-correlation function.

While in the above-mentioned embodiment, the present invention is applied for the electronic guitar, it can be applied for any other systems of the type in which pitches are extracted from a sound signal or an electrical vibration as input from a microphone, for example, and an acoustic signal, which is different from the original signal, is generated at the pitches or note frequencies corresponding to those of the original signal. Specific examples of such are electronic pianos with key boards, electronic wind instruments, electronic string instruments such as electronic violins and koto (Japanese string instrument).

As described above, once a not-on command or a pitch change command is issued, an additional pitch change command is prohibited until the time count means counts a predetermined time. Therefore, the electronic guitar of this embodiment has a high pitch resolution with a low frequency of outputting the pitch change commands.

It should be understood that the novel technical ideas with satisfactory inventive steps, which are presented in the first to twelfth embodiments may be applied, individually and in combination, to musical instruments. It is evident to those skilled in the art that the present invention may further be modified and changed as in various ways, all of which fall within the scope of the invention.

What is claimed is:

1. An electronic string musical instrument of a type in which musical tones are generated on the basis of pitches extracted from an input waveform signal produced by the vibration of a string, comprising:

pitch extracting means for extracting pitches from the input waveform signal;

input signal check means for checking whether said input waveform signal is present; and commanding means (a) for, when said input signal check means detects a start of the presence of said input waveform signal, providing a sounding start command to first generate a musical tone with a predetermined pitch corresponding to maximum string length in which no pitch designation operation is manipulated on an open string by a performer and (b) for, when the pitch of said input waveform signal is extracted by said pitch extracting means, providing a command to change the pitch of said generated musical tone to the extracted pitch.

2. The electronic string musical instrument according to claim 1, in which said pitch extracting means comprises:

peak detecting means for detecting at least one of a positive and a negative peak point in the input waveform signal;

zero-cross point detecting means for detecting zero-cross points in said input waveform signal; and means for detecting at least one of a time interval (t1) between successive first zero-cross points detected by said zero-cross point detecting means after after respective ones of the positive peak points are detected by said peak point detecting means and a time interval (t2) between successive first zero-cross points detected by said zero-cross point detecting means after respective ones of the negative peak points are detected by said peak point detecting means.

3. An electronic musical instrument of a type in which musical tones are generated on the basis of pitches contracted from an input waveform signal comprising:

detecting means for, upon initiation of said input waveform signal, detecting two periods of said input waveform signal within a time duration shorter than two periods of said input waveform signal; and commanding means for when the two periods detected by said detecting means are substantially equal to each other, providing a command to initiate generation of a musical tone at a frequency whose period corresponds to a period of the input waveform signal derived from at least one of the two detected periods of the input waveform signal.

4. The electronic musical instrument according to claim 3, in which said detecting means detects said two periods by detecting a time duration (t1) between successive first zero-cross points appearing after respective positive peak points of said input waveform signal that are detected, and by detecting a time duration (t2) between successive first zero-cross points appearing after respective negative peak points of said input waveform signal that are detected.

5. The electronic musical instrument according to claim 3, in which said detecting means detects said two periods by detecting a time interval (T1) at which positive peak points appear and by detecting a time interval (T2) at which negative peak points appear.

6. An electronic string musical instrument of a type in which musical tones are generated on the basis of pitches extracted from signals produced by the vibrations of strings comprising:

detecting means for detecting, when inputting of said input waveform signal is initiated, whether a rate of increase of peak values of the input waveform signal is steep or gentle;

commanding means for, when said detecting means detects a gentle rate of increase of peak values of the input waveform signal, not providing a musical tone sounding command, and when said detecting means detects a steep rate of increase of peak values of the input waveform signal, providing a musical tone sounding command; and wherein said detecting means detects the steep or gentle rate of increase of the input waveform signal by using at least one of (a) a difference between and (b) a ratio of a previously detected peak value of said input waveform signal and a presently detected peak value of the input waveform signal.

7. The electronic string musical instrument according to claim 6, further comprising pitch extracting means for extracting a pitch data from said input waveform signal, said pitch extracting means comprising:

peak detecting means for detecting at least one of a positive and a negative peak point in the input waveform signal;

zero-cross point detecting means for detecting zero-cross points in said waveform signal; and means for detecting at least one of a time interval (t1) between successive first zero-cross points detected by said zero-cross point detecting means after respective positive peak points are detected by said peak point detecting means and a time interval (t2) between successive first zero-cross points detected by said zero-cross point detecting means after respective negative peak points are detected by said peak point detecting means.

8. An electronic string musical instrument of a type in which musical tones are generated on the basis of pitches extracted from input waveform signals produced by the vibrations of strings, comprising:

detecting means for detecting positive and negative peak points of the input waveform signal;

measuring means for measuring a time interval in a manner that successively obtained positive and negative peak points of said input waveform signal occurring immediately after inputting of said input waveform signal is initiated are obtained, and the absolute values thereof are compared, and the peak point or a point relating to the peak point of a larger value is used as a starting point of said time interval, and an end point of said time interval is the peak point or a point relating to a peak point which is the same polarity as that of the peak point used as the starting point, and satisfies a predetermined condition; and commanding means for giving a command to generate a musical tone at a frequency based on said time interval measured by said measuring means.

9. The electronic string musical instrument according to claim 8, in which the point relating to said peak point is a zero-cross point following said peak point having the same polarity as that of the starting peak point.

10. The electronic string musical instrument according to claim 8, in which the point relating to said peak point is a zero-cross point immediately before said peak point having the same polarity as that of the starting peak point.

11. An electronic musical instrument of a type in which musical tones are generated on the basis of pitches extracted from an input waveform signal comprising:

first measuring means for measuring a given time period of one wave length of said input waveform signal;

second measuring means for measuring a given time period of one wave length partially overlapping said one wave length as measured by said first measuring means;

third measuring means for measuring a given time period of one wave length partially overlapping said one wave length as measured by said second measuring means;

judging means for judging whether the given time periods measured by said first to third measuring means are substantially equal to one another; and commanding means for, when said given time periods are substantially equal, providing a command to change the frequency of a generated musical tone based on said given time periods as measured by said first to third measuring means after the musical tone is generated.

12. An electronic string musical instrument of a type in which musical tones are generated on the basis of pitches extracted from input waveform signals produced by the vibration of strings, comprising:

detecting means for detecting a variation of peak values in said input waveform signal; and commanding means for, when said detecting means detects a rapid increase of a peak value of said input signal waveform during sounding of a musical tone, repeating a command to start the sounding of said musical tone.

13. The electronic string musical instrument according to claim 12, in which said detecting means detects a rapid increase of said input waveform signal based on (a) a difference between or (b) a ration of the peak levels of the input waveform signal as previously detected and as presently detected.

14. The electronic string musical instrument according to claim 12, further comprising pitch extracting means for extracting pitches of said input waveform signal, said pitch extracting means comprising:

peak detecting means for detecting at least one of a positive and a negative peak point in an input waveform signal;

zero-cross point detecting means for detecting zero-cross points in said waveform signal; and pitch detecting means for detecting pitches of said input waveform signal by detecting a time interval (t1) between successive first zero-cross points detected by said zero-cross point detecting means after respective positive peak points are detected by said peak point detecting means and a time interval (t2) between successive first zero-cross points detected by said zero-cross point detecting means after respective negative peak points are detected by said peak point detecting means.

15. An electronic string musical instrument of a type in which musical tones are generated on the basis of pitches extracted from input waveform signals produced by the vibration of strings, comprising:

frequency measuring means for measuring a frequency of the input waveform signal;

sounding commanding means for commanding generation of a musical tone based on the measured frequency;

detecting means for detecting positive and negative peak values of said input waveform signal;

judging means for determining whether difference values exist between the positive and negative peak values detected by said detecting means and whether those values as previously detected exceed a predetermined value; and sounding stop commanding means for commanding the stop of the musical tone sounding when said judging means detects that the difference values exceed the predetermined value.

16. The electronic string musical instrument according to claim 15, wherein said frequency measuring means comprises:

peak detecting means for detecting at least one of a positive and a negative peak point in an input waveform signal;

zero-cross point detecting means for detecting zero-cross points in said input waveform signal; and pitch detecting means for detecting pitches of said input waveform signal by detecting at least one of a time interval (t1) between successive first zero-cross points detected by said zero-cross point detecting means after respective positive peak points are detected by said peak point detecting means and a time interval (t2) between successive first zero-cross points detected by said zero-cross point detecting means after respective peak points are detected by said peak point detecting means.

17. An electronic musical instrument of a type in which musical tones are generated on the basis of pitches extracted from an input waveform signal comprising:

frequency measuring means for measuring a frequency of said input waveform signal;

sounding commanding means for providing a command to generate a musical tone based on the frequency measured by said frequency measuring means;

level judging means for judging whether an amplitude level of said input waveform signal is below a predetermined value;

continue judging means for judging whether the input signal amplitude level below the predetermined level continues for a predetermined period of time; and sounding stop commanding means for stopping sounding when said continue judging means judges that said input signal amplitude level state continues for the predetermined time.

18. The electronic musical instrument according to claim 17, in which said frequency measuring means comprises:

peak detecting means for detecting at least one of a positive and a negative peak point in an input waveform signal;

zero-cross point detecting means for detecting zero-cross points in said waveform signal; and pitch detecting means for detecting pitches of said input waveform signal by detecting at least one of a time interval (t1) between successive first zero-cross points detected by said zero-cross point detecting means after respective positive peak points are detected by said peak point detecting means and a time interval (t2) between successive first zero-cross points detected by said zero-cross point detecting means after respective negative peak points are detected by said peak point detecting means.

19. An electronic string musical instrument of a type in which musical tones are generated on the basis of pitches extracted from input waveform signals produced by the vibration of strings, comprising:

memory means for storing pitch data representing an extracted pitch;

comparing means for comparing pitch data representing a previously extracted pitch and stored in said memory means with pitch data representing a presently extracted pitch; and control means for, when a comparison result of said comparing means shows that the presently extracted pitch is about one octave higher than the previously extracted pitch represented by the pitch data read out from said memory means, (a) judging that harmonics are generated, and (b) for outputting a sounding stop command to stop the sounding of a musical tone.

20. The electronic string musical instrument according to claim 19, further comprising pitch extracting means for extracting pitches from said input waveform signal, said pitch extracting means comprising:

peak detecting means for detecting at least one of positive and negative peak points in an input waveform signal;

zero-cross point detecting means for detecting zero-cross points in said waveform signal; and pitch detecting means for detecting pitches of said input waveform signal by detecting a time interval (t1) between successive first zero-cross points detected by said zero-cross point detecting means after respective positive peak points are detected by said peak point detecting means and a time interval (t2) between successive first zero-cross points detected by said zero-cross point detecting means after respective positive peak points are detected by said peak point detecting means.

21. An electronic musical instrument having a pitch detecting means for detecting a fundamental pitch frequency from an input waveform signal, and commanding means for commanding sound source means to generate a musical tone at a pitch based on said fundamental pitch frequency as detected by said pitch detecting means, comprising:

time count means for, every time said commanding means provides a sounding start command or a pitch change command to said sound source means, measuring the time elapsed from when it is given; and means for causing said commanding means to provide a new pitch change command based on the fundamental pitch frequency as detected by said pitch detecting means after said time count means measure a predetermined time.

22. The electronic musical instrument according to claim 21, in which said pitch detecting means comprises:

peak detecting means for detecting at least one of a positive and a negative peak point in an input waveform signal;

zero-cross point detecting means for detecting zero-cross points in said waveform signal; and detecting means for detecting pitches of said input waveform signal by detecting a time interval (t1) between successive first zero-cross points detected by said zero-cross point detecting means after respective positive peak points are detected by said peak point detecting means and a time interval (t2) between successive first zero-cross points detected by said zero-cross point detecting means after respective negative peak points are detected by said peak point detecting means.

23. An electronic musical instrument having a plurality of strings, comprising:

a plurality of vibration detecting means for detecting vibrations of corresponding ones of the plurality of strings, respectively, and each of the plurality of vibration detecting means including:

(a) sensor means for sensing a vibration of a corresponding string to obtain an electric signal representative of the vibration, (b) low-pass filtering means coupled to said sensor means for filtering high frequency components of the electric signal to produce a filtered electric signal, a cut-off frequency of the low-pass filtering means being determined by a note range or the corresponding string, (c) positive peak detecting means coupled to the low-pass filtering means for detecting positive peak points in the filtered electric signal output from the low-pass filtering means, and (d) negative peak detecting means coupled to the low-pass filtering means for detecting negative peak points in the filtered electric signal output from the low-pass filtering means; and processing means including a CPU which is coupled to the positive peak detecting means and the negative peak detecting means of each of the plurality of vibration detecting means for executing pitch extracting and designating operations for each string time-divisionally, said CPU time-divisionally executing for each string:

(a) identifying, from all positive peak points detected by said positive peak detecting means, a first positive peak point succeeding to the negative peak point detected by said negative peak detecting means;

(b) identifying, from all negative peak points a detected by said negative peak detecting means, a first negative peak point succeeding to the positive peak point detected by said positive peak detecting means;

(c) measuring at least one of a time duration between first positive peak points succeeding to negative peak points and a time duration between first negative peak points succeeding to positive peak points; and (d) outputting pitch data to determine tone pitches from said at least one measured time duration.

24. An electronic musical instrument having a plurality of strings, comprising:

a plurality of vibration detecting means for detecting vibrations of corresponding ones of the plurality of strings, respectively, and each of the plurality of vibration detecting means including:

(a) sensor means for sensing a vibration of a corresponding string to obtain an electric signal representative of the vibration, (b) low-pass filtering means coupled to said sensor means for filtering high frequency components of the electric signal to produce a filtered electric signal, a cut-off frequency of the low-pass filtering means being determined by a note range of the corresponding string, (c) positive peak detecting means coupled to the low-pass filtering means for detecting positive peak points in the filtered electric signal output from the low-pass filtering means, and (d) negative peak detecting means coupled to the low-pass filtering means for detecting negative peak points in the filtered electric signal output from the low-pass filtering means; and processing means coupled to the positive peak detecting means and the negative peak detecting means of each of the plurality of vibration detecting means for executing pitch extracting and designating operations for each string time-divisionally, and comprising, for each string:

(a) means for identifying, from all positive peak points detected by said positive peak detecting means, a first positive peak point succeeding to the negative peak point detected by said negative peak detecting means;

(b) means for measuring a time duration between the first positive peak points succeeding to negative peak points; and (c) means for outputting pitch data to determine tone pitches from said at least one measured time duration.

25. An electronic musical instrument having a plurality of strings, comprising:

a plurality of vibration detecting means for detecting vibrations of corresponding ones of the plurality of strings, respectively, and each of the plurality of vibration detecting means including:

(a) sensor means for sensing a vibration of a corresponding string to obtain an electric signal representative of the vibration, (b) low-pass filtering means coupled to said sensor means for filtering high frequency components of the electric signal to produce a filtered electric signal, a cut-off frequency of the low-pass filtering means being determined by a note range of the corresponding string, (c) positive peak detecting means coupled to the low-pass filtering means for detecting positive peak points in the filtered electric signal output from the low-pass filtering means, and (d) negative peak detecting means coupled to the low-pass filtering means for detecting negative peak points in the filtered electric signal output from the low-pass filtering means; and processing means coupled to the positive peak detecting means and the negative peak detecting means of each of the plurality of vibration detecting means for executing pitch extracting and designating operations for each string time-divisionally, and comprising, for each string:

(a) means for identifying, from all negative peak points detected by said negative peak detecting means, a first negative peak point succeeding to the positive peak point detected by said positive peak detecting means;

(b) means for measuring a time duration between the first negative peak points succeeding to positive peak points; and (c) means for outputting pitch data to determine tone pitches from said at least one measured time duration.

26. An electronic musical instrument having a plurality of strings, comprising:

a plurality of vibration detecting means for detecting vibrations of corresponding ones of the plurality of strings, respectively, and each of the plurality of vibration detecting means including:

(a) sensor means for sensing a vibration of a corresponding string to obtain an electric signal representative of the vibration, (b) low-pass filtering means coupled to said sensor means for filtering high frequency components of the electric signal to produce a filtered electric signal, a cut-off frequency of the low-pass filtering means being determined by a note range of the corresponding string, (c) peak detecting means coupled to the low-pass filtering means for detecting at least one of a positive and a negative peak point in the filtered electric signal output from the low-pass filtering means, and (d) zero-cross point detecting means for detecting zero-cross points in the filtered electric signal output from the low-pass filtering means; and processing means coupled to the peak detecting means and the zero-cross point detecting means of each of the plurality of vibration detecting means for executing pitch extracting and designating operations for each string time-divisionally, and comprising, for each string:

(a) means for extracting pitches of the electric signal to produce pitch data by detecting at least one of a time interval (t1) between successive first zero-cross points detected by said zero-cross point detecting means after respective positive peak points are detected by said peak detecting means and a time interval (t2) between successive first zero-cross points detected by said zero-cross point detecting means after respective negative peak points are detected by said peak detecting means, and (b) means for outputting said pitch data to determine tone pitches in accordance with the extracted pitches of the electrical signal.

27. An electronic musical instrument having a plurality of strings, comprising:

a plurality of vibration detecting means for detecting vibrations of corresponding ones of the plurality of strings, respectively, and each of the plurality of vibration detecting means including:

(a) sensor means for sensing a vibration of a corresponding string to obtain an electric sensor output signal representative of the vibration, (b) positive peak detecting means coupled to said sensor means for detecting positive peak points in the electric sensor output signal, and (c) negative peak detecting means coupled to said sensor means for detecting negative peak points in the electric sensor output signal; and processing means coupled to the positive peak detecting means and the negative peak detecting means of each of the plurality of vibration detection means for executing pitch extracting and designating operations for each string time-divisionally, and comprising, for each string:

(a) means for identifying, from all positive peak points detected by said positive peak detecting means, a first positive peak point succeeding to the negative peak point detected by said negative peak detecting means, (b) means for identifying, from all negative peak points detected by said negative peak detecting means, a first negative peak point succeeding to the positive peak point detected by said positive peak detecting means, (c) means for measuring at least one of a time duration between successive ones of the first positive peak points succeeding negative points and a time duration between successive ones of the first negative peak points succeeding positive peak points, and (d) means for determining tone pitches from said at least one measured time duration.

28. The pitch detection apparatus according to claim 27, wherein said sensor means includes low-pass filtering means for filtering high frequency components of the electric signal, and a cut-off frequency of the low-pass filtering means is determined by a note range of the corresponding string.

29. An electronic musical instrument having a plurality of strings, comprising:

a plurality of vibration detecting means for detecting vibrations of corresponding ones of the plurality of strings, respectively, and each of the plurality of vibration detecting means including:

(a) sensor means for sensing a vibration of a corresponding string to obtain an electric sensor output signal representative of the vibration, (b) positive peak detecting means coupled to said sensor means for detecting positive peak points in the electric sensor output signal, and (c) negative peak detecting means coupled to said sensor means for detecting negative peak points in the electric sensor output signal; and processing means coupled to the positive peak detecting means and the negative peak detecting means of each of the plurality of vibration detection means for executing pitch extracting and designating operations for each string time-divisionally, and comprising, for each string:

(a) means for identifying, from all positive peak points detected by said positive peak detecting means, a first positive peak point succeeding to the negative peak point detected by said negative peak detecting means, (b) means for measuring a time duration between successive ones of the first positive peak points succeeding to negative peak points, and (c) means for determining tone pitches from said measured time duration.

30. The pitch detection apparatus according to claim 29, wherein said sensor means includes low-pass filtering means for filtering high frequency components of the electrical signal, and a cut-off frequency of the low-pass filtering means is determined by a note range of the corresponding string.

31. An electronic musical instrument having a plurality of strings, comprising:

a plurality of vibration detecting means for detecting vibrations of corresponding ones of the plurality of strings, respectively, and each of the plurality of vibration detecting means including:

(a) sensor means for sensing a vibration of a corresponding string to obtain an electric sensor output signal representative of the vibration, (b) positive peak detecting means coupled to said sensor means for detecting positive peak points in the electric sensor output signal; and (c) negative peak detecting means coupled to said sensor means for detecting negative peak points in the electric sensor output signal; and processing means coupled to the positive peak detecting means and the negative peak detecting means of each of the plurality of vibration detection means for executing pitch extracting and designating operations for each string time-divisionally, and comprising, for each string:

(a) means for identifying, from all negative peak points detected by said negative peak detecting means, a first negative peak point succeeding to the positive peak point detected by said positive peak detecting means, (b) means for measuring a time duration between successive ones of the first negative peak points succeeding to positive peak points, and (c) means for determining tone pitches from said measured time duration.

32. The pitch detection apparatus according to claim 31, wherein said sensor means includes low-pass filtering means for filtering high frequency components of the electric signal, and a cut-off frequency of the low-pass filtering means is determined by a note range of the corresponding string.

33. A pitch detection apparatus for an electronic stringed musical instrument having a plurality of strings to be plucked, comprising:

a plurality of vibration detecting means for detecting vibrations of the strings, and each of the vibration detecting means including:

(a) sensor means for sensing a vibration of a corresponding string to obtain an electric signal representative of the vibration, (b) peak detecting means coupled to the sensor means for detecting at least one of a positive and a negative peak point in the filtered electric signal output from the sensor means, and (c) zero-cross point detecting means for detecting zero-cross points in the electric signal output from the sensor means; and processing means coupled to the respective peak detecting means and the respective zero-cross point detecting means of each of the plurality of vibration detecting means for executing pitch extracting and designating operations for each string time-divisionally, and comprising, for each string:

(a) means for extracting pitches of the electric signal by detecting at least one of a time interval (t1) between successive first zero-cross points detected by said zero-cross point detecting means after respective positive peak points are detected by said peak detecting means and a time interval (t2) between successive first zero-cross points detected by said zero-cross point detecting means after respective negative peak points are detected by said peak detecting means, and (b) means for determining tone pitches in accordance with the extracted pitches of the electrical signal.

34. The pitch detection apparatus according to claim 33, wherein said sensor means includes low-pass filtering means for filtering high frequency components of the electric signal, and a cut-off frequency of the low-pass filtering means is determined by a note range of the corresponding string.

35. An electronic string musical instrument of a type in which musical tones are generated in accordance with the vibrations of strings, comprising:

detecting means for detecting, when inputting of said input waveform signal is initiated, whether a rate of increase of peak values of the input waveform signal is steep or gentle;

commanding means for, when said detecting means detects a gentle rate of increase of peak values of the input waveform signal, not providing a musical tone sounding command, and when said detecting means detects a steep rate of increase of peak values of the input waveform signal, providing a musical tone sounding command; and wherein said detecting means detects the steep or gentle rate of increase of the input waveform signal by using at least one of (a) a difference between and (b) a ratio of a previously detected peak value of said input waveform signal and a presently detected peak value of the input waveform signal.

36. An electronic string musical instrument of a type in which musical tones are generated in accordance with the vibration of strings, comprising:

detecting means for detecting a variation of peak values in said input waveform signal; and commanding means for, when said detecting means detects a rapid increase of a peak value of said input signal waveform during sounding of a musical tone, repeating a command to start the sounding of said musical tone.

37. The electronic string musical instrument according to claim 36, in which said detecting means detects a rapid increase of said input waveform signal based on (a) a difference between or (b) a ratio of the peak levels of the input waveform signal as previously detected and as presently detected.

38. An electronic string musical instrument of a type in which musical tones are generated in accordance with the vibration of strings, comprising:

frequency measuring means for measuring a frequency of the input waveform signal;

sounding commanding means for commanding generation of a musical tone having a designated frequency;

detecting means for detecting positive and negative peak values of said input waveform signal;

judging means for determining whether difference values exist between the positive and negative peak values detected by said detecting means and whether those values as previously detected exceed a predetermined value; and sounding stop commanding means for commanding the stop of the musical tone sounding when said judging means detects that the difference values exceed the predetermined value.

39. An electronic musical instrument of a type in which musical tones are generated in accordance with the vibration of strings comprising:

sounding commanding means for providing a command to generate a musical tone having a designated frequency;

level judging means for judging whether an amplitude level of said input waveform signal is below a predetermined value;

continue judging means for judging whether the input signal amplitude level below the predetermined level continues for a predetermined period of time; and sounding stop commanding means for stopping sounding when said continue judging means judges that said input signal amplitude level state continues for the predetermined time.

* * * * *